United States Patent [19]

Yamada et al.

[11] 3,964,828

[45] June 22, 1976

[54] APPARATUS FOR PREPARING ELECTROPHOTOGRAPHIC MICROFILM

[75] Inventors: Hiroshi Yamada, Ichikawa; Hisanori Ataka; Yukio Shirai, Kawasaki, all of Japan

[73] Assignee: Ricoh Co., Ltd., Tokyo, Japan

[22] Filed: Dec. 21, 1973

[21] Appl. No.: 427,240

[30] Foreign Application Priority Data

Dec. 29, 1972 Japan ..... 47-3743[U]

[52] U.S. Cl. ..... 355/10

[51] Int. Cl.[2] ..... G03G 15/10

[58] Field of Search ..... 355/3, 4, 5, 10

[56] References Cited

UNITED STATES PATENTS

| | | | |
|---|---|---|---|
| 2,446,668 | 8/1948 | Tuttle | 354/88 |
| 2,760,418 | 8/1956 | Hawn | 354/88 |
| 3,115,075 | 12/1963 | Alexander | 355/5 |
| 3,117,501 | 1/1964 | Oliphant | 355/3 |
| 3,679,301 | 7/1972 | Inoue | 355/4 |

*Primary Examiner*—John Gonzales

*Attorney, Agent, or Firm*—Cooper, Dunham, Clark, Griffin & Moran

[57] ABSTRACT

An electrophotographic process and a system for preparing microfilm is provided in which use is made of a roll film including a photosensitive layer a thin film of organic photoconductive material on a film of polyester. A portion of the film is taken out of the roll and is conveyed to and stationarily held in a processing position where the film plane is vertical. A movable unit including a charger, an exposure window and a vessel of developing solution is moved parallel to the photosensitive surface which is thus held in place, in a direction which traverses the optical axis of a taking lens as well as in a direction parallel to the optical axis of the lens to effect an electrophotographic processing of the photosensitive surface while mainintaing the film plane vertical.

18 Claims, 105 Drawing Figures

APPARATUS FOR PREPARING ELECTROPHOTOGRAPHIC MICROFILM

BACKGROUND OF THE INVENTION

The invention relates to an electrophotographic process of preparing a microfilm and to a system therefor, and more particularly to a process of and a system for preparing microphotographs by using electrophotographic microfilm in an electrophotographic process.

In addition to the microfilm used for preparing silver salt photographs, there is a microfilm adapted for use in electrophotography. The photosensitive film used in electrophotography comprises a photosensitive layer which is a thin film of organic photoconductive material coated on a film of polyester. Microphotographs are made by subjecting such film to the known electrophotographic steps of charging, exposing and developing. The resulting electrophotographic microfilm may be taken up on a suitable reel so that it may be stored as a recorded roll of film. Alternatively, it may be cut to suitable lengths, for example, lengths each providing a succession of 12 frames, and the cut film can be arranged on and affixed to a suitable transparent thin mount of transparent frame to provide a microfiche suitable for storage.

When subjecting electrophotographic microfilm to electrophotographic processings, either the units for charging, exposing and developing may be fixed, with the film moving across them, or the film may be held stationary while these units may be moved to be sequentially brought opposite the photosensitive surface to provide the respective processing steps. When the film is moved, the planarity of the film at the respective processing positions must be repeatedly reestablished each time the film is moved, which is inconvenient. Consequently, the latter method of maintaining the film stationary is preferred because it is only necessary to establish the planarity of the film once.

In the developing step, it is advantageous to employ a wet developing process in which the developing takes place by way of a developing solution, in view of its simplicity as compared with a dry developing process which needs a heat fixing step. When supplying developing solution to an exposed photosensitive surface, a liquid-tight developing chamber can be defined by the photosensitive surface and a vessel of developing solution located opposite thereto, with the developing solution being supplied into the interior of the chamber to contact the photosensitive surface. It would appear that when the film is placed in a horizontal position above the vessel, with the plane of the photosensitive surface facing down, the supply and drainage of the developing solution to and from the liquid-tight developing chamber defined therebetween would be facilitated. However, when the film is held in a horizontal position, with its photosensitive surface facing down, great difficulties are involved in conveying the film, because its photosensitive surface must be maintained clear of any conveying means. Consequently, it is advantageous to move the film in an upright position, in a vertical plane, and to hold it stationary in such position.

SUMMARY OF THE INVENTION

The invention is in the field of microfilming originals by using an electrophotographic process rather than the conventional photographic process. An object of the invention is to provide highly automated microfilming which is reliable, efficient, inexpensive and provides high quality microfilm images.

In a specific embodiment of the invention, electrophotographic microfilm is processed to provide multiframe strips for microfiche uses. Blank electrophotographic films is withdrawn from a horizontal roll such that the withdrawn portion of the film is in a vertical plane. A sufficient leader length of film is moved past an exposure position and then a film frame is positioned against a pressure plate that is at the exposure position. A moving unit carrying a charger, an exposure window and a developer is suitably moved to register its charger with the film frame against the pressure plate and that frame is charged uniformly. The degree of charging is selectively controllable by controlling the speed of the charging unit, or its voltage, or both. After the charging step, the movable unit aligns its exposure window with the frame at the pressure plate and an optical system projects an image of an original to form a latent image thereof on the film frame. After the exposure step, the movable unit registers the developer with the film frame at the pressure plate, forms a closed chamber having the film frame as one of its walls, and applies developing solution to the exposed film frame to develop the latent image thereon. The movable unit then returns to its original position and fixes the developing image on the film frame by a stream of hot air. The film is fed by one frame and the charging, exposure, developing and fixing steps are repeated. This continues for a selected number of frame, for example, 12 frames, after which a length of film containing a blank leader and 12 frames is severed from the roll of blank film and is delivered for incorporation into a microfiche.

Processing of the film, from loading a blank roll of microfilm to providing lengths of processed microfilm for incorporation into a microfiche, is fully automated and does not require manual intervention. Numerous provisions are made according to the invention to increase the reliability, the quality and the efficiency of the processing. For example, the microfilm frame which is being processed remains stationary against a planar pressure plate which holds it suitably by suction to thereby insure against defects resulting from lack of planarity of the processed frame or undesirable movement of the frame during processing. The image field on the frame increases with each step, i.e., the image field during charging is smaller than the image field during exposure which in turn is smaller than the image field during developing, to thereby insure against marring the margin around the desirable final image on the processed microfilm. Specific measures are taken in accordance with the invention to insure complete and even development and to remove any residual developing solution prior to the fixing step so as to provide a clean processed microfilm without any undersirable effects of residual developing solution. A receptacle for the original which is being projected on the microfilm is constructed in accordance with the invention to enhance the quality of the resulting microfilm image and to avoid undesirable marginal effects. The relative timing of the various operations is interlocked in accordance with the invention to avoid the possibility of errors or of lack or loss of synchronization between different operations.

DETAILED DESCRIPTION

Figure 1:
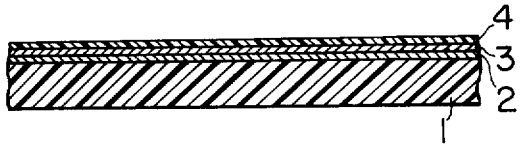
FIG. 1 is an enlarged section of a photosensitive film suitable for use in the invented electrophotographic process and system.

The photosensitive film adapted for use in the electrophotographic process as contemplated in the invention is shown in FIG. 1 as comprising a transparent film base 1 formed of polyester resin or the like on which is evaporated a conductive layer 2 formed by a transparent thin film of copper iodide, aluminum iodide or the like. Overlaid thereon is an adhesive layer 3 comprising a material such as polyvinyl acetate. Overlaid on the adhesive layer 3 is a top photosensitive layer 4 formed by a thin film of an organic photoconductive material which principally comprises poly-N-vinylcarbazole. The thickness of the entire film assembly is nearly 0.1 mm. The electrophotographic film is formed into a film roll having a width of 16 mm to provide a microfilm.

Some of the most essential portions of the invented system are described in connection with the schematic plan view of FIG. 2, where a microfilm delivery apparatus 12 including a film transport drum 6, a pair of guide rollers 7, 8 arranged in abutment against the periphery of the drum 6 and a guide piece 9 takes a suitable length of film from a roll 5 and transports it toward an electrophotographic processing station 11 while maintaining the photosensitive surface of the transported length of film in an upright position (in a vertical plane). A pressure plate 13 helps hold stationary and planar the film fed by the delivery apparatus 12 to the electrophotographic processing station 11. An apertured frame 14 is mounted on a stationary part at a position opposite to the pressure plate 13 and a movable unit 15 including a charger 16, an exposure window 17 and a vessel of developing solution 18 is disposed generally parallel to the microfilm at the processing station 11 and is movable across the photosensitive surface thereof. A suitable drive mechanism described below moves the unit 15 parallel to the photosensitive surface of the film length that is at the processing station 11 to sequentially bring the charger 16, the exposure window 17 and the vessel 18 of developing solution into alignment with the photosensitive surface of the film portion which is held stationary between the apertured frame 14 and the pressure plate 13. A taking optical system including a first reflecting mirror 19, a second reflecting mirror 20 and a focusing lens 21 projects a light image of an original onto the film portion held stationary on the pressure plate 13 through the exposure window 17 and the apertured frame 14. A shutter blade 22 normally blocks the path of the original image along the optical axis O, but moves out of the path O to permit exposing of the film to the image of the original when the movable unit 15 has moved to bring the exposure window 17 into alignment with the apertured frame 14. An original receptacle 23 is placed below the first reflecting mirror 19 and illuminating lamps L1 to L8 illuminate the original receptacle 23. Means are provided to bring an opening in the vessel 18 into alignment with the exposed photosensitive surface of the film at the processing station 11 and means are provided to supply a developing solution into the vessel 18 when it is aligned with the exposed photosensitive surface, and for draining the developing solution from the vessel after the exposed film is developed. The developed iomage is fixed by blowing dry air against the photosensitive surface. Means including an air pump are provided to circulate the developing solution so that it is supplied into the vessel 18 and is sequentially d drained therefrom by increasing and reducing the pressure to the air pump. The processed film is conveyed from the electrophotographic processing station 11 toward a film outlet; the pressure plate 13 is retracted while the film is being conveyed from the electrophotographic processing station 11 so as not to damage the film. A cutter assembly 24 severs the processed film to lengths containing a given number of frames. The severed lengths of film are transported to the front side of the system.

The moving unit 15 subjects the film portion held stationary at the electrophotographic processing station 11 to charging, exposure, developing and drying as described below.

CHARGING STEP

Figure 3:
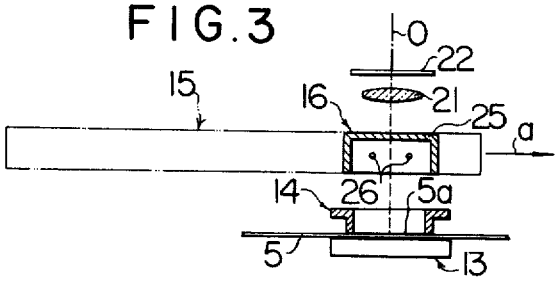
FIG. 3 is a schematic view illustrating the charging step which takes place in the system.

As shown in FIG. 3, the charger 16 is the first portion of the unit 15 to come opposite the photosensitive surface 5*a* of the film 5 held stationary between the apertured frame 14 and the pressure plate 13 when the movable unit 15 moves in the direction of an arrow *a* across the optical axis of the taking optical system. The charger 16 comprises a shield 25 having an opening mounted to be opposite the photosensitive surface 5*a* held in an upright position, and corona discharge electrodes 26 which are in the shield 25 and are at discharge voltage applied thereto from a high tension source (see also FIGS. 12 and 32). When the charger 16 moves across the photosensitive surface 5a in the direction of the arrow *a*, the discharge of the electrodes 26 causes the photosensitive layer 4 on the phtosensitive surface 5*a* to be charged. During such time, the path of the taking light is closed by the shutter blade 22. The speed of the charger 16 can be selectively varied by controlling the rotational speed of its drive motor, as described later, and the potential to which the photosensitive surface is charged can be controlled by adjusting the running speed of the charger 16 as well as the voltage applied to the electrodes 26.

Exposure step

Figure 4:
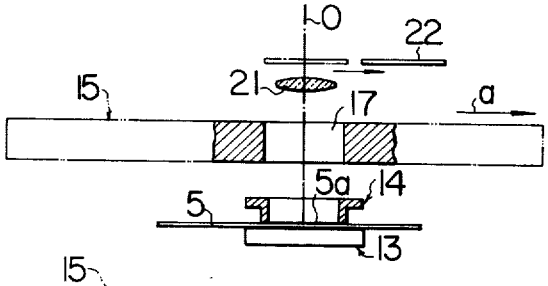
FIG. 4 is a schematic view illustrating the exposing step which takes place in the system.

The exposure step is shown in FIG. 4 as taking place when the movable unit 15 has moved to bring the exposure window 17 into alignment with the optical axis of the taking optical system. The exposure window 17 is formed approximately at the median position in the movable unit 15. When the exposure window 17 comes opposite the photosensitive surface 5*a* which has been charged by the charger 16, the unit 15 is momentarily stopped. The shutter blade 22 is immediately moved out of the path of the taking light, whereby an image of an original which is placed on the receptacle 23 and is illuminated by the lamps L1 to L8 as shown in FIG. 2 is projected upon the photosensitive surface 5*a* through the first and second reflecting mirrors 19, 20 and the focussing lens 21. This continues for a period of time determined by a timer described later, and thereafter the shutter blade 22 is restored to the blocking position to close the path of the taking light. Thereupon, the movable unit 15 resumes its movement, running in the direction of the arrow *a*.

Developing step

Figure 5:
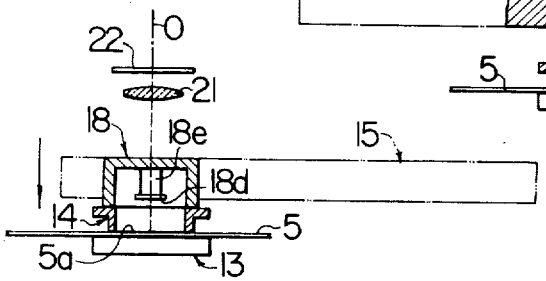
FIG. 5 is a schematic view illustrating the developing step which takes place in the system.

The developing step is shown in FIG. 5 as taking place when the movable unit 15 has moved in the direction of the arrow *a* to bring the vessel 18 of developing solution onto the optical axis of the taking optical system, so that an opening in the vessel 18 is in alignment with the photosensitive surface 5a of the exposed film held stationary between the apertured frame 14 and the pressure plate 13. Developing is effected by bringing the opening into close contact with the photosensitive surface 5*a*, with the apertured frame 14 interposed therebetween, and by supplying developing solution into the vessel 18. Specifically, when the movable unit 15 has moved to bring the vessel 18 into alignment with the photosensitive surface 5*a* of the exposed film, its movement along the arrow *a* is interrupted and the movable unit 15 is driven toward the photosensitive surface 5*a*, whereby the front end surface located on the open side of the vessel 18 is moved into abutment against the apertured frame 14 to make the vessel 18 liquid-tight by closing its open side with the exposed film. The vessel 18 is provided with a developing solution supply inlet 18*a* and a drainage port 18*b* (see FIG. 43), and is also formed with a reentrant portion 18c on which is mounted a counter-electrode plate 18*d*. When a liquid-tight chamber is formed in this manner, a quantity of developing solution sufficient to fill the chamber is supplied thereinto through the supply inlet 18a to bring the developing solution in contact with the exposed photosensitive surface. Upon completion of developing, the developing solution is drained through the drainage port 18b, and the movable unit 15 is retracted, whereby the vessel 18 is moved away from the apertured frame 14.

Drying (fixing) step

Figure 2:
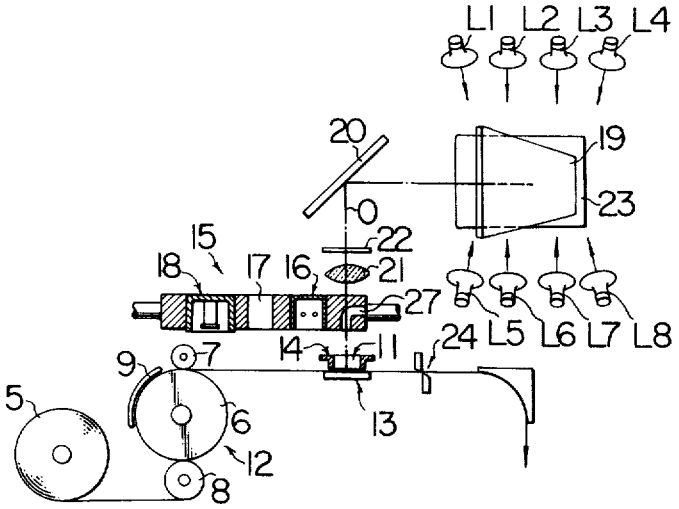
FIG. 2 is a schematic diagram showing the fundamental arrangement of the system according to the invention.
Figure 6:
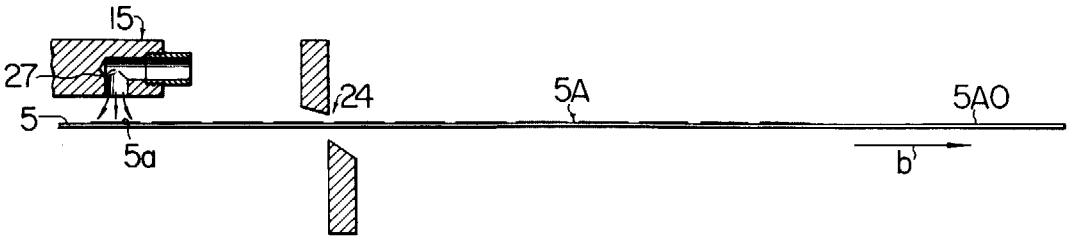
FIG. 6 is a schematic view illustrating the drying or fixing step which takes place in the system.
Figure 7:
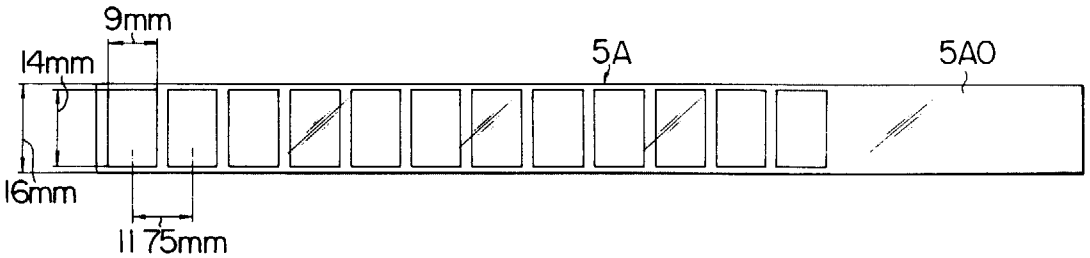
FIG. 7 is a front view of an electrophotographic film prepared with the invented system.

As shown in FIG. 6, the drying step takes place by blowing dry air against the developed photosensitive surface 5*a* from a ventilation hole 27 which is formed in the movable unit 15 adjacent the charger 16, to the right thereof as viewed in FIG. 2. After the movable unit 15 has moved in the direction of the arrow *a* to complete the charging, exposure and developing steps, it is then moved in the opposite direction to its original position, and upon reaching such position, the ventilation hole 27 is located opposite the newly developed photosensitive surface 5*a*, on the optical axis O. When the movable unit 15 has returned to such position, air is driven against the developed photosensitive surface 5*a* from the ventilation hole 27 over a period of time which is determined by a timer described later, thereby drying and fixing the photosensitive surface 5*a*. When the electrophotographic processing steps applied to the film while it is held stationary on the pressure plate 13 are completed, the film is transported by a distance corresponding to one frame toward the film outlet, whereby the next section of the photosensitive surface is positioned against the pressure plate 13. When a succession of 12 frames, for example, have been processed in this manner, the cutter assembly 24 severs a piece of film 5A, which is then transported in the direction indicated by an arrow *b* to be discharged externally of the system through the film outlet. FIG. 7 shows such pieces of film 5A, and also illustrates certain dimensions thereof.

Figure 8:
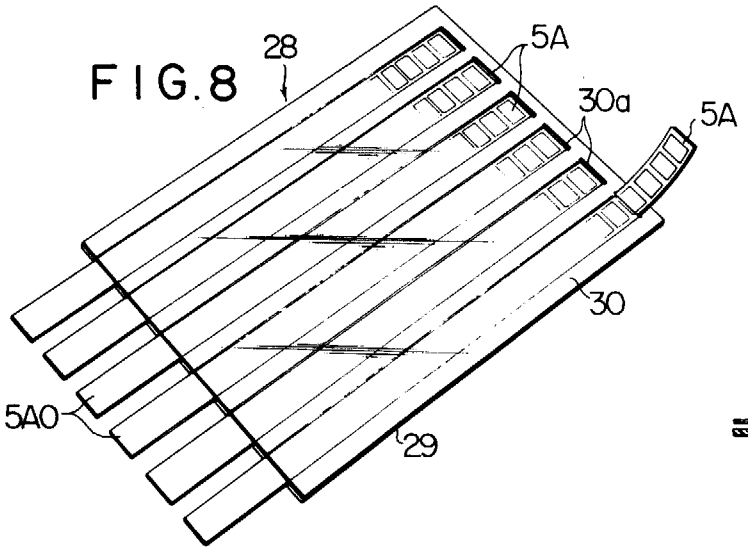
FIG. 8 is a perspective view of microfiches cut from an electrophotographic film prepared with the invented system.
Figure 9:
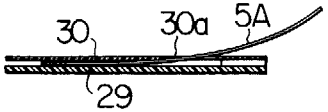
FIG. 9 is an enlarged section of the film inlet shown in FIG. 8.

As shown in FIG. 8, a microfiche may be formed from a plurality of sheets of film 5A thus prepared by retaining them in a transparent sheath-shaped support 28. The sheath-shaped support 28 comprises a thin transparent base 29, and a plurality of transparent thin film strips 30 having widths slightly greater than the width on the film 5. The strips 30 are laid on the base 29 to form a plurality of sheet receiving sheaths together with the base. At one end, the film 30 is formed with an insertion opening 30a. FIG. 9 shows that a sheet of film 5A is being inserted into the sheath through the insertion opening 30a. A plurality of sheets of film 5A may be thus mounted on the base 29 and the portions of the sheets 5A on which no microphotographs are formed may be removed by cutting, thereby providing a microfiche. In one example, the system according to the invention uses a microfilm having a width of 16 mm to reduce an image having the original size of 216 × 336 mm to 9 × 14 mm or at a reduction ratio of 24 : 1. The film has a leader 5AO (see FIGS. 6 and 7) at its forward end which extends over a length of four pitches. Successive frames are photographed at a pitch of 11.75 mm, and when a succession of 12 frames are photographed, a film sheet 5A corresponding to 15 frames inclusive of the leader is severed from the remainder of the film and is discharged externally of the system.

Figure 10:
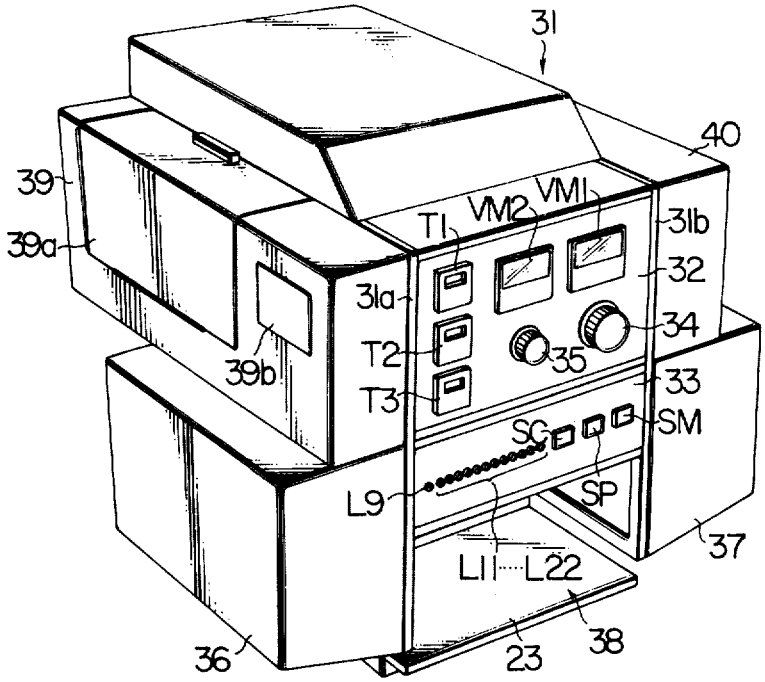
FIG. 10 is a perspective view of one embodiment of the invented electrophotographic system.

A specific embodiment of an electrophotographic system for preparing a microfilm according to the invention will now be described. The overall appearance of the system is shown in FIG. 10. The system is generally shown at 31 and includes a pair of upper and lower operating panels 32 and 33 on its front side. The upper operating panel 32 includes a voltage regulation knob 34 for the illumination lamps L1 to L8 (FIGS. 2, 11 and 12), a meter VM1 for indicating the lamp voltage, a voltage regulation knob 35 for a motor M1 (see FIGS.

12 and 87) which runs the movable unit 15, a meter VM2 for indicating the voltage supplied to the motor M1, a timer T1 for establishing the exposure time, a timer T2 for establishing the developing period, and a timer T3 for establishing the drying period. The lower operating panel 33 includes a main switch SM, a photographing switch SP, a spacing switch SC which is used to feed film when less than 12 frames are photographed, an indicator lamp L9 which indicates the amount of film remaining within the system 31, and a plurality of indicator lamps L11 to L22 which indicate how many frames have been processed within the system 31 and also the number of the frame which is to be photographed next. Each of the main switch SM, photographing switch SP and spacing switch SC comprises a pushbutton, and lamps L23 to L26 (FIG. 88A) are internally housed within these pushbuttons. When the main switch SM is turned on, the lamps L23 and L24 which are associated with the pushbuttons of the main switch and the photographing switch SP, respectively, are turned on to indicate that the system is ready for photographing. When the pushbutton of the photographing switch SP is depressed to close it, the lamp L24 within this pushbutton is turned off by the operation of relays described later and another lamp L25 having a different color is turned on. When the lamp L25 is turned on and the color presented by the pushbutton of the switch SP changes, this means that the system 31 is in its photographing operation or in the course of its electrophotographic processing. As a consequence, during such interval, a repeated depression of the photographing pushbutton SP has no effect. When the photographing operation is terminated in a normal manner, the lamp L25 turns off automatically and the lamp L24 turns on to indicate the end of photographing. When the spacing switch SC is closed, the lamp L26 located within the pushbutton thereof turns on to indicate that the system is in its spacing operation.

In this manner, the on and off states of the lamps on the lower operating panel 33 serve to indicate the operational condition of the system 31 in a suitable manner. On the rear side of the operating panels 32 and 33 are located the first reflecting mirror 19 and the second reflecting mirror 20 as shown in phantom lines in FIG. 11. The original receptacle 23 (see FIGS. 10 and 11) is disposed directly below the first reflecting mirror 19, and an original placed on the receptacle 23 is illuminated by the illumination lamps L1 to L8 (see FIGS. 2, 11 and 12) which are symmetrically located on the left and right hand sides of the receptacle in two groups of four. The image of the original is directed by the first reflecting mirror 19, located directly thereabove, toward the second reflecting mirror 20 which is positioned near the top center of the system. The second reflecting mirror 20 reflects the image of the original which comes from the first reflecting mirror 19 in a horizontal direction which is nearly at right angles thereto, toward the left-hand side wall 31a of the system 31 as viewed from the front side thereof. As indicated in FIG. 10, the illuminating lamps L1 to L8 are housed in a pair of casings 36 and 37 which are open on their confronting side, each casing housing four of the lamps. In the space subtended by these lamps, the original receptacle 23 is formed with a recess 38 for receiving an original. In a position above and rearwardly of the recess 38 are located the movable unit 15 (see FIG. 2) which is positioned toward the left-hand side wall 31a and the drive mechanism for the movable unit 15 including the running motor M1 (see FIG. 12).

To the exterior of the left-hand side wall 31a of the system 31 and above the casing 36 is located another casing 39 which houses the film feed mechanism including a film transport motor M2 (see FIG. 12), a roll of microfilm 5 which is transported by the feed mechanism and the cutter assembly for the film. The casing 39 is formed with an opening therein which is normally closed by a lid **39*a* that may be opened to load a roll of microfilm 5 into the casing 39. On the front side of the casing 39 is located an outlet for film sheets severed by the cutter assembly. This outlet is normally closed by a lid 39b**, and is opened when a film sheet is to be discharged.

To the exterior of the right-hand side wall 31b of the system 31 and above the casing 37 is located another casing 40 having a comparable size to the casing 39. The casing 40 houses electrical units which drive the system 31. Additionally, a tank of developing solution 41, a vacuum cylinder 42 used to apply suction, and an air pump 43 used to circulate the developing solution are located in the rear portion of the system 31, as shown in phantom lines in FIG. 11. The illumination lamps L1 to L8 are cooled by an air flow supplied by cooling fans M3 and M4 (see FIG. 12).

Figure 11:
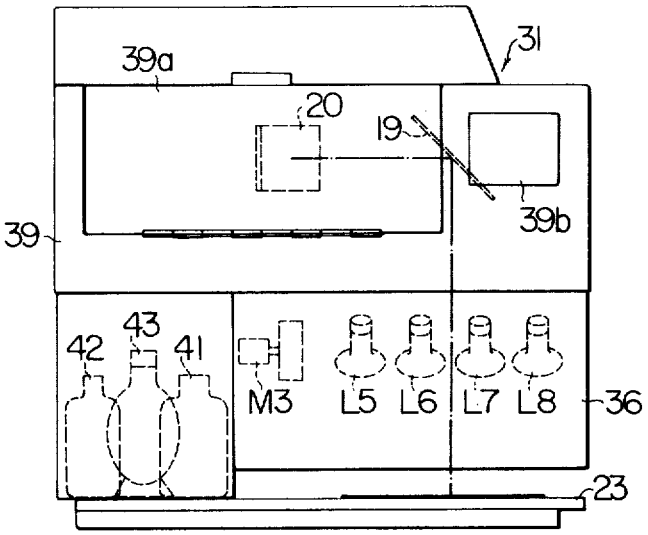
FIG. 11 is a left-hand elevation of the system shown in FIG. 10.
Figure 12:
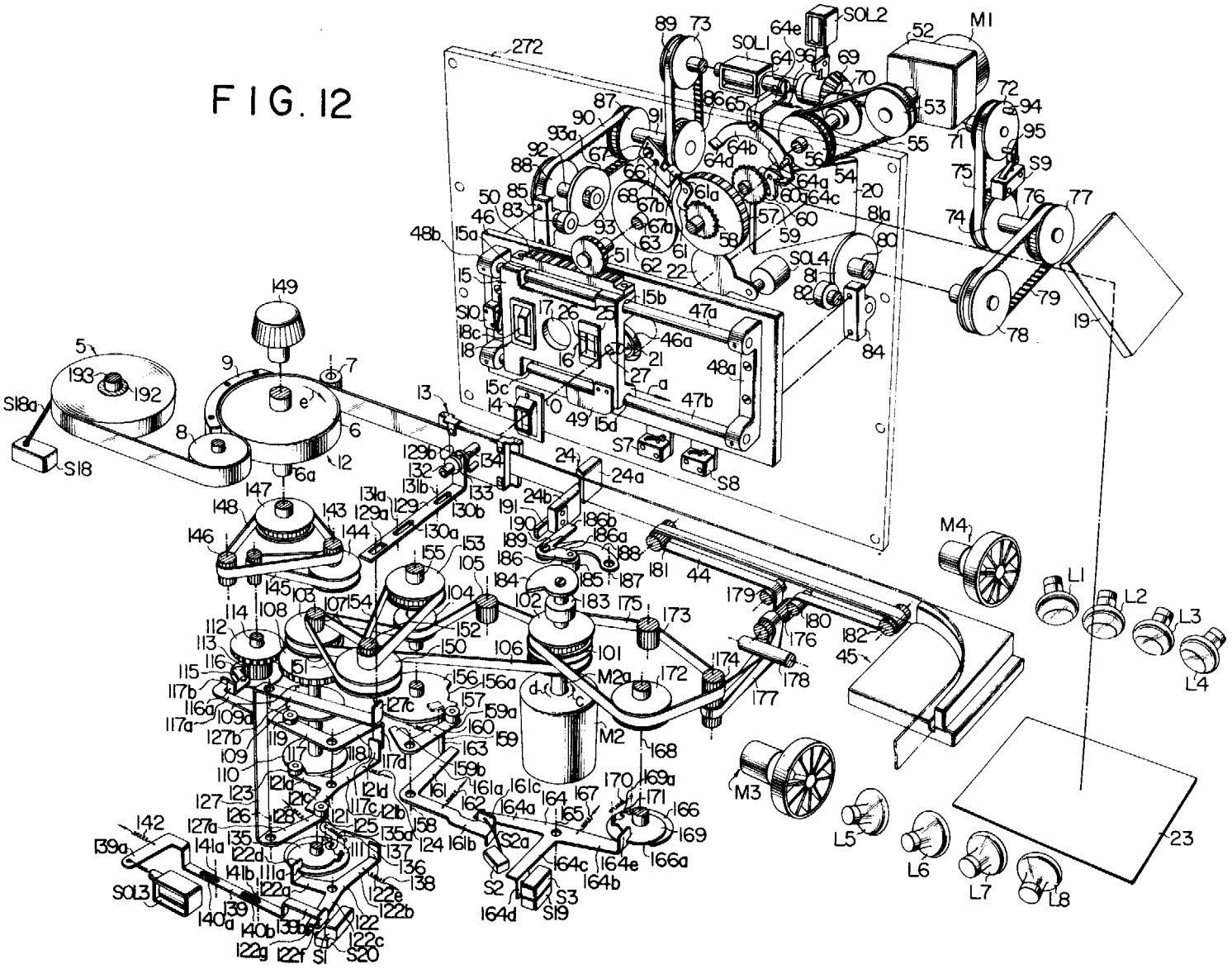
FIG. 12 is a perspective view showing various units and mechanisms within the system shown in FIG. 10.

The operation of the drive mechanisms discussed above is described below first in general terms and then in detail. Referring to FIG. 12, a portion of film unreeled from a film roll 5 in which the film is wound with its photosensitive surface facing radially inwardly extends counterclockwise around approximately half the periphery of the guide roller 8, and then extends clockwise around approximately half the periphery of the film transport drum 6, with the surface of the film which is opposite from the photosensitive surface bearing against the peripheral surface of the drum 6. Subsequently, the film is nipped between the guide roller 7 and the drum 6 to extend between the pressure plate 13 and the apertured frame 14. Because of the transport drum 6, the tendency of the film 5 to curl, which occurs as a result of its being in a roll, is corrected to maintain planarity. The pressure plate 13 and the apertured frame 14 are located on the optical axis O of the optical system, and the film passes therebetween, with the rear surface of the film (the surface opposite from the photosensitive surface) abutting against the presssure plate 13. Whenever the film 5 is about to move, the pressure plate 13 retracts rearwardly from the running path of the film 5 to assure a smooth transport of the film 5. After passing between the pressure plate 13 and the apertured frame 14, the film passes through the cutter assembly 24, which comprises a stationary blade **24*a* and a movable blade 24*b*. When the film is extended to pass this assembly, the film loading operation is completed. Subsequently, as images are successively formed on the film, it passes through the blades 24*a* and 24*b*, and is conveyed along a conveying path comprising a timing belt 44 toward the film outlet. The timing belt 44 feeds the film by the abutment of the lower edge of the film against the timing belt 44 while preventing an upward movement of the film. When a length of film corresponding to 16 pitches has been transported toward the outlet, the cutter assembly 24 severs the film, and the severed portion of the film 5 is deflected by an outlet forming member 45 to follow a path which is curved to a direction substantially perpendicular to the original path to be discharged out of the outlet which is normally closed by the lid 39b (see FIGS. 10 and 11), to the exterior of the system 31**.

The film roll loaded into the casing 39 is positioned so that the film portion in the span extending between the transport drum 6 and the cutter assembly 24 is upright, in a vertical plane, with a portion of the film held stationary between the pressure plate 13 and the apertured frame 14. As mentioned previously, the apertured frame 14 is located on the optical axis O of the optical system and is resiliently mounted on a stationary side wall described later. On the inner side of this stationary side wall, on the side in which the second reflecting mirror 20 is diposed, there is provided a mounting plate 46 for the movable unit 15, which plate is located parallel to the tensioned film. A stationary plate 272 is located rearwardly of the mounting plate 46 (as viewed in FIG. 12) and has the focusing lens 21 of the taking optical system mounted in its central region. An opening 46a is formed in the mounting plate 46 at a position opposite the lens 21. The apertured frame 14 is positioned opposite the opening **46*a*, with the movable unit 15 interposed therebetween. The mounting plate 46 is adapted to move over a small distance in the direction of the optical axis of the lens 21 by the actuation of a cam described later. The purpose of such movement is to bring the vessel 18 of developing solution mounted on the movable unit 15 into close contact with the apertured frame 14**.

The movable unit 15 is slidably mounted on the mounting plate 46. Specifically, on the side of the mounting plate 46 which faces the apertured frame 14, a pair of guide rods **47*a* and 47*b* are mounted on the upper and lower portion of the mounting plate 46 by means of mounting members 48*a* and 48*b*, respectively, and extend in a direction parallel to the direction of travel of the film 5, and the movable unit 15 is slidably mounted on these guide rods 47*a* and 47*b*. The movable unit 15 is in the form of a block having a pair of upper tabs in which holes 15*a* and 15*b* fitting the upper guide rod 47*a* are formed, and also having a pair of forks 15*c* and 15*d* at the opposite ends of its lower part which straddle the lower guide rod 47*b*, thereby allowing sliding movement along the guide rods 47*a* and 47*b*. In the central region, the movable unit 15 is formed with the exposure window 17, and carries the charger 16 to the right thereof. To the right of the charger 16, the movable unit 15 is formed with the ventilation hole 27, and carries the vessel 18 of developing solution to the left of the exposure window 17. As mentioned previously, the vessel 18, charger 16 and ventilation hole 27 all have their operative surface directed toward the apertured frame 14. On the lower, right-hand portion of the movable unit 15, on its front side, is fixed a microswitch operating member 49, in the path of travel of which are arranged a microswitch S7 and another microswitch S8 spaced apart from each other in the direction of travel of the movable unit 15. The microswitch S7 is operated by the member 49 as the movable unit 15 moves to bring the exposure window 17 into alignment with the optical axis O, while the microswitch S8 is depressed by the member 49 as the movable unit 15 moves to bring the vessel 18 of developing solution into a position on the optical axis O and opposite to the apertured frame 14. As mentioned previously, in its starting position the movable unit 15 is normally positioned such that the ventilation hole 27 is located opposite the apertured frame 14. Thus, at this time the movable unit 15 has completed its movement to the left relative to the mounting plate 46, and abuts against a change-over switch S10 which is located on the guide rod mounting member 48*b*. The change-over switch S10, when urged in this manner, connects a capacitor C7 (see FIG. 88A) with a power source, and is automatically switched to its other position, as the movable unit 15 moves to discharge the capacitor C7 to relay coil RA9 (see FIG. 88A). Normally the microswitch S7 has its contact connected with a capacitor C3 (see FIG. 88B) and is operative, when its contact position is changed by the member 49, to discharge the capacitor C3 to a relay coil RA2 (see FIG. 88B). The switch S8 is normally closed, and is opened when the member 49** depresses it.

The movable unit 15 thus constructed is adapted to be moved by an arrangement comprising a rack 50 and a pinion 51. The rack 50 is fixed on the top surface of the movable unit 15 and meshes with the pinion 51 which is operated by a movable unit drive mechanism. This drive mechanism comprises a motor M1 (see FIG. 12) which is a reversible D.C. motor, and a clutch mechanism. Specifically, the drive output from the motor M1 is transmitted through a reduction gear 52 to an output pulley 53 which is connected with a drive pulley 54 by a timing belt 55. The drive pulley 54 is fixedly mounted on a drive shaft 56, so that as the pulley 54 rotates, the drive shaft 56 is driven for rotation in the same direction. The drive shaft 56 extends toward the movable unit 15, and has a gear 57 loosely fitted thereon. Also fixedly mounted on the drive shaft 56 and on the opposite sides of the gear 57 are ratchet wheels 58 and 59 having serrated pawls extending opposite each other. The ratchet wheel 58 is located forwardly of the gear 57 and serves to return the movable unit 15 through its reverse stroke, while the ratchet wheel 59 is located rearwardly of the gear 57 and serves to advance the movable unit 15 through its forward stroke. During an advancing movement of the movable unit 15, a pawl member 60 which is pivotally mounted on the gear 57 engages the ratchet wheel 59 to transmit the rotative force from the drive shaft 56 to the gear 57, and during a returning motion of the movable unit 15, another pawl member 61 which is pivotally mounted on the gear 57 engages the ratchet wheel 58 to transmit the rotative force from the drive shaft 56 to the gear 57. The gear 57 to which the rotative force is transmitted in this manner meshes with a linking gear 62 on an axle 63 on which the pinion 51 is also fixedly mounted. The position of the pawl member 60 relative to the ratchet wheel 59 is controlled by an operating link 64 which is rocked by a solenoid SOLI described later. Specifically, the operating link 64 is rockably mounted at a pivot 65 located above the ratchet wheel 59, and has curved arms **64*a* and 64*b* which extend therefrom and straddle the ratchet wheel 59. The extremities 64c and 64*d* of the curved arms 64*a* and 64*b* are folded toward the gear 57, with one of the extremities, 64*c*, normally engaging a projection 60*a* on the pawl member 60 to prevent the engagement of this pawl member with the ratchet wheel 59. The pawl member 60 is urged to engage the ratchet wheel 59 by the resilience of a spring described later. The operating link 64 has also a branch arm 64*e* which extends rearwardly from the central portion thereof, the branch arm 64*e* being adapted to be attracted by the solenoid SOL1 in a suitable manner. The other pawl member 61 is also urged to engage the ratchet wheel 58** by the resilience of a spring to be described later.

The drive shaft 56 also extends rearwardly of the pulley 54, and a bevel gear 69 is mounted on this portion of the drive shaft through a one-way clutch. This clutch may comprise a spring clutch (see FIG. 54), and is adapted to transmit to the bevel gear 69 only the rotation of the drive shaft 56 in one direction. The bevel gear 69 meshes with another bevel gear 70 which is mounted on a rotary shaft 71 that extends in a direction at right angles to the axis of the drive shaft 56. Rotative force from the bevel gear 70 may be transmitted to the rotary shaft 71 through a spring clutch described later, the connection and disconnection of this spring clutch being controlled by a solenoid SOL2. Fixedly mounted on the opposite ends of the rotary shaft 71 are a pair of pulleys 72 and 73, from which a drive is obtained for moving the movable unit 15 and the mounting plate 56 is a forward and rearward direction with respect to the apertured frame 14 when the movable unit 15 has moved to a developing position. Specifically, one of such drive mechanisms may comprise a timing belt 75 extending around the pulley 72 and another pulley 74 located below it. The axle 76 on which the pulley 74 is mounted has another pulley 77 fixedly mounted thereon. A timing belt 79 extends around the pulley 77 and a further pulley 78 located adjacent mounting plate 46, the pulley 78 being mounted on an axle 80 which fixedly carries a cam disc 81. The periphery of the cam disc 81 is formed with a bulging portion 81a. On its rear surface, the mounting plate 46 has secured thereto a pair of fixtures 84 and 85 for a pair of rollers 82 and 83, respectively, and the cam disc 81 is adapted to have its periphery in abutment against one of the rollers (82). The other roller (83) is in abutment with a cam disc 93 of a similar transmission mechanism which includes the pulley 73, further pulleys 86, 87, 88, timing belts 89, 90, pulley axles 91, 92 and cam disc 93.

By a separate mechanism described later, the movable unit 15 normally assumes a home position in which it is away from the plane of the opening in the apertured frame 14. On one end face of the pulley 72 and adjacent its periphery, a pair of pins 94 and 95 are fixedly mounted thereon at symmetrical positions, and a microswitch S9 is located in the path of rotation of these pins. When the pulley 72 undergoes half its revolution, the pin 94 depresses the microswitch S9 to switch it in order to supply an operating signal to the developing timer T2 (see FIG. 88A). The mechanism for driving the mounting plate 46 in a forward and rearward direction is constructed in this manner.

Now the operation of the drive mechanism for the movable unit will be considered in more detail. Assume that the main switch SM (see FIG. 10) is depressed and the motor M1 is connected with the power source. At the same time, the illumination lamps L1 to L8 are connected to the low voltage output of the power source, preheating their heaters. The output pulley 53 of the motor M1 rotates clockwise, and the drive pulley 54 is also rotated clockwise through the belt 55, whereby the ratchet wheels 58 and 59 that are fixedly mounted on the drive shaft 56 also rotate clockwise with the drive shaft 56. However, because the clutch mechanism comprising the ratchet wheels 58, 59 and the pawl members 60, 61 is in its inoperative position, the rotative force from the motor M1 is not at this time transmitted to the movable unit 15.

When the photographing switch SP (see FIG. 10) is depressed, an electrical circuit described later is activated to operate the solenoid SOLI, whereby the operating link 64 is rocked counterclockwise about the axle 64. Thereupon, the extremity **64*c* of the curved arm 64*a* is disengaged from the projection 60*a* on the pawl member 60, so that the latter is resiliently moved to engage the ratchet wheel 59. Upon occurrence of such engagement, since the pawl member 60 is pivotally mounted on the gear 57, the rotation of the ratchet wheel 59 is transmitted to the gear 57 through the pawl member 60, whereby the gear 57 rotates clockwise. When the gear 57 rotates, the linking gear 62 meshing therewith rotates counterclockwise to cause a counterclockwise rotation of the pinion 51. As the pinion 51 rotates, the rack 50 is translated, whereby the movable unit 15** begins running in the direction of the arrow *a* along the guide rods **47*a* and 47*b*. The speed with which the movable unit 15 moves can be controlled by selecting the speed of the motor M1 by an electrical circuit described later. Once started by the counterclockwise rotation of the pinion 51, the movable unit 15 moves across the apertured frame 14, with its charger 16 facing this frame 14. In this motion, discharge occurs from the corona discharge electrodes 26 to the portion of the microfilm which is located within the apertured frame 14 and which is held stationary against the pressure plate 13, thereby charging that portion of film. By the time the charger 16 has moved past the apertured frame 14 and the exposure window 17 in the movable unit 15 comes opposite this frame, the gear 57 and the ratchet wheel 59 have rotated slightly in excess of half their revolution, whereby the projection 60*a* of the pawl member 60 abuts against the extremity 64*d* of the curved arm 64*b* of the now oscillating operating link 64 to release the engagement between the pawl member 60 and the ratchet wheel 59. Thereupon, the transmission of the force from the drive shaft 56 to the gear 57 is interrupted, so that the pinion 51 ceases to rotate, thereby preventing the movable unit 15 from further movement. The unit 15 stops at a position in which the exposure window 17 is interposed between the apertured frame 14 and the focusing lens 21**.

When the movable unit 15 has reached this stop position, the operating member 49 switches the microswitch S7 to activate an electrical circuit to be described later, whereby the exposure timer T1 is operated, and simultaneously the illumination lamps L1 to L8 are connected with a high voltage output to illuminate an original on the receptacle 23. At the same time, a solenoid SOL4 is operated to move the shutter blade 22 out of the path of photographing light. Thereupon, the photographing light which illuminates the original is projected through the first reflecting mirror 19 located directly above the original, thence to the second reflecting mirror 20, and is focused by the focusing lens 21 onto the charged microfilm portion held stationary on the pressure plate 13 through the exposure window 17 and the apertured frame 14, thus taking a picture of the original on the microfilm. The exposure time involved is established by the exposure timer T1, as mentioned previously.

At the end of the exposure time interval, T1 times out to change its electrical contact, thereby terminating the exposure. This terminates the energization of the solenoid SOL1. At the same time, the solenoid SOL4 is also deenergized, whereby the energization of the lamps takes place at a lower voltage. When the solenoid SOL1 becomes deenergized, the operating link 64 is restored to its initial position under the resilience of a spring 96, whereupon the projection 60*a* of the pawl member 60 which engaged the extremity 64*d* of the curved arm 64*b* becomes disengaged from the extremity 64*d* and reengages the ratchet wheel 59 under the resilience applied thereto to transmit the rotating force from the drive shaft 56 to the gear 57, thereby causing a counterclockwise rotation of the pinion 51. When the solenoid SOL4 is deenergized, the shutter blade 22 again closes the path of photographing light.

Thus, subsequent to exposure, the rotation of the pinion 51 translates the rack 50 to cause the movable unit 15 to move further in the direction of the arrow *a*. At this time, the movable unit 15 moves at a speed which is different from its previous speed and which is determined by automatically switching the speed of the motor M1 to a predetermined new speed.

By the time the movable unit 15 has moved to bring the vessel 18 of developing solution to a position opposite the apertured frame 14, the gear 57 and the ratchet wheel 59 have rotated through slightly less than a half revolution. When the ratchet wheel 59 has turned through approximating such remaining half revolution, the projection 60*a* of the pawl member 60 abuts against the extremity 64*c* of the restored operating link 64 to release the engagement of the pawl member 60 with the ratchet wheel 59, whereby the transmission of the force from the drive shaft 56 to the pinion 51 is interruted and the movable unit 15 comes to a stop. At this time, the gear 57 and the pawl member 60 have just completed their one revolution to return to their initial position, and the movable unit 15 has also completed its advancing or forward stroke. During the advancing or forward stroke, the ratchet wheel 59 operates to rotate the gear 57 through one revolution, and it will be noted that the other ratchet wheel 58 also rotates in the same direction during such period. When the gear 57 rotates, the pawl member 61 also rotates therewith, so that during its rotation, the ratchet wheel 58 rotates integrally with the pawl member 61 while maintaining a position in which it is engageable with the pawl member 61. When the movable unit 15 stops or the gear 57 and the pawl member 61 stop, the ratchet wheel 58 is free to slide under the pawl member 61, so that the ratchet wheel 58 has no effect upon the pawl member 61. When the gear 57 has completed its 1 revolution, the pawl member 61 assumes a position in which a projection 61*a* thereon is close to the inside of a folded piece 67*a* of a blocking member 67.

When the movable unit 15 comes to a stop at such position, the member 49 depresses the microswitch S8 to open it, whereby an electrical circuit described later becomes activated to energize the solenoid SOL2, thereby operating the spring clutch,, and allowing the rotation of the bevel gear 70 to be transmitted to the rotary shaft 71. Thereupon, the pulleys 72 and 73 are set in motion, and the belts 75 and 89 drive the pulleys 74 and 86 for rotation. The rotation of the pulleys 74 and 86 is transmitted to the pulleys 77 and 87, which in turn transmit their rotation to the axles 80 and 92 for the cam discs 81 and 93 through the belts 79 and 90, respectively. Thus, the cam discs 81 and 93 rotate and when they have rotated through approximately their one-half revolution, the bulging portions 81*a* and 93*a* formed along their periphery press against the rollers 82 and 83 to cause the mounting plate 46 to move toward the apertured frame 14 along the optical axis 0, against a resilient force applied thereto, such resilience being described later. When the mounting plate 46 moves toward the apertured frame 14, the vessel 18 of developing solution is initially aligned with the apertured frame 14, and then presses the apertured frame 14 against the exposed film portion on the pressure plate 13 against the resilience applied to the apertured frame 14. At this time, the pressure plate 13 is slightly retracted under the pressure applied by the apertured frame 14, thereby closing the opening of the vessel 18 by the exposed film portion on the pressure plate 13 with the apertured frame 14 interposed therebetween and thus forming a liquid-tight chamber therein. The liquid-tight chamber is formed in the vessel 18 at the time the pulleys 72 and 73 have just undergone half their revolution to have the bulging portions 81*a* and 93*a* of the cam discs 81 and 93 pressed against the rollers 82 and 83, respectively, to the maximum extent.

At this position, the pin 94 on the pulley 72 depresses the microswitch S9 to change it, thereby initiating the operation of the developing timer T2. A developing solution is supplied into the vessel 18 through the inlet 18*a* (see FIG. 43). The amount of developing solution supplied is previously determined by the developing solution metering tank described more fully later so as to just fill the vessel 18. After the developing solution is supplied in this manner, it is brought into contact with the exposed film, which is thereby developed.

When the mounting plate 46 has moved toward the apertured frame 14, and the vessel 18 has formed the liquid-tight chamber, the energization of the solenoid SOL2 is interruted by the operation of an electrical circuit described later, whereby the mounting plate 46 is maintained in its advanced position. The developing period is established by the timer T2. Upon completion of the developing step, the developing solution is drained through the drainage port 18b (see FIG. 43) formed in the vessel 18, and after the lapse of a given period of time, the solenoid SOL2 is energized again by the operation of an electrical circuit described later to rotate the cam discs 81 and 93 to another half revolution. Thereupon, the mounting plate 46 retracts along the optical axis 0 under the action of its own resilience, initially allowing the apertured frame 14 to move away from the pressure plate 13 and subsequently moving the vessel 18 away from the apertured frame 14 to its retracted position. When the vessel is returned, the energization of the solenoid SOL2 is interrupted. However, immediately before this occurs, the microswitch S9 is depressed by the pin 95, and a signal from the switch S9 changes the direction of rotation of the motor M1. Thus, the output pulley 53 of the motor M1 begins to rotate counterclockwise, and the drive shaft 56 also rotates counterclockwise by the drive imparted thereto through the belt 55 and the pulley 54. Simultaneously, the ratchet wheel 58 is also rotated counterclockwise to cause a counterclockwise rotation of the gear 57 through the pawl member 61 which engages with this wheel 58, thereby causing the gear 62 to rotate clockwise. As a result, the pinion 51 rotates clockwise, so that the rack 50 returns the movable unit 15 to its initial position. This return movement takes place for one revolution of the gear 57 in the counterclockwise direction, and during such time, the movable unit 15 moves in a direction opposite that indicated by the arrow *a* back to its initial position. The ventilation hole 27 is then located opposite the completely developed surface of the microfilm within the apertured frame 14, and a microswitch S10 is depressed by the movable unit 15 to change its position, whereby a drying timer T3

(see FIG. 88A) is operated and a supply of drying air is fed through the ventilation hole 27 onto the developed film surface for the purpose of fixing. When the timer T3 times out after a given period of time, the supply of drying air is interrupted and an electrical circuit described later operates to provide a film transport signal to the film feed mechanism to operate it, thereby feeding the film by a distance corresponding to one frame along the arrow *a*. This covers the operation of the drive mechanism for the movable unit 15.

Now the film feed mechanism housed within the casing 39 and a drive mechanism therefor will be generally described. The film feed mechanism comprises the three film feeding mechanisms described below, as well as a drive mechanism for the cutter assembly 24 and a mechanism for moving the pressure plate 13 away from the apertured frame 14. All of these mechanisms are operated by a single reversible motor M2. The three film feeding mechanisms referred to above are described immediately below:

1. An automatic film loading mechanism

This mechanism is operative, when a roll of microfilm is initially loaded into the system, to guide the leading end of the film around the transport drum 6 and to subsequently thread it through the space between the apertured frame 14 and the pressure plate 13 and also between the blades 24*a* and 24*b* of the cutter assembly 24 onto the timing belt 44 which forms the conveying path. In the course of such loading, approximately 27 frames are fed automatically. 2. A proper film feed mechanism This mechanism operates intermittently to feed the film by a distance corresponding to one frame after each electrophotographing processing cycle during which the film is held stationary on the pressure plate and the movable unit 15 reciprocates once, so as to feed the processed film forwardly along the conveying path and to feed a new frame of the film onto the pressure plate 13 to be held in place. The feeding operation by this mechanism comprises feeding 12 frames in succession, for the purpose of the electrophotographic processings, followed by an idle feeding of four frames in succession (during the latter, only the film feeding operation is involved without any electrophotographic processing), and when the film has been transported by a distance corresponding to a total of 16 frames, the fed film is severed by the cutter assembly 24 to provide a film sheet 5A as mentioned previously (see FIGS. 6, 7 and 8). The severed film sheet 5A is carried by the timing belt 44 toward the film outlet. The idle feeding of 4 frames in succession is necessary because in the present system, the cutter assembly 24 is located nearer the film outlet than the location of the pressure plate 13; as a result, when the 12th frame has been processed, further feeding is necessary to convey it to the position of the cutter assembly 24. The distance between the pressure plate 13 and the cutter assembly 24 corresponds to 4 frames.

3. A film idle feeding mechanism

This mechanism is provided for assuring a proper feeding operation of the film to provide a film sheet 5A of a normal length when the number of frames in which pictures are to be taken is less than 12. For example, it may be necessary that three originals are to be photographed on the film. Because this represents an insufficient number of frames to form a single film sheet 5A, it is necessary to provide an idle feeding of the remaining nine frames when the photographing and processing of three frames have been completed. Specifically, when the spacing switch SC (see FIG. 10) is closed, the proper film feed mechanism is disabled and an idle feeding of successive frames takes place. When the film has been transported by a distance corresponding to 12 frames, the operation is automatically switched to the normal idle feeding of four frames described above. When the film has been fed by a distance corresponding to a total of 16 frames, the cutter assembly 24 is operated to sever a film sheet 5A therefrom. However, it is to be noted that the film sheet 5A obtained in this case contains pictures in only three of its frames.

The three film feeding mechanisms which constituted together the composite film feed mechanism will be described more fully below, but for convenience of description, only the proper film feed mechanism will be dealt with in detail now and the automatic loading mechanism as well as the film idle feeding mechanism will be taken up at a later portion of the description.

Referring to FIG. 12, a film transport motor M2 comprises a reversible motor. The motor M2 has its output shaft M2a coupled with a forward rotation pulley 101 and a reverse rotation pulley 102 through respective one-way clutches. When the motor M2 rotates in the forward direction (in the direction indicated by an arrow *c*), the pulley 101 also rotates in the same direction to activate a transport system which feeds the film from the roll 5 to the position between the pressure plate 13 and the apertured frame 14, and when the motor M2 rotates in the reverse direction (in the direction indicated by an arrow *d*), the pulley 102 also rotates in the same direction to activate another transport system which conveys a film sheet 5A containing 16 frames and severed from the remainder of the film by the cutter assembly 24 toward the film outlet.

A transmission pulley 103 is coupled with the forward rotation pulley 101 by means of a timing belt (drive belt 106) which also extends around a guide pulley 104 and guide roller 105. The transmission pulley 103 is fixedly mounted on a drive shaft 107 on which a large diameter gear 108, a cam disc 109 having a projection thereon, a notched cam disc 110 and a notched disc 111 are also fixedly mounted. The large diameter gear 108 meshes with a small diameter gear 112 which has a diameter equal to one-half the diameter of the gear 108, and thus when the gear 108 undergoes 1 revolution, the small diameter gear 112 undergoes 2 revolutions. A ratchet wheel 113 is integrally mounted on the lower surface of the gear 112 and both are loosely fitted on an axle 114. The ratchet wheel 113 rests on a disc 115 which is fixedly mounted on the axle 114 and on which is pivotally mounted a pawl member 116 which is adapted to engage the ratchet wheel 113 when desired. Thus, the ratchet wheel 113 and the pawl member 116 constitute together a clutch. The pawl member 116 is urged by a spring to engage the ratchet wheel 113, but such rotation toward the ratchet wheel is prevented by the engagement of an upright piece 116*a* folded from the pawl member 116 with an upright piece 117*b* formed on the end of one arm 117*a* of a control lever 117. The control lever 117 is pivotally mounted at a pivot 118, and carries a roller 119 on the arm 117*a* intermediate its length. Normally, the control lever 117 is urged to rotate clockwise about the pivot 118 under the resilience of a spring 120 (see FIG. 65), but such rotation is prevented by the abutment of the roller 119 against the peripheral surface of the cam disc 109. When the cam disc 109 rotates, a projection 109*a* thereon moves the arm 117*a* to cause it to rock counterclockwise about the pivot 118. The projection 109*a* is formed on the periphery of the cam disc 109 and its position is such that the projection 109*a* moves the roller 119 when the cam disc 109 has just rotated through one quarter of a revolution. The control lever 117 has another arm 117*c* which extends in a direction at right angles to the arm 117*a* and the extremity of which is formed with a folded depending piece 117*d*. A pair of three arm links 121 and 122 are also pivotally mounted on the pivot 118. The upper three arm link 121 is provided to move the pressure plate. The link 121 includes a first arm 121*a* which extends close to the notched cam disc 110 and carries at its extremity a roller 123 which is adapted to abut against the periphery of the notched cam disc 110. The link 121 also includes a second arm 121*b* which extends generally in the same direction as the arm 117*c* of the control lever 117 and which is formed with an upright folded piece 121*d* at its extremity. A spring 124 extends between the arm 121*b* and a stationary point and urges the three arm link 121 to rotate clockwise about the pivot 118, but such rotation is prevented by the abutment of the roller 123 against the periphery of the notched cam disc 110. The link 121 also includes a third arm 121*c* which extends generally in the opposite direction from the second arm 121*b* and abuts against a roller 125 which is mounted on an arm 127*a* extending from the lower end of a rocking member 127 which is in turn pivotally mounted at 126. A spring 128 extends between the arm 127*a* and a stationary point to urge the rocking member 127 to rotate counterclockwise about the pivot 126, but such rotation is prevented by the abutment of the roller 125 against the third arm 121*c*. The rocking member 127 has another arm 127*b* which extends horizontally from the top end thereof, the extremity of the arm 127*b* being bent upwardly to form an upright piece 127*c* which engages with a slot 128*a* formed in a sliding bar provided for the purpose of moving the pressure plate. The sliding bar 129 is also formed with a pair of elongate guide slots 130*a* and 130*b* into which are fitted a pair of pins 131*a* and 131*b*, respectively, mounted on a stationary part so as to render the bar slidable in a direction perpendicular to the direction in which the film extends. At its end toward the film, the sliding bar 129 is bent upwardly with a fork 129*b* formed at its extremity. The fork 129*b* receives a hollow shaft 132 fixedly mounted on the rear surface of the pressure plate 13, and the hollow shaft 132 has secured thereon a pair of flanges 133, 134 which are located on the opposite sides of the fork 129*b*, so that when the sliding bar 129 moves rearwardly, the pressure plate 13 is moved in the direction of the optical axis 0 to be removed from the apertured frame 14.

The lower three arm link 122 controls the rotation of the drive shaft 107, and operates to change the position of a forward and reverse rotation changeover switch S1 (see FIG. 87) so as to control the direction of rotation of the motor M2. The link 122 includes a first arm 122*a* which extends generally in the same direction as the first arm 121*a* of the link 121 and which has at its extremity an upright folded piece 122d normally engaging a notch 111a in the disc 111. Above the notched disc 111, a cam 135 for closing the plane of the notch 111a is rotatably mounted on the shaft 107. The cam disc 135 is formed with a peripheral cam surface having a gradually increasing diameter, with the maximum diameter of the cam surface extending slightly beyond the disc 111. The cam disc 135 and the disc 111 are interconnected by a spring 136 (see FIG. 65) which extends between the cam disc 135 and a pin 137 upstanding from the disc 111. When the folded piece 122d is not engaged with the notch 111a in the disc 111, the resilience of the spring 136 causes the cam disc 135 to rotate counterclockwise until a stop 135*a* mounted on the cam disc 135 abuts against the pin 137, thereby placing the peripheral cam surface in overlapping relationship with the notch 111*a* to close the plane thereof. When the cam disc 135 is operated to assume such position, the switch S1 is operated by the third arm 122*c* to cause the motor M2 to rotate in the forward direction. The link 122 also includes a second arm 122*b* which extends generally in the same direction as the second arm 121*b* of the link 121 and which is formed with an upright folded piece 122 *e* at its extremity. By locking the folded piece 122e in a suitable manner, the three arm link 122 is maintained in its operative position. A spring 138 extends between the second arm 122*b* and a stationary point to urge the link 122 to rotate clockwise about the shaft 107. As a result, the folded piece 122*d* on the first arm 122*a* is maintained in abutment against the periphery of the disc 111. The link 122 also includes a third arm 122*c* which extends generally in the same direction as the third arm 121*c* of the link 121 and the extremity of which is formed with an upright folded piece 122*f* at its one lateral edge. The microswitch S1 for changing the direction of rotation of the reversible motor M2 is disposed adjacent the folded piece 122*f*. The switch S1 normally assumes a position in which the motor M2 rotates in the reverse direction, but is switched to another position by the folded piece 122*f* in which the motor M2 rotates in the forward direction when the three arm link 122 is rotated counterclockwise about the axle 118 against the resilience of the spring 138.

Pivoting of the three arm link 122 in the counterclockwise direction is effected by means of a slide bar 139 which presses against the folded piece 122*f*. The slide bar 139 is formed with a pair of spaced apart elongated guide slots 140*a* and 140*b* which are engaged by stationary pins 141*a* and 141*b*, respectively. At one end, the slide bar is bent to form an L-shaped portion 139*a* which is adapted to be pulled by a solenoid SOL3 to be described later. The other end 139*b* of the slide bar 139 extends toward the folded piece 122*f*, and its extremity abuts against the folded piece 122*f*. Normally, the slide bar 139 is urged to the left, as viewed in FIG. 12, by the resilience of a spring 142, thus freeing the three arm link 122 for rotation.

Extending around the top of the axle 114 on which the small diameter gear 112 and the ratchet wheel 113 are fitted and around a pulley 144 fixedly mounted on an axle 143 is a timing belt 145; another timing belt 148 extends around the axle 143, a guide shaft 146 and a pulley 147 which is fixedly mounted on the axle 6*a* of the transport drum 6 around which the microfilm 5 extends for one-half its peripheral length. A speed reduction drive system is formed by the belts 145 and 148 and transmits the rotative force from the axle 114 to the axle 6*a*. When the small diameter gear 112 fitted on the axle 114 has completed one revolution, both the pivot 6*a* and the transport drum 6 undergo 1/16 of a revolution. This rotation of the transport drum 6 corresponds to feeding one frame of the microfilm 5.

The axle 6a for the transport drum extends further upwardly and a manual knob 149 is fixed to the end thereof. By rotating the knob 149 clockwise, the transport drum 6 can be rotated in the direction of the arrow *e*, thereby feeding the film to the aperture position.

A timing belt 151 extends around the drive shaft 107 and a pulley 150 which is fixedly mounted on a rotary shaft 152, and a timing belt 154 extends around the rotary shaft 152 and a pulley 153 which is in turn fixedly mounted on another rotary shaft 155. In this manner, a speed reduction drive system is formed by the belts 151 and 154 for transmitting the rotative force from the drive shaft 107 to the rotary shaft 155. The arrangement is such that when the large diameter gear 108 has completed one revolution, the pulley 153 undergoes one-fourteenth of a revolution. The drive control is the one providing the idle feeding of four frames in succession subsequent to an intermittent feed of 12 frames. Fixedly mounted on the rotary shaft 155 is a notched disc 156, the outer periphery of which is formed with a notch 156a continuing through an angle which corresponds to 2/14 the length along the circumference thereof. A roller 157 is disposed to abut against the outer periphery of the notched disc 156. Specifically, the roller 157 is mounted on the end of an arm 159a of a bell crank-shaped, rockable link 159 which is pivotally mounted on an axle 158. A spring 160 extends between the arm 159a and a stationary point to urge the rockable link 159 to rotate counterclockwise about the axle 158. As a result, the roller 157 is held abutting against the outer periphery of the notched disc 156. The rockable link 159 has another arm 159b which extends toward the folded depending piece 117d and the upright folded piece 121d, and which is adapted, when the roller 157 has dropped into the notch 156a, to cause the rockable link 159 to rock counterclockwise about the axle 158 under the resilience of the spring 160, to be thereby moved into the path of rocking motion of the depending piece 117d and the folded piece 121d and to thereby engage with these pieces to constrain the operation of the control lever 117 and the upper arm link 121.

A bell crank-shaped rockable link 161 is also pivotally mounted on the axle 158, and serves to open and to close a microswitch S2 connected in series between the reverse rotation contact of the change-over switch S1 and the motor M2. The link 161 has an arm 161a which extends generally in the same direction as the arm 159a, and the link 161 is urged by a spring 162 to rotate counterclockwise about the axle 158. However, such rotation is prevented by the abutment of the arm 161a against a depending piece 163 which extends radially outwardly from the notched disc 156. The rockable link 161 has another arm 161b which extends in the opposite direction from the arm 159b of the rockable link 159, and which is formed with an upright folded piece 161c at its extremity along one lateral side thereof. The folded piece 161c is adapted to operate the microswitch S2. Specifically, the upright piece 161c abuts against an actuator S2a of the switch S2. When the actuator S2a is in abutment with the upright piece 161c, the switch S2 is closed, and when rockable link 161 rotates counterclockwise about the axle 158, the upright piece 161c moves away from the actuator S2a to open the switch S2.

The movement of the upright piece 161c is also transmitted to a three arm link 164 which operates to open or close a normally closed microswitch S3. The link 164 is pivotally mounted on an axle 165, and has a first arm 164a which extends close to the upright piece 161c. The link 164 has a second arm 164b which extends in the opposite direction from the first arm 164a and which is formed at its extremity with an upright piece 164e that is adapted to engage a notched disc 166 controlling the reverse drive of the motor M2. The link 164 also has a third arm 164c which extends in a direction perpendicular to the other two arms, and an upright piece 164d formed at the extremity of this arm is adapted to open or close the microswitch S3 located adjacent thereto. A spring 167 extends between the three arm link 164 and a stationary point to urge it to rotate counterclockwise about the axle 165, but such rotation is prevented by the abutment of the upright piece 164e against the periphery of the notched disc 166.

The microswitch S3 is connected between the switch S2 and the motor M2, and is open when the upright piece 164e has dropped into a recess 166a, but when the link 164 rocks clockwise about the axle 165, the upright piece 164d moves away from the switch S3 to close its contacts.

The notched disc 166 is fixedly mounted on a shaft 168 which forms part of the reverse rotation drive system comprising the motor M2, the latter operating on the conveying path formed by the timing belt 44. A cam disc 169 is rotatably mounted on the shaft 168 at a position above the disc 166 for closing the plane of the notch 166a. The cam disc 169 is formed with a cam surface having a gradually increasing diameter, with the maximum diameter portion extending slightly outwardly of the disc 166. The cam disc 169 and the disc 166 are interconnected by a spring 170. Thus, when the upright piece 164e is not engaged with the notch 166a, the tension spring 170 which extends between the cam disc 169 and a pin 171 on the disc 166 causes the cam disc 169 to rotate clockwise until a stop 169a provided thereon abuts against the pin 171, so that the cam disc 169 is positioned over the notch 166a to close it, as viewed from the top. When the cam disc 169 assumes this position, the upright piece 164e can not drop into the notch 166a, whereby the three arm link 164 is maintained in the position to which it has rocked clockwise about the axle 165 against the resilience of the spring 167, thereby holding the switch S3 closed.

A pulley 172 is fixedly mounted on the shaft 168, and a timing belt 175 extends around the pulley 172, a guide pulley 173, a transmission roller 174 and the reverse rotation pulley 102. A drive roller 176 is mounted horizontally, parallel to the optical axis and thus at right angles to the transmission roller 174, and a timing belt 177 extends around these rollers. A tension roller 178 is located below and adjacent the drive roller 176 in a direction to intersect with the latter, and the timing belt 177 has its surface bearing against the lower side of the roller 178 to be twisted thereby when passing between the rollers 174 and 176. In this manner, the rotative force from the transmission roller 174 is imparted through the belt 177 to the drive roller 176 to cause it to rotate clockwise about its axle. The timing belt 44 which serves to transport toward the film outlet a severed microfilm sheet 5A carrying 16 frames extends around the drive roller 176. Specifically, a pair of guide rollers 179 and 180 are located above and on the opposite sides (as viewed in FIG. 12) of the roller 176, and a pair of further guide rollers 181 and 132 are located on the opposite sides of these guide rollers at a level slightly thereabove. The timing belt 44 extends around these guide rollers 176 to 182, following a path which is T-shaped. The rollers 176, 181 and 132 are located inside the loop formed by the timing belt 44, while the rollers 179 and 180 are located outside the loop. The film which is delivered from the cutter assembly 24 has its lower edge abutting against the span of the belt 44 which extends between the rollers 181 and 182, and is conveyed toward the film outlet while maintaining an upright position when the belt is driven. For a normal film feeding operation, the drive of the belt 44 occurs during one revolution of the notched disc 166, and the film sheet is discharged through the film outlet externally of the system during such interval.

A hollow shaft 183 connects the reverse rotation pulley 102 mounted on the output shaft M2a of the motor M2 with a cam disc 184 which drives the cutter assembly 24. The cam disc 184 also has a cam surface of gradually increasing diameter, and is adapted to rotate clockwise when the reverse rotation pulley 102 is rotated clockwise. Abutting against the cam disc 184 is a roller 185 which is mounted on the end of one arm 186*a* of a bell crank-shaped rockable link 186. The rockable link 186 is pivotally mounted on a stud 189 carried by the extremity of a lever 188 which is pivotally mounted on an axle 187. The rockable link 186 has another arm 186*b* on which the movable blade 24*b* of the cutter assembly 24 is mounted. A torsion spring 190 extends between the rockable link 186 and the lever 188 to urge the members 186*b* and 188 to move away from each other. However, movement of the members 186 and 188 away from each other is prevented by the abutment of the movable blade 24*b* against a guide member 191 therefor which is fixed on a stationary part. The above description has dealt with the proper film feed mechanism including the mechanism for translating the pressure plate 13 and the drive mechanism for the cutter assembly 24.

In operation, assuming that the film has been unreeled from the roll 5 and loaded between the pressure plate 13 and the apertured frame 14, electrophotographic processing is applied to the film portion abutting against the pressure plate 13 through the movement of the movable unit 15, which thereater returns to its initial position to close the microswitch S10. When the drying or fixing step has been completed, the solenoid SOL3 is energized, whereby the slide bar 139 is moved against the resilience of the spring 142 to press against the folded piece 122*f*. As the folded piece 122*f* is moved, the three arm link 122 rotates counterclockwise about its axle 118 against the resilience of the spring 138, so that the cam disc 135 is freed for counterclockwise rotation under the resilience of the spring 136, closing the plane of the notch 111*a* and preventing the folded piece 122*d* from falling into it. When the folded piece 122*f* is pushed, the switch S1 is switched to a position in which the motor M2 is connected for rotation in the forward direction. The rotation of the motor M2 in the forward direction causes the forward rotation pulley 101 to rotate in the direction indicated by the arrow *c*. This causes the transmission pulley 103 to be rotated by means of the belt 106, so that the drive shaft 107 is driven in the counterclockwise direction, thus rotating counterclockwise the large diameter gear 108, the cam disc 109 with its projection, the notched cam disc 110 and the notched disc 111. The three arm link 122 is maintained in the position to which it has rocked counterclockwise, thereby operating the switch S1 to its forward position and maintaining the motor M2 energized for rotation in the forward direction. When the drive shaft 107 has rotated through ¼ revolution, the projection 109*a* presses against the roller 119 to rock the control lever 117 counterclockwise about its axle 118. Thereupon, the upright piece 117*b* is disengaged from the folded piece 116*a*, whereby the pawl member 116 is allowed to engage the ratchet wheel 113 to transmit the rotative force from the large diameter gear 108 to the shaft 114 through the small diameter gear 112.

As soon as the drive shaft 107 commences its rotation, a portion of the increased diameter circumference of the notched cam disc 110 moves the roller 123 out of the notch therein, so that the three arm link 121 is rotated counterclockwise about its axle 118 against the resilience of the spring 124 to move the roller 125 with its third arm 121*c*, whereby the rockable member 127 is rocked clockwise about its axle 126 against the resilience of the spring 128. This results in a clockwise rocking motion of the other arm 127*b*, whereby the engagement between the folded piece 127*c* and the slot 129*a* causes the slide bar 129 to move in the direction of the optical axis, and the engagement between the fork 129*b* and the flanges 133 causes the pressure plate 13 to move away from the apertured frame 14.

As the shaft 114 rotates clockwise, the pulley 144 is rotated through the belt 145, and the pulley 147 is rotated by the belt 148. Such rotation occurs for an intermediate ½ revolution during 1 revolution of the large diameter gear 108 and corresponds to one revolution of the small diameter gear 112, which in turn corresponds to one-sixteenth revolution of the pulley 147. When the pulley 147 rotates through 1/16 revolution, the transport drum 6 is also rotated through the shaft 6a through 1/16 revolution to provide a film feeding of one frame, supplying a fresh film portion onto the pressure plate 13 and conveying the processed film portion toward the film outlet.

When the cam disc 109 rotates and the projection 109a thereon moves the roller 119 to rock the control lever 117 to thereby engage the pawl member 116 with the ratchet wheel 113, the shaft 114 is rotated clockwise together with the disc 155, so that the transmission of the force from the drive shaft 107 to the shaft 114 is not interrupted with subsequently the roller 119 has moved past the projection 109*a* to fall onto the periphery of the cam disc 109 since the pawl member 116 is already disengaged from the upright piece 117*b*. However, when the film is transported by an amount corresponding to just one frame, the disc 115 also completes its 1 revolution, whereby the folded piece 116*a* of the pawl member 116 abuts against the upright piece 117*b* again, whereby the pawl member 116 becomes disengaged from the ratchet wheel 113, interrupting the transmission of the force from the drive shaft 107 to the shaft 114. Thus the shaft 114 comes to a standstill when the transport drum 6 has completed 1/16 revolution to feed the film by one frame.

As the notched cam disc 110 continues rotating, the roller 123 falls into the notch therein having a reduced diameter, whereby the three arm link 121 rocks clockwise about the axle 118 under the reslience of the spring 124 and resumes its initial position. Thereupon, the roller 125 follows this motion of the link 121 under the resilience of the spring 128 to cause a counterclockwise rocking motion of the rockable link 12 about its pivot 126. As a result, the engagement between the folded piece 127*c* and the slot 129*a* causes the slide bar 129 to move in the direction of the optical axis, and as the fork 129*b* advances, the pressure plate 13 is advanced toward the apertured frame 14, thus positioning the film in a normal electrophotographic processing position and holding it in place.

When the drive shaft 107 has undergone its one revolution, the notched disc 111 also has undergone 1 revolution, so that the cam disc 135 which is disposed in overlapping relationship with the disc 111 has its maximum diameter portion in engagement with the folded piece 122*d*, thereby being prevented from further rotation. As a result, only the disc 111 is allowed to rotate, clearing the notch 111*a* which has been covered or closed, whereby the folded piece 122*d* falls into the notch 111*a* under the resilience of the spring 138. Thereupon, the three arm link 122 rocks clockwise about its axle 118, moving the folded piece 122*f* away from the switch S1 which is therefore changed from the forward to reverse rotation position. For the reason described later, the motor M2 is stopped at this time. Since the solenoid SOL3 is already deenergized, the slide bar 139 is restored to its original position under the resilence of the spring 142.

When the drive shaft 107 completes its one revolution, the rotary shaft 155 has rotated through 1/14 revolution because of the speed reduction. At the same time, the notched disc 156 has rotated through one-fourteenth revolution, whereby the rockable link 161 is disengaged from the depending piece 163. Consequently, the link 161 rocks counterclockwise about the axle 158 under the resilience of the spring 162 to move the first arm 164*a* with its upright piece 161c, thus rocking the three arm link 164 clockwise about its axle 165 against the resilience of the spring 167. When the link 164 rocks in this manner, the upright piece 164*d* thereon moves away from the switch S3 to close it. As the upright piece 161*c* moves away from the actuator S2*a* of the switch S2, the later opens. As a consequence, when the change-over switch S1 is switched to its reverse rotation position, the energization of the motor M2 is interrupted by opening the switch S2 in the series circuit comprising the switches S2 and S3, thus stopping the motor M2. As the three arm link 164 rocks clockwise, the upright piece 164*e* moves out of the notch 166*a*, whereby the cam disc 169 rotates under the resilience of the spring 170 to close the notch 166*a*. Subsequently, the link 164 maintains the position to which it has rocked clockwise until the film is fed for the 16th time.

The above description has dealt with a film feed operation by one frame. Such one frame feeding operation takes place automatically by the operation of the solenoid SOL3 each time the movable unit 15 goes through one reciprocatory motion to provide electrophotographic processings to a fresh film portion which is held stationary within the apertured frame 14. After such operation is repeated 12 times, the film is fed by an amount corresponding to 12 frames, and film feeding of four blank frames in succession takes place. This takes place by a counterclockwise rocking motion of the rockable link 159 about its axle 158 under the resilience of the spring 160 when the drive shaft 107 rotates to feed the film for the twelfth time and the roller 157 falls into the notch 156*a*. Specifically, when the drive shaft 107 rotates, the control lever 117 is rocked counterclockwise about the axle 118 by means of the projection 109*a*, so that the notched cam 110 rocks the three arm link 121 counterclockwise about the axle 118 by means of its increased diameter portion. When the rockable link 159 rocks at the time the lever 117 is rocked, the arm 159*b* moves into the path of rocking motion of the depending folded piece 117*d* and the upright folded piece 121*d*, thereby preventing the returning motion thereof and holding the control lever 117 and the three arm link 121 in the respective positions to which they have rocked.

When the three arm link 121 is maintained in its rocked position, the pressure plate 13 is held in a position retracted from the apertured frame 14. Since the pawl member 116 does not then engage the upright piece 117*b* while the shaft 114 rotates through its 1 revolution, the driving force from the large diameter gear 108 is now transmitted to the small diameter gear 112 in its entirety. Under this condition, the large diameter gear 108 rotates through two revolutions, whereby the small diameter gear 112 rotates through 4 revolutions which correspond to 4/16 of a revolution of the transport drum 6, thereby feeding the film for a length corresponding to four frames in succession. When the film is fed by such length, the 12th frame of the film is displaced just to the outlet side of the movable blade 24*b* of the cutter assembly 24. In the meantime, the roller 157 has fallen into the notch 156a, and when the drive shaft 107 has rotated through 2 revolutions and the rotary shaft 155 has rotated through 2/14 of a revolution, the roller 157 is moved out of the notch 156*a*, whereby the rockable link 159 rocks clockwise about the axle 158 to its original position. Also during such time, the folded piece 122*e* of the three arm link 122 is locked by an arm (not shown) of the rockable link 159 when the link 122 is rocked counterclockwise about the axle 118, and is maintained in its rocked position while the drive shaft 107 rotates through two revolutions. Thus, the switch S1 remains in the forward rotation position to which it is switched.

When the rockable link 159 returns, the folded piece 122*e* is unlocked, and the folded piece 122*d* falls into the notch 111*a*. Thereupon the three arm link 122 rocks clockwise to its original position, whereby the switch S1 is changed to the reverse rotation position. Substantially at the same time, one arm 161*a* of the rockable link 161 is moved by the rotation of the depending piece 163 to cause a clockwise rocking motion of the link 161 about the axle 158, whereby the upright piece 161*c* closes the microswitch S2. When the microswitch S2 is closed, the circuit for the reverse rotation of the motor M2 is completed, whereby the motor M2 starts to rotate in the reverse direction, causing the reverse rotation pulley 102 to rotated clockwise. The rotation of the pulley 10 causes a clockwise rotation of the cam disc 184 having a gradually increasing diameter to move the roller 158 in a direction away therefrom, thus causing the lever 188 to rotate clockwise about its pivot 187 through the rockable link 186. As a result, the movable blade 24*b* of the cutter assembly 24 is advanced toward the film along the guide member 191 and cooperates with the stationary blade 24*a* to sever the film. In this manner, a film sheet containing 16 frames is severed from the remainder of the film and is placed on the belt 44 which is driven by the belts 175 and 177. Thus the severed film sheet is conveyed toward the film outlet and is discharged externally of the system.

The belt 44 is driven for a period which corresponds to one revolution of the notched disc 166. Specifically, when the motor M2 rotates in the reverse direction, the disc 166 is rotated clockwise through the pulley 172, and when it has rotated through one revolution, an increased diameter portion of the cam disc 169 located above the disc 166 abuts against the upright piece 164*e* to clear the notch 166*a*, whereby the upright piece 164*e* falls into the notch 166*a* to rock the three arm link 164 counterclockwise about the axle 165. The rocking motion of the link causes its upright piece 164*d* to press against the switch S3 and open it, thereby interrupting the circuit of the motor M2 to stop it. This completes one cycle of the operation of the proper film feed mechanism, including the mechanism for translating the pressure plate 13 and the drive mechanism for the cutter assembly 24. The automatic film loading mechanism and the film idle feeding mechanism are more fully described later. Having described the general operation of various drive mechanisms used in the system of the invention, various individual mechanisms are described below in more detail.

Film grounding means

Figure 13:
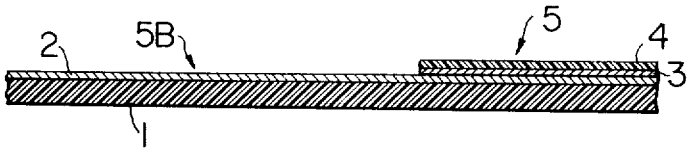
FIG. 13 is an enlarged section of a portion of the electrophotographic film wound on a supply reel.
Figure 14:
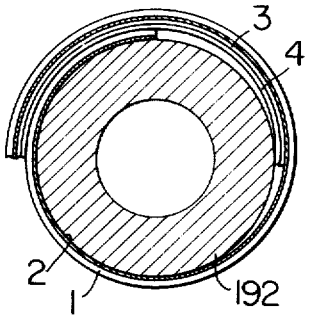
FIG. 14 is a cross section showing the manner of winding the elongate electrophotographic film on the supply reel.

As shown in section in FIG. 1, the electrophotographic film used in the system of the invention comprises the transparent film base 1 with the transparent conductive layer 2 evaporated thereon, and the adhesive layer 3 placed thereon and covered with the photosensitive layer 4. Thus, the conductive layer 2 is electrically floating, and electric charge can not be applied to the photosensitive layer 4 by corona discharge from the charger 16 unless the conductive layer 2 is electrically grounded. In the system of the invention, an arrangement is made to cause the conductive layer 2 of the film to contact with a conductive reel when the film is coiled in the form of a roll in order to provide a ground connection for the conductive layer. As indicated in FIG. 13, at one end 5B of the film 5, the adhesive layer 3 and the photosensitive layer 4 are removed on the side facing the reel to expose the conductive layer 2 which is thus brought into direct contact with a conductive reel 192 as shown in FIG. 14, and the film is subsequently coiled around the reel 192 to form a roll. When the roll of a microfilm 5 coiled around the conductive reel 192 is mounted on a conductive axle 193 (see FIG. 12), the conductive layer 2 of the microfilm is electrically connected to ground through the conductive reel 192 and the axle 193.

Figure 15:
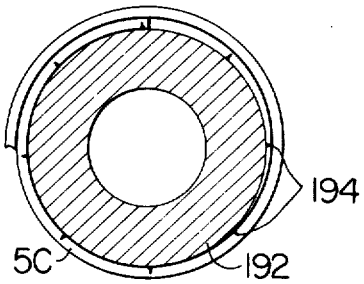
FIG. 15 is a cross section illustrating another example of winding the electrophotographic film on the supply reel.

FIG. 15 shows another example of electrically grounding the conductive layer. The conductive reel 192 has a plurality of conductive needles 194 fixedly mounted around its periphery, the conductive needles 194 being of a small length to pierce into only the first turn of the film coiled around the reel 192. When a film having no exposed conductive layer is coiled around the reel 192 thus constructed, the conductive needles 194 pierce into the film 5C of the first turn, thereby electrically connecting the conductive layer 2 of the film to ground through the needles 194 and the reel 192. An additional advantage is that the roll of film is securely coiled around the reel 192.

When the roll of microfilm coiled around the reel 192 is mounted on the axle 193 of the system, a microswitch S18 has its actuator S18*a* adapted to abut against part of the outer periphery of the mounted roll film 5 as shown in FIG. 12. The switch S18 detects the amount of film remaining on the roll as the film continues to be delivered. The purpose of the microswitch S18 is to detect that the supply of film has been exhausted by the movement of the actuator S18*a* closing the switch S18, to provide an indication to this by an indicator lamp L9, and to render the electrical circuit of the photographing switch SP nonconductive.

Microfilm delivery apparatus

Figure 16:
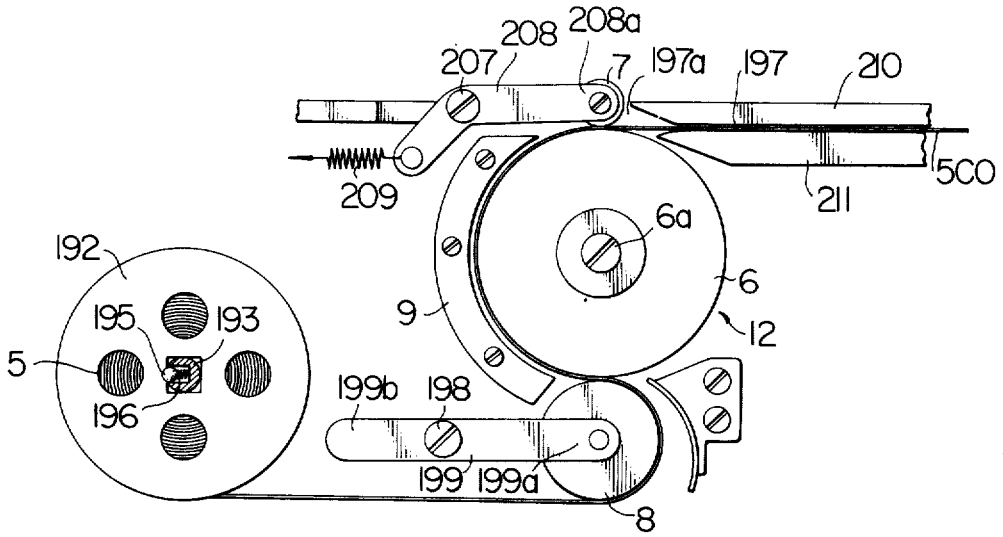
FIG. 16 is a plan view of the microfilm delivery apparatus.

The microfilm delivery apparatus 12 operates to unreel a microfilm from the roll mounted on the axle 193 and to pull its leading edge into the space between the pressure plate 13 and the apertured frame 14. Referring to FIG. 16, the reel 192 having a roll of microfilm 5 coiled thereon is shown mounted on the axle 193. A click stop assembly comprising a ball 195 and a coiled spring 196 is mounted on the axle 193 to prevent an axial withdrawal of the reel 192 from the axle 193 once the reel has been fitted thereon. A film portion pulled out of the roll 5 thus mounted is initially extended around the guide roller 8 in a counterclockwise direction for half its circumference and then around the transport drum 6 clockwise for half its circumference, and is subsequently directed toward a conveying path 197. The delivery port 197*a* into the conveying path is defined by the guide roller 7 which is held in abutment against the periphery of the drum 6.

Figure 17:
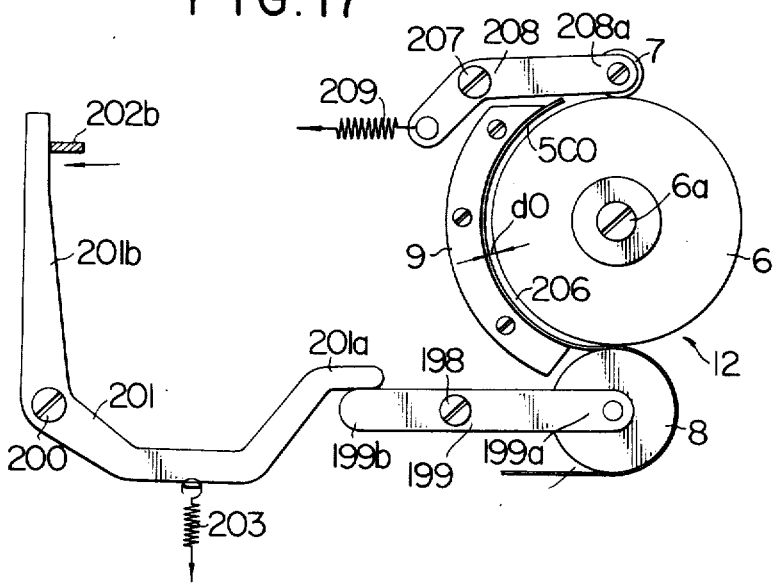
FIGS. 17 and 18 are plan views showing the operating mechanism for a guide roller in the delivery apparatus.
Figure 18:
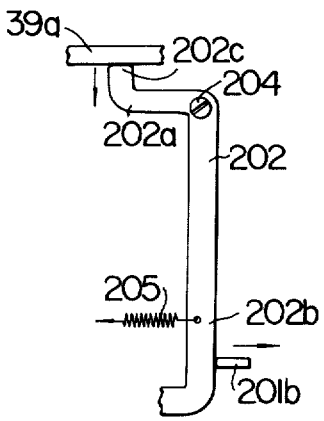
Figures 21, 22:
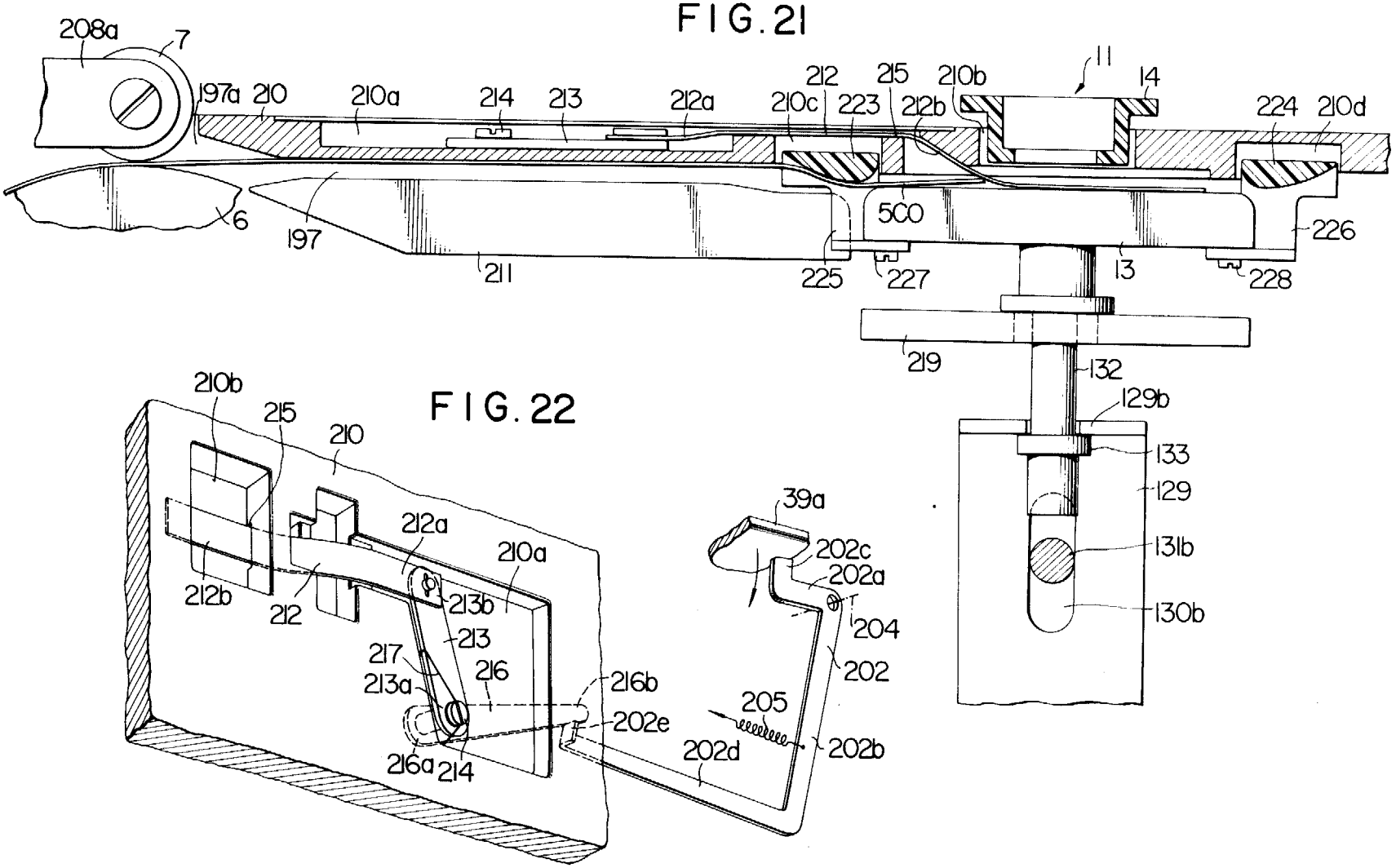
FIG. 21 is a plan view showing the manner of mounting a film leading member which guides the leading end of the film into the film conveying path.
FIG. 22 is a perspective view showing the operating mechanism for the film leading member.

The guide roller 8 is rotatably mounted on the end of an arm 199*a* of a support member 199 which is pivotally mounted on a pivot 198. The support member 199 is adapted to rock as the lid 39*a* of the casing 39 is opened or closed to cause the guide roller 8 to abut against the periphery of the drum 6. The support member 199 has another arm 199*b* which engages with the end of an arm 201*a* of a bell crank-shaped rockable link 201 which is pivotally mounted on a pivot 200 and which is urged to rotate clockwise about the pivot 200 under the resilience of a spring 203, as shown in FIG. 17. The rockable link 201 has another arm 201*b* which engages with an arm 202*b* of a rocking member 202 extending in a direction at right angles to the arm 201*b*. As shown in FIGS. 18 and 22, the rocking member 202 is adapted to rock by interlocking with the opening and closing motion of the lid 39*a*. In FIGS. 18 and 22, the rocking member 202 is shown as viewed from the interior of the system. Specifically, the rocking member 202 is pivotally mounted at 204 on a stationary member, and is urged by a spring 205 to rock clockwise about the pivot 204. The rocking member 202 has one arm 202*a* which is bent to extend upwardly, with the extremity 202*c* thereof in abutment against the lid 39*a*. As the lid 39*a* is opened, the rocking member 202 rocks clockwise about the pivot 204 (counterclockwise when viewed from the exterior of the system) under the resilience of the spring 205. As it rocks, the rockable link 201 rocks clockwise about the pivot 200, as viewed in FIG. 17, under the resilience of the spring 203 in following relationship with the movement of the other arm 202*b* thereof. This results in a counterclockwise rocking motion of the support member 199 about the pivot 198, whereby the guide roller 8 is moved into abutment against the periphery of the drum 6.

Under this condition, the leader 500 of the film pulled out of the reel 192 is wrapped around the guide roller 8 and is then threaded between the drum 6 and the guide roller 8, and the drum 6 is driven for rotation. Thereupon, the film leader 500 moves through a conveying path 206 formed by the drum 6 and the guide piece 9 which is disposed adjacent to the left-hand circumference (as viewed in FIG. 17) of the drum 6 and is delivered through the delivery port 197*a* where the guide roller 7 is in abutment therewith, into the conveying path 197. Subsequently, the film is passed over the pressure plate 13, through the cutter assembly 24 and onto the belt 44 (see FIG. 12) to be tensioned.

The guide roller 7 is disposed at a position substantially symmetrical to the guide roller 8 with respect to the axle 6*a*. Specifically, as shown in FIGS. 16 and 17, the roller 7 is rotatably mounted on the end of an arm 208*a* of a support arm 208 which is pivotally mounted on a pivot 207. The arm 208 is urged by a spring 209 to rock clockwise about the pivot 207, whereby the guide roller 7 is brought into abutment against the periphery of the drum 6. The conveying path 206 defined between the drum 6 and the guide piece 9 has a small spacing $d_0$. Because the film has a tendency to curl, it moves slidingly along the guide piece 9 as the film leader 500 passes through the conveying path 206. In so doing, the film is forced to bow in the opposite direction to that of the curling tendency, thereby removing the latter tendency. However, this results in an undesirable effect in that the film located between the guide rollers 8 and 7 remains loose without being held tightly against the periphery of the drum when the leader 500 has advanced into the nip between the guide roller 7 and the drum 6, and if the normal film feeding operation is commenced under this condition, the relaxed film will result in an error in the amount of film feed.

To avoid such disadvantage in the system of the invention, an arrangement is made to release the guide roller 8 from abutment against the drum 6 when the lid 39*a* is closed after the film has been tensioned in the electrophotographic processing position. Specifically, when the lid 39*a* is closed, the extremity 202*c* of the arm 202*a* is forced down to thereby cause the rocking member 202 to rock counterclockwise (or clockwise when viewed from the exterior of the system) about the pivot 204 against the resilience of the spring 205, whereby the other arm 202*b* moves the arm 201*b* of the rockable link 201 to the left, as viewed in FIG. 17. As a consequence, the rockable line 201 rocks counterclockwise, as viewed in FIG. 17, about the pivot 200 against the resilience of the spring 203, whereby its arm 201*a* moves away from the arm 199*b* of the support member 199 to release the guide roller 8 from abutment against the drum 6, the roller 8 thus remaining free. In this manner, the guide roller 8 is not driven as the drum 6 rotates, but serves as a mere guide roller so that no slackening of the film takes place. As indicated in FIG. 16, the film is tightly held against the periphery of the drum, and further delivery of the film into the conveying path 197 is effected by the drum 6 and the guide roller 7 which abuts against it, thus preventing the occurrence of an error in the film feeding operation.

Figure 19:
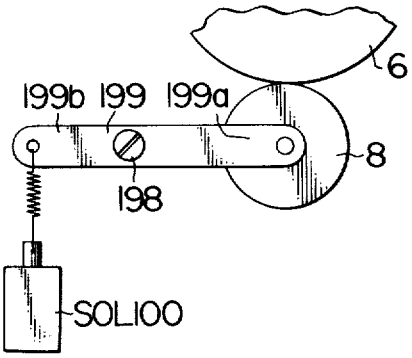
FIG. 19 is a plan view showing another example of the operating mechanism for the guide roller.

While in the embodiment described above the means for moving the guide roller 8 to and from the drum 6 comprises a linkage interlocked with the opening and closing of the lid 39*a*, the result can be achieved alternately by the arrangement shown in FIG. 19. Specifically, referring to this figure, the other arm 199*b* of the support member 199 for the guide roller 8 is pulled by a solenoid SOL100 to cause the abutment of the guide roller 8 against the drum 6. After the film has been loaded, the solenoid SOL100 is deenergized, thus making the guide roller 8 free.

Figure 20:
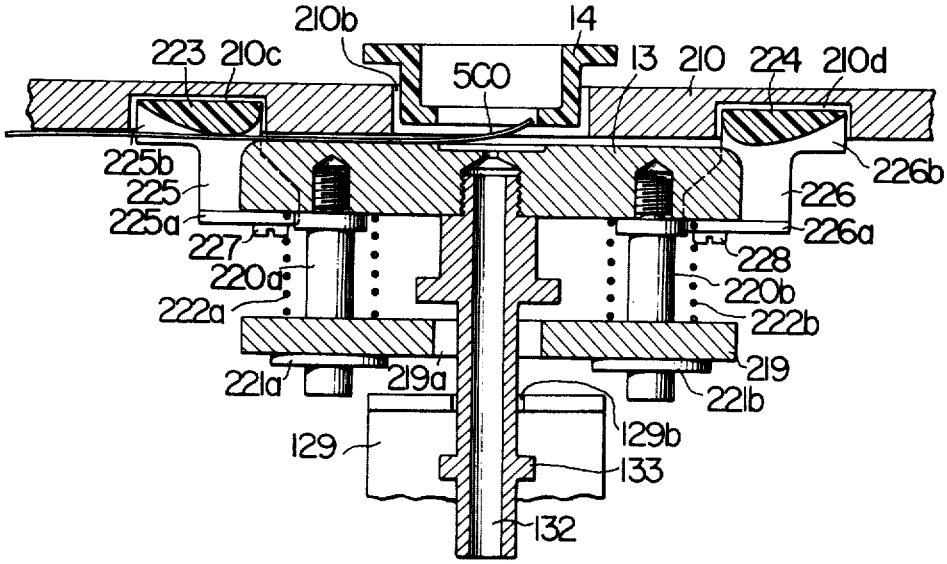
FIG. 20 is an enlarged section showing a film conveying path formed by a pressure plate and an apertured frame.

As the film leader 5C0 moves through the conveying path 197, there is still a certain amount of curling tendency in the film leader, which therefore bows toward the apertured frame 14. As shown in FIG. 20, in moving through the space between the apertured frame 14 and the pressure plate 13, the bow in the film leader may jam against the apertured frame 14 to prevent smooth conveying of the film.

In the film delivery apparatus 12, such disadvantage is eliminated by interposing a film leading member between the apertured frame 14 and the pressure plate 13. Referring to FIG. 21, the conveying path 197 is formed by a clearance between a stationary wall 210 on which the apertured frame 14 is resiliently mounted and a stationary member 211 which is disposed on the outer side of the wall 210 (below it as viewed in FIG. 21) and in parallel relationship with this wall 210. In FIG. 21, the conveying path 197 is located to the right of the film delivery port 197*a* defined between the guide roller 7 and the drum 6. To the right of the conveying path 197 is located the electrophotographic processing station 11 defined by the apertured frame 14 and the pressure plate 13; as shown in FIG. 12, the station 11 is located on the optical axis 0. The movable unit 15 is adapted to move along the wall 210 on the inner side thereof, i.e., on the opposite side thereof from the stationary member 211. On its inner side (on the upper side as viewed in FIG. 21), the stationary wall 210 is formed with a recess 210*a* in which one end 212*a* of the film leading member 212 is disposed. The film member 212 comprises an elongate thin piece of material such as celluloid or polyester film which is flexible and has low surface friction. When viewed in plan view, the recess 210*a* is substantially rectangular in shape, as indicated in FIG. 22. Within the recess 210*a*, a rockable arm 213 has its one end 213*a* pivotally mounted on an axle 214 which extends through the stationary wall 210 to the exterior thereof. The free end 213*b* of the rockable arm 213 has one end 212*a* of the leading member 212 mounted thereon. The body 212*b* of the leading member 212 extends through an interconnecting groove 215 which is formed in the stationary wall 210 so that the recess 210*a* communicates with a mounting aperture 210*b* formed therein for mounting the apertured frame. The axle 214 is rotatable with respect to the stationary wall 210, and on the opposite end of the axle 214 is fixedly mounted one end 216*a* of an arm 216, the other end 216*b* of which is adapted to engage a folded piece 202*e* from an arm 202*d* which is bent in the L-shape from the arm 202*b* of the rocking member 202. The rockable arm 213 is urged by a torsion spring 217 disposed around the axle 214 to rock clockwise, as viewed in FIG. 22, about the axle 214.

When loading the film, the lid 39*a* is open, so that the rocking member 202 rocks clockwise about the pivot 204 under the resilience of the spring 205 to bring its folded piece 202*e* to an upper position, thereby rocking the axle 214 as well as the rockable arm 213 counterclockwise through the arm 216. As a result, the film leading member 214 is driven forward in the direction in which the film is conveyed, with its free end 212*b* traversing the aperture 210*b* as shown in FIG. 22. When the film is fed under this condition, the film leader 5C0 moves through the space between the apertured frame 14 and the pressure plate 13 while sliding along the leading member 212 as shown in FIG. 21, so that no jamming with the aperture 210b or other members occurs even if the film leader 5C0 had a curling tendency, thereby assuring a smooth passage of the film.

After the film has been passed smoothly in this manner, the lid 39a is closed, whereby the extremity 202c of the rocking member 202 is depressed by the lid 39a to rock counterclockwise about the pivot 204 against the resilience of the spring 205, moving the folded piece 202e away from the arm 216 and thus causing the rockable arm 213 to rock together with the axle 214 clockwise under the resilience of the spring 217 until it abuts against a side wall of the recess 210a. By such rocking motion of the rockable arm 213, the free end 212b of the leading member 212 is retracted from the aperture 210b, thus clearing it. Thus, in the present embodiment the film leading member 212 is moved into and out of the space between the apertured frame 14 and the pressure plate 13 by interlocking with the opening and closing of the lid 39a, and the rocking member 202 for rocking the rockable arm 213 is used in common with the drive for moving the guide roller 8 to and from the drum 6.

Figure 23:
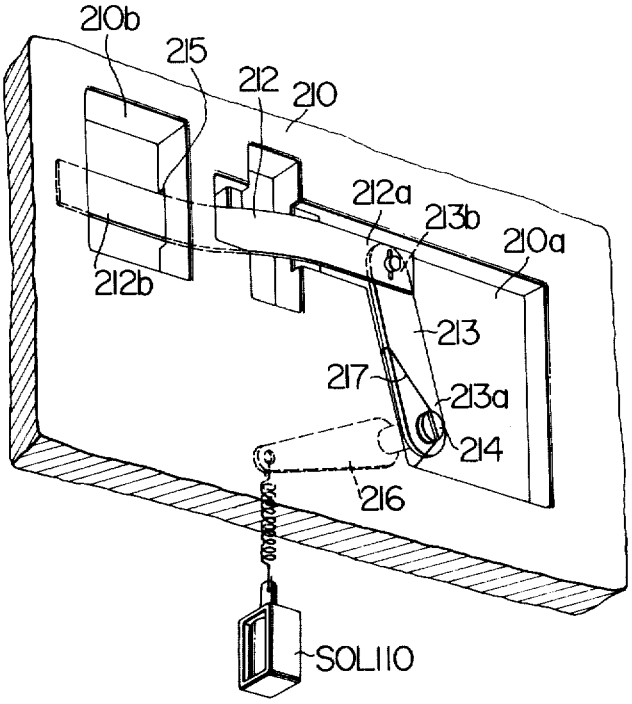
FIG. 23 is a perspective view of another example of the operating mechanism which may be used in place of the one shown in FIG. 22.
Figure 24:
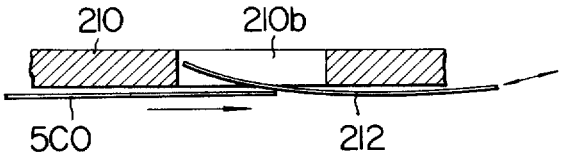
FIG. 24 is a fragmentary sectional view showing a further example of the film leading member.

While in the embodiment described above the rockable arm 213 has been rocked by using the rocking member 202, it will be understood that similar rocking motion can be achieved by pulling the arm 216 by means of a solenoid SOL110 as indicated in FIG. 23. Furthermore, while in the embodiment described above the film leading member 212 has been disposed at an advanced position with respect to the aperture 210b as viewed in the direction in which the film is conveyed and is moved in such direction, it will be appreciated that the leading member 212 may be disposed beyond the aperture 210b and may be moved in a direction opposite the conveying direction of the film, as shown in FIG. 24. When the film leading member 212 is inserted into the space between the apertured frame 14 and the pressure plate 13, the pressure plate 13 is retracted from the apertured frame 14.

Pressure plate

Figure 25:
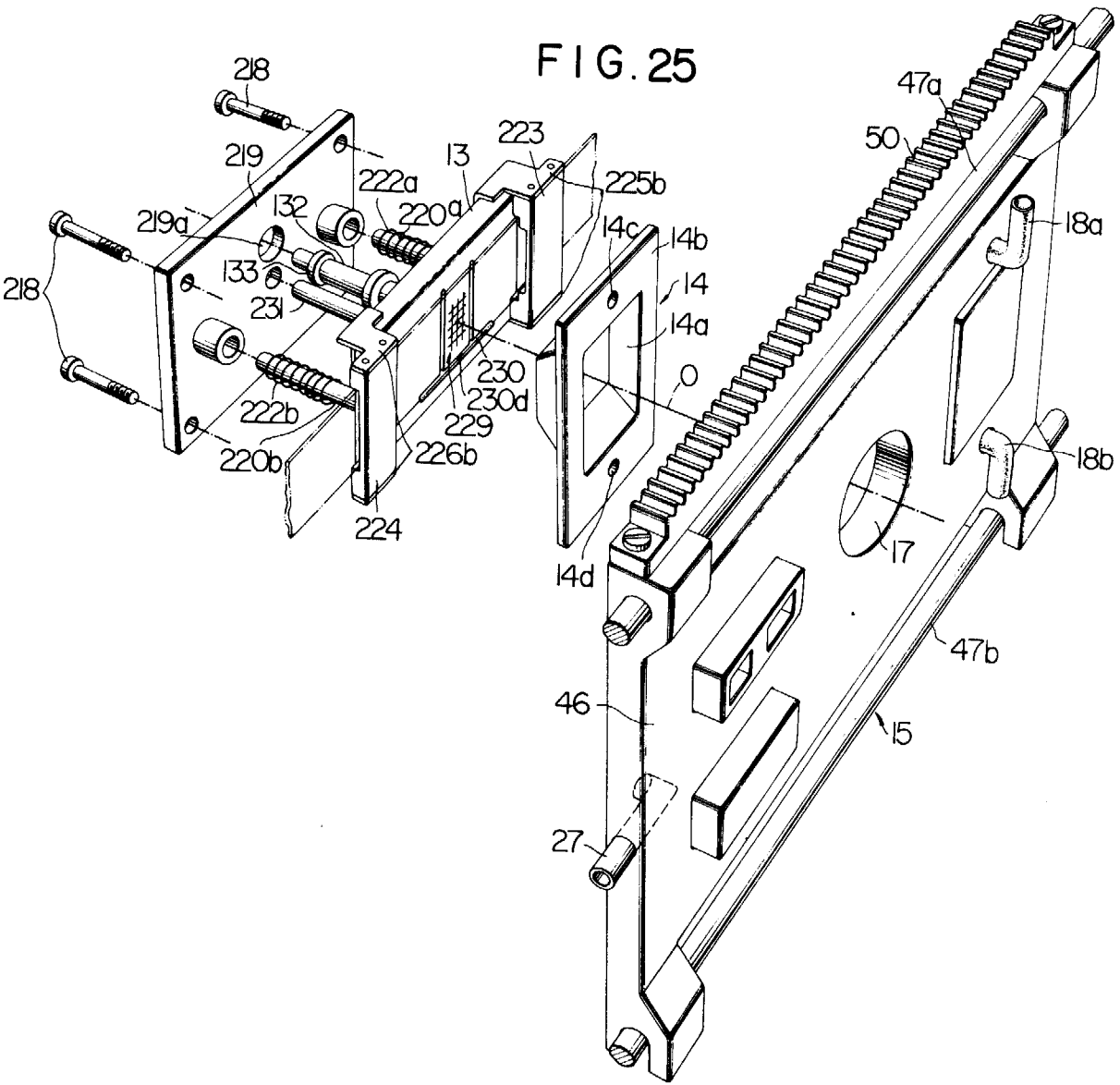
FIG. 25 is an exploded perspective view of the pressure plate and associated parts for illustrating the mounting structure of the pressure plate.

The mounting structure for the pressure plate 13 is specifically indicated in FIGS. 20, 21 and 25. The pressure plate 13 which is located opposite to the apertured frame 14 comprises a relatively thick rectangular plate resiliently mounted on a stationary plate 219 which is substantially integrally secured to the stationary wall 210 by means of a plurality of bolts 218 (see FIG. 25). Specifically, the hollow shaft 132 is fixedly mounted centrally on the rear surface of the pressure plate 13 and extends rearwardly, and on opposite lateral sides thereof a pair of studs 220a and 220b are screwed into the pressure plate 13. The free end of the studs 220 and 220b extend rearwardly through the stationary plate 219, and locking rings 221a and 221b are fitted on their ends which extend beyond the stationary plate 219. A pair of compression coiled springs 222a and 222b are disposed around the studs 220a and 220b, respectively, to urge the pressure plate 13 to a position adjacent the apertured frame 14. The hollow shaft 132 extends rearwardly through an opening 219a formed in the stationary plate 219, and the fork 129b mentioned above fits around the hollow shaft at a portion intermediate the flange 133 integrally formed therewith and the stationary plate 219. A pair of film separating members 223 and 224 are mounted on the pressure plate 13 for moving the pressure plate 13 together with the film thereon when the pressure plate is to be retracted during the time the film is conveyed. As indicated in FIG. 20, the film separating members 223 and 224 are secured to channel-shaped fixtures 225 and 226, respectively, which are located on the opposite sides of the pressure plate 13 and have their vertical bases 225a, 226a secured to the opposite ends of the pressure plate 13 on the rear surface thereof by means of set screws 227, 288. The horizontally extending limbs 225b and 226b (see FIG. 25) of the fixtures extend forwardly beyond the front surface of the pressure plate 13, and the separating members 223 and 224 are mounted across the horizontal limbs 225b, 226b to extend in a direction perpendicular to the direction in which the film is conveyed. Because the separating members 223 and 224 extend forwardly of the pressure plate 13 on the opposite sides thereof, the stationary wall 210 is notched to provide grooves 210c and 210d in which they are positioned. Each of the separating members 223 and 224 has an airfoil cross sectional configuration toward the film. Consequently, as the film is conveyed through the conveying path 197, it passes through the space between the separating member 223 and the pressure plate 13 initially, then through the clearance between the apertured frame 14 and the pressure plate 13, and finally between the separating member 224 and the pressure plate 13. By using such separating members 223 and 224, it is assured that the tensioned film is moved away from the apertured frame by means of the separating members when the rockable member 127 (see FIG. 12) is rocked to retract the pressure plate 13 to permit conveying the film. Such retracting movement of the film together with the pressure plate 13 prevents rubbing the photosensitive surface of the film which would otherwise occur when the film is conveyed while it is held in abutment against the stationary wall 210 around the aperture 210b for the apertured frame 14 because of the resilience of the springs 222a and 222b which urge the pressure plate 13 against the apertured frame 14 during the electrophotographic processing steps.

While the mechanism for retracting the pressure plate 13 has been described previously in connection with FIG. 12, FIG. 16 shows it separately from the remainder of the system. To iterate, the mechanism comprises the notched cam disc 110 fixedly mounted on the drive shaft 107, the roller 123 held abutting against the cam disc 110, the three arm link 121 carrying the roller 123 on its one arm 121a, the axle 118 for the link 121, the roller 125 abutting against the third arm 121c of the link 121, the rockable member 127 having the arm 127a which carries the roller 125, the axle 126 for the member 127, and the other arm 127b of the rockable member 127 which is formed with the folded piece 127c fitting in the slot 129a formed in the slide bar 129. By the fitting engagement of the elongate guide slots 130a and 130b of the slide bar 129 with the stationary pins 131a and 131b, respectively, the slide bar 129 is adapted to move in a direction perpendicular to the tensioned film surface, with the fork 129b fitting around the hollow shaft 132. When the notched cam disc 110 rotates through its 1 revolution, the increased diameter portion 110a moves the roller 123 angularly, whereby the three arm link 121 is rocked counterclockwise about its axle 118. As a result, the roller 125 is moved by the third arm 121c to rock the rockable member 127 clockwise about the axle 126, whereby the engagement between the folded piece 127c and the slot 129*a* causes the slide bar 129 to retract away from the tensioned film surface. As it retracts the fork 129*b* abuts against the flange 133 to move the hollow shaft 132, whereby the pressure plate 13 is retracted away from the apertured frame 14 against the resilience of the springs 222*a* and 222*b*. At the same time, the film separating members 223 and 224 move in the same direction, whereby the tensioned film is moved together with the pressure plate 13 away from the aperture 210*b* and its surrounding portion. Such separating motion occurs as the portion 110*a* moves the roller 123, and when the cam disc 109 with projection rotates through approximately one-fourth revolution, the film feeding operation is commenced. During the time the notched cam disc 110 rotates through the remaining ¾ revolution, the film is transported, and hence it will be noted that no damage to its photosensitive surface is caused because the film being transported is removed from the apertured frame 14. When the notched cam disc 110 has rotated through one revolution, the roller 123 falls into a notch (a portion 110*b* of reduced diameter in the cam disc 110), whereby the three arm link 121 rocks clockwise about its axle 118 and permits, through the rockable member 127, and advancing movement of the slide bar 129. Thereupon the fork 129*b* moves away from the flange 133, thus allowing the pressure plate 13 to move toward the apertured frame 14 together with the fresh film portion that is supplied into the region thereon under the resilience of the coiled springs 222*a* and 222*b* and to hold that fresh film portion in position for the intended electrophotographic processings.

Figure 28:
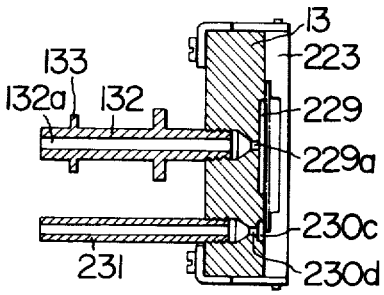
FIG. 28 is a cross section taken along the line X-X shown in FIG. 27.
Figure 27:
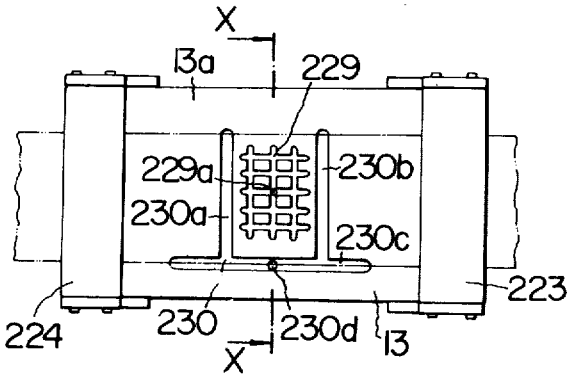
FIG. 27 is a front view of the pressure plate.

The pressure plate 13 has a film resting surface 13*a* in which are formed film suction grooves 229 and grooves 230 which suck residual developing solution during the developing process, as shown in FIG. 27. Specifically, the grooves 229 are formed in grid shape centrally in the front surface of the pressure plate 13 which defines the film resting surface 13*a* and communicate with each other and also with a small opening 229*a* which extends through the pressure plate 13 at a central position of the grooves. As indicated in FIG. 28 which is a cross section taken along the line X—X shown in FIG. 27, the small opening 229*a* communicates with the interior 132*a* of the hollow shaft 132, which is connected with a suction pipe described later so that the air within the hollow shaft 132 and the grooves 229 is withdrawn through the suction pipe by a suction unit when the film is held stationary on the pressure plate 13. This is provided for the purpose of maintaining the planarity of the film held in place on the pressure plate. When the film is held in place over the grid-shaped grooves 229, the latter is closed by the film, and when the internal space of the grooves 229 is subject to suction, the film is held attracted to the pressure plate to thereby maintain its planarity. Preferably the grooves 229 extend over a region which corresponds to the area of one frame of the microfilm. While the grooves 229 have been shown in the form of grid in the above example, it should be understood that they may be formed in any desired shape provided they communicate with the suction unit.

The grooves 229 are surrounded by the grooves 230 which serve to remove residual developing solution. Specifically, these include a pair of traverse grooves 230*a* and 230*b* which are spaced apart by a distance corresponding to the width of one frame of the microfilm, and a longitudinal groove 230*c* located on the lower lateral edge of the microfilm, it being understood that all of these grooves communicate with each other. A small opening 230*d* is formed to extend through the pressure plate 13 at an intermediate position in the groove 230*c*. The small opening 230*d* communicates with the interior of a suction pipe 231 (see FIGS. 25 and 28) screwed into the rear surface of the pressure plate 13 at a position downstream of the hollow shaft 132 and extending parallel thereto. The suction pipe 231 serves also the function of withdrawing the air from the grooves 230 and allowing a residual developing solution to be collected from the groove 230*c* into the vacuum tank 42 (see FIG. 11) through the pipe 231 as such developing solution drops down on the developed film surface to flow into the groove 230*c* when the developing solution is to be drained from the vessel 18 (see FIGS. 5 and 12) subsequent to the developing step.

Apertured frame

Figure 29:
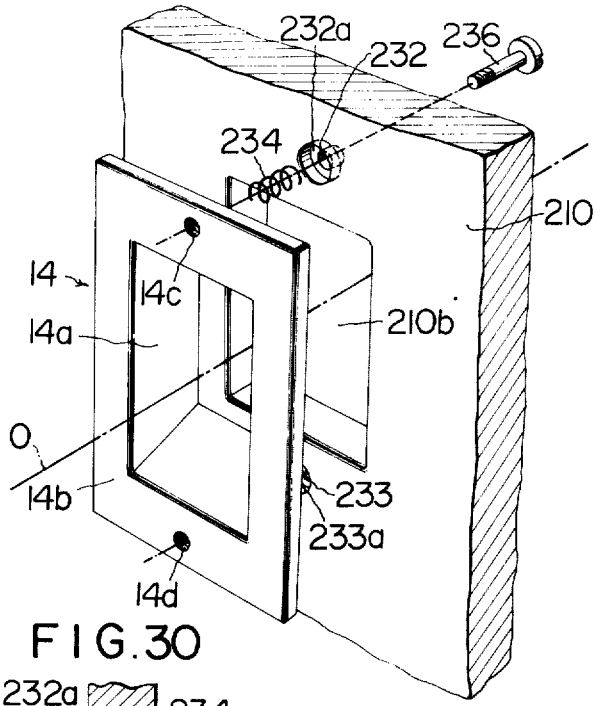
FIG. 29 is an exploded perspective view showing the mounting structure for the apertured frame.
Figure 30:
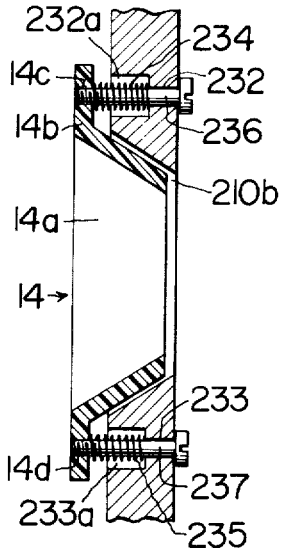
FIG. 30 is a longitudinal section of the apertured frame.

As mentioned previously, the apertured frame 14 is resiliently mounted to be located on the optical axis O (see FIG. 12). As indicated in FIG. 29, the aperture 210*b* for mounting the apertured frame is formed in the stationary wall 210 so as to be on the optical axis O and is in the form of an elongate rectangle having four side walls tapered toward the pressure plate 13 so as to reduce the area of the aperture as the pressure plate 13 is approached. A pair of mounting holes 232 and 233 are formed to extend through the stationary wall 210 on the upper and lower sides of the aperture 210*b*, and are enlarged on the side facing the apertured frame 14 to define holes 232*a* and 233*a* for receiving a pair of compression coiled springs 234 and 235, respectively. The apertured frame 14 is of an electrically insulating material such as synthetic resin or the like, and comprises a bevelled wall 14*a* which conforms to the tapered aperture 210*b* and a marginal area 14*b* which is integral with the forward end of the bevelled wall 14*a*. The marginal area is formed with a pair of threaded holes 14*c* and 14*d* in its upper and lower portions for receiving mounting screws 236 and 237, respectively. As indicated in FIG. 30, the mounting screws 236 and 237 are inserted into the holes 232 and 233, respectively, the coiled springs 234 and 235 are disposed around them, and subsequently the screws 236 and 237 are threadably engaged with the threaded holes 14*c* and 14*d*, respectively, to mount the apertured frame 14 floating in the aperture 210*b* of the stationary wall 210. The opening defined by the bevelled wall 14*a* of the apertured frame 14 at the position nearest the pressure plate 13 corresponds exactly to the size of one frame of the microfilm, e.g. 9 × 14 mm (see FIG. 7).

Figure 31:
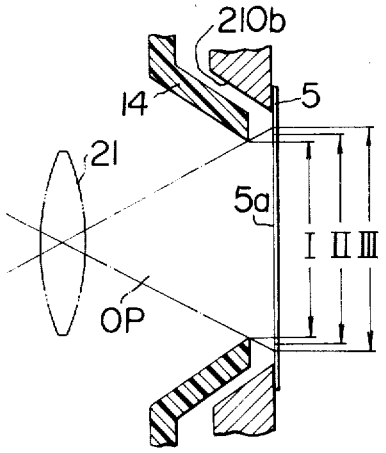
FIG. 31 is a schematic illustration of image fields formed by a double structure movable apertured frame.

The purpose of constructing the aperture in the form of a double structure comprising the mounting aperture 210*b* formed in the electrically conductive stationary wall 210 and the electrically insulating apertured frame 14 is to provide an increasing area of the image field on the film held in place on the pressure plate 13 as the sequence of the developing, charging, and exposure steps takes place, by moving the apertured plate 14 along the optical axis. If a single apertured frame 14 were used for all of these steps, the process of bringing the opening of the developing solution vessel 18 into close contact with the apertured frame 14 to thereby close it with the exposed photosensitive surface of the film and supplying the developing solution into the chamber thus formed for the purpose of developing as described in accordance with the invention, would result in developing solution remaining on the marginal area of the photosensitive surface when the vessel 18 is moved away therefrom, giving rise to a marring of the marginal area of the developed surface. To eliminate such disadvantage, it is desirable to have an insensitive marginal area surrounding each frame of the microfilm. It is noted that in contradistinction to silver salt photographs, the formation of an electrophotographic image involves initially the charging of the photosensitive semiconductor surface. This fact is advantageously utilized in the system of the invention during the charging and subsequent exposure steps by employing a movable apertured frame 14 to leave insensitive a marginal area around each frame so that the developing solution subsequently applied thereto has no effect upon this marginal area. Specifically, when the aperture comprises a double structure including the mounting aperture 210*b* and the apertured frame 14, it can be seen from FIG. 31 that upon charging, an image field II greater than the normal image field I defined by the apertured frame 14 can be charged from the corona discharge scattered and extended externally beyond the normal opening of the apertured frame 14 after having passed therethrough, which is possible because the apertured frame 14 floats over the photosensitive film surface 5*a* and the mounting aperture 210*b*. Then, an exposure takes place over an image field III which is still greater than the charged image field II. This is because during exposure, the apertured frame 14 again floats over the photosensitive film surface 5*a* and the mounting aperture 210*b*, and the ray OP exiting from the focusing lens 21 impinges upon the photosensitive surface 5*a* at an angle.

Figure 32:
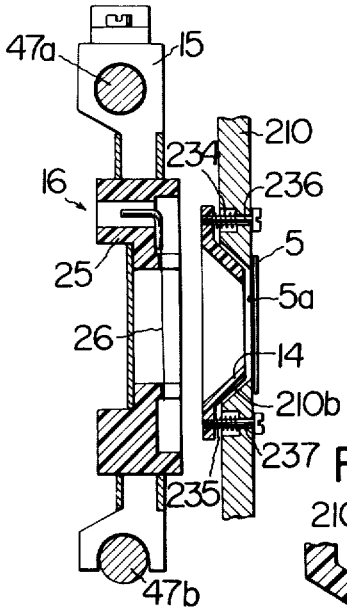
FIG. 32 is a cross section showing the relationship between the movable apertured frame and a charger.
Figure 34:
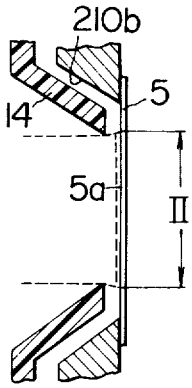
FIG. 34 is a section illustrating the charging field resulting from the arrangement shown in FIG. 32.
Figure 33:
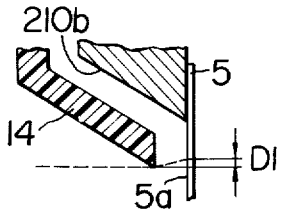
FIG. 33 is an enlarged section of a portion of FIG. 32.

The formation of the three image fields I, II and III is fully described with reference to FIG. 32. The charger 16 mounted on the movable unit 15 which is slidably mounted on the pair of guide rods 47*a* and 47*b* comprises the shield frame 25, and the corona discharge electrode 26 which extends vertically across the frame 25 and to which a discharge voltage from a high tension source HV (see FIG. 87) is applied. The charging of the photosensitive surface 5*a* of the film 5 takes place by moving the charger in front of and across the apertured frame 14. The discharge electrode 26 comprises a wire electrode, and it is known that when a wire electrode is used as a discharge electrode, the resulting corona discharge tends to be scattered on the landing surface. Thus, when the discharge occurs while frame 14 is maintained floating over the photosensitive surface 5*a* which represents the discharge landing surface, as shown in FIG. 32, the region of the photosensitive surface 5*a* which is charged by such discharge is nominally limited by the normal opening in the apertured frame 14, but the charge having passed through the apertured frame 14 is scattered in the space between the normal opening of the apertured frame 14 and the photosensitive film surface 5*a* as shown in FIG. 33. Hence, charging takes place over a region which extends beyond the edge of the normal opening in the apertured frame 14 by a slight distance $D_1$. Thus, the charged region defines an image field II on the photosensitive film surface 5*a* which is slightly greater than the image field I defined by the normal opening of the apertured frame 14, as shown in FIG. 34.

Figure 35:
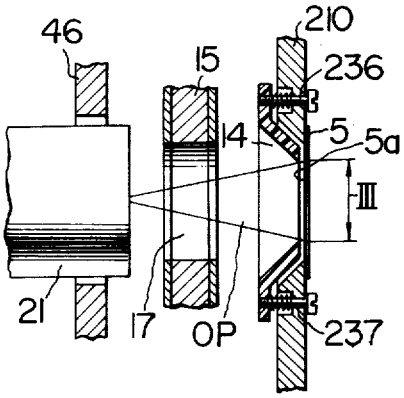
FIG. 35 is a section showing the relative arrangement of the movable apertured frame and an exposure unit and the exposure field formed thereby.
Figure 36:
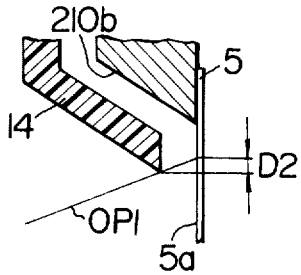
FIG. 36 is an enlarged section of a portion of FIG. 35.

After the image field II is charged, an exposure occurs over an image field III greater than the image field II. Referring to FIG. 35, when the exposure window 17 which comprises a circular opening in the movable unit 15 reaches its position on the optical axis of the focusing lens 21 by the movement of the movable unit 15, the exposure ray OP from the focusing lens 21 passes through the exposure window 17 to reach the photosensitive film surface 5*a*. At this time, the normal opening in the apertured frame 14 is again spaced from the photosensitive surface 5*a* on which the ray OP impinges, and the ray OP exits from the focusing lens 21 at an angle with respect to its axis. As a result, while the ray OP is patterned by the normal opening in the apertured frame 14, the ray $OP_1$ which exits along the line joining the center of the lens 21 and the inner edge of the normal opening in the apertured frame 14, will after having been patterned by the edge of the normal opening in the apertured frame 14, further extend radially as it reaches the photosensitive surface 5*a*, so that the exposed area on the photosensitive surface 5*a* will be extended by a distance $D_2$ externally beyond the edge of the normal opening in the apertured frame 14. The resulting exposure image field III which extends by a distance $D_2$ externally around the normal image field I is thus greater than the charged image field II. The additional charged area (II-I) which is marginal to the normal image field I is included within the exposure image field III, so that the charge in the additional charged area (II-I) will be completely removed when exposed. Such exposure is effected by the light emanating from a white diffuse surface formed on the original receptacle 23 to be described later and is independent from the light which forms an image. As a consequence, there is no residue of charge, so that no toner can attach thereto upon developing even if a residual developing solution is brought into contact therewith, thereby enabling a rectilinear boundary to be defined to form the normal image field I of each frame.

Figure 37:
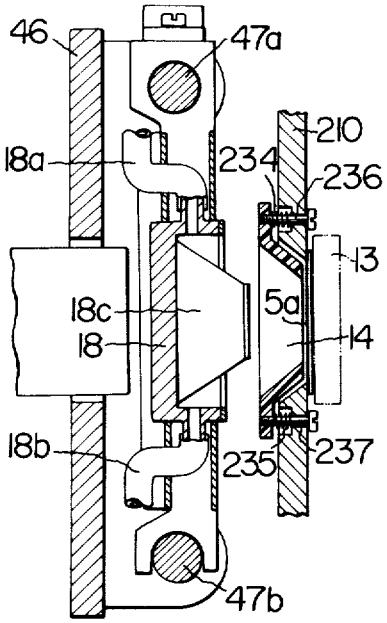
FIG. 37 is a section illustrating the relative arrangement of the movable apertured frame and a vessel of developing solution.
Figure 38:
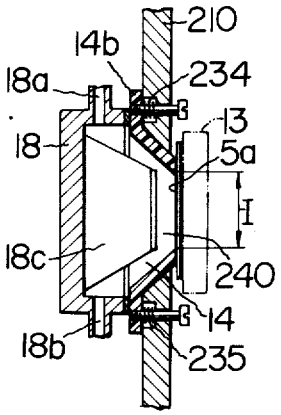
FIG. 38 is a section illustrating the developing field formed when developing the exposed film.

While the additional charge is removed by the exposure described above, an electrostatic latent image remains formed within the normal image field I which has an area corresponding to the area of the normal opening in the apertured frame 14. As indicated in FIG. 37, when the movable unit 15 has moved to bring the vessel 18 of developing solution into alignment with the apertured frame 14, and subsequently the vessel 18 is moved toward the apertured frame 14, the reentrant portion 18*c* thereof is moved into the apertured frame 14 as shown in FIG. 38, and the front end surface of the vessel 18 abuts against the marginal area 14*b* of the apertured frame 14, thereby forcing it against the pressure plate 13 against the resilience of the coiled springs 234 and 235. Under this condition, the area of the image field I coincides with the area of the opening of the apertured frame 14, and the opening of the vessel 18 is closed to the apertured frame 14, the opening of which is closed by the exposed film 5*a* on the pressure plate 13. As a result, the vessel 18 of developing solution, the apertured frame 14 and the film 5*a* on the pressure plate 13 define a developing chamber 240, and developing solution is supplied into this developing chamber through the supply inlet 18*a* formed in the upper portion of the vessel 18. The amount of developing solution supplied is predetermined by a developing solution supply unit described later so as to fill the developing chamber 240. As developing solution is supplied, it is brought into contact with the exposed photosensitive surface 5*a* to develop it. Such contact is maintained during the developing process which continues for a given period of time, and subsequently the developing solution within the developing chamber 240 is drained through the drainage port 18*b* formed in the lower part of the vessel 18. Because the image field I during the developing process coincides with the normal opening in the apertured frame 14, the boundary of the image field which defines one frame is sharply defined.

Figure 39:
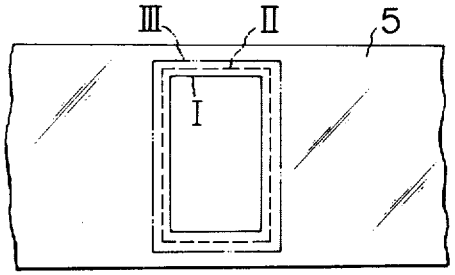
FIG. 39 is a front view showing the relative areas of the developing, exposure and charging fields.

To iterate, FIG. 39 illustrates that the charged image field II shown in phantom lines is greater than the image field I which is to be developed and the exposed image field III shown in chain lines is greater than the exposed image field II. This result is accomplished by using a double structure comprising the mounting aperture 210*b* and the apertured frame 14 and making the apertured frame 14 movable.

Another purpose of using this double structure is to improve the accuracy with which the film is positioned. By using the stationary wall 210 against which to position the film in alignment with the optical axis, it is easier to locate the photosensitive surface of a film portion corresponding to one frame in alignment with the imaging area on the optical axis with high accuracy and in a stable manner.

If the member which forms a frame against the photosensitive film surface is made of metal, it may impair satisfactory charging and developing. This difficulty may be avoided by using an insulating material such as a plastic material for the stationary wall 210, but this results in a difficulty in maintaining a desired positional accuracy. For these reasons, in accordance with the invention, the stationary wall 210 is formed of a metal to improve the accuracy in positioning the film, while its effects during the charging and developing steps are counterbalanced by using an insulating material for the apertured frame 14 together with the mounting aperture 210*b* formed in the stationary wall 210, thus again providing a double structure.

The resulting double structure permits the apertured frame 14 to be resiliently mounted by means of the springs 234 and 235 as mentioned above so that upon developing, the vessel 18 of developing solution can be brought into abutment against it to move it against the film, thereby moving the film 5 away from the stationary wall 210. In this manner, attachment of developing solution to the stationary wall 210 to mar it is avoided during the developing step, whereby a degradation in the positional accuracy of the film which may result from marring the stationary wall 210 can be prevented.

Residual developing solution suction means

This means serves to prevent residual developing solution from remaining attached to the developed surface after the developing solution supplied into the developing chamber 240 is drained. The arrangement is such that as the movable unit 15 moves slowly in its return stroke subsequent to completion of the developing step, the apertured frame 14 follows it, moving away from the film surface to cause an air stream to flow through the gap formed between the film surface 5*a* and the apertured frame 14 and to blow off any residual developing solution attaching to the film surface 5*a* into the developing chamber 240 while simultaneously reducing the pressure within the developing chamber 240.

Figure 40:
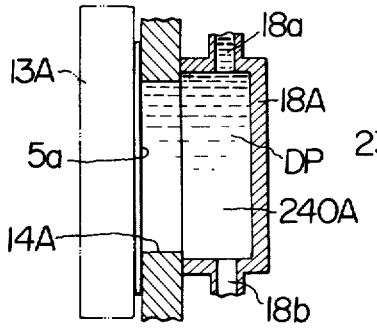
FIG. 40 is a section of a developing chamber which is formed by a fixed apertured frame.
Figure 41:
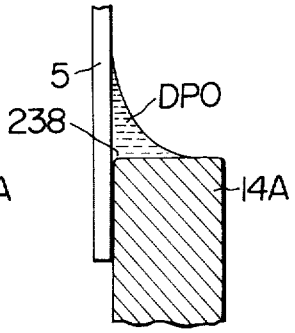
FIGS. 41 and 42 are enlarged sections showing part of FIG. 40 and illustrating the relationship between the fixed apertured frame and the film.
Figure 42:
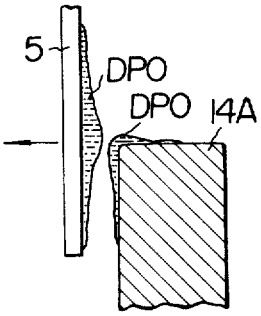

As an illustration of the effect discussed above, FIG. 40 shows an aperture station formed by a stationary frame 14A, one side of which abuts against a photosensitive film 5*a* carried on a pressure plate 13A as a result of a movement of the latter, while the other side of the film abuts against a vessel 18A of developing solution to define a developing chamber 240A. When developing solution DP enters the developing chamber through the supply inlet 18*a*, and is drained through the drainage port 18*b* subsequent to the developing step, the developing solution DP may not be completely drained from the developing chamber 240A, and some of it may remain in a corner region 238 formed by the film 5 and the fixed frame 14A as shown in FIG. 41. Such residual developing solution DPO will remain in both the upper and lower corner regions, but the majority of the residual developing solution will be in the lower corner region 238 because the film 5 is in an upright position and the residual developing solution DPO attaching to the upper corner region and to the developed surface of the film 5 falls by gravity along the developed surface to the lower corner region 238. If the pressure plate 13A is moved under this condition to move the developed film 5 away from the fixed frame 14A, the residual developing solution DPO remaining in the corner region 238 will divide between the film surface and the fixed frame 14A. The residual developing solution DPO which attaches to the film surface will fall down further by gravity, and may impair the image field defined by the aperture. In addition, the developing solution DPO remaining attached to the film surface and the fixed frame 14A may flow to mar other parts of the system. Such disadvantage can be prevented by an arrangement according to the invention.

Figure 43:
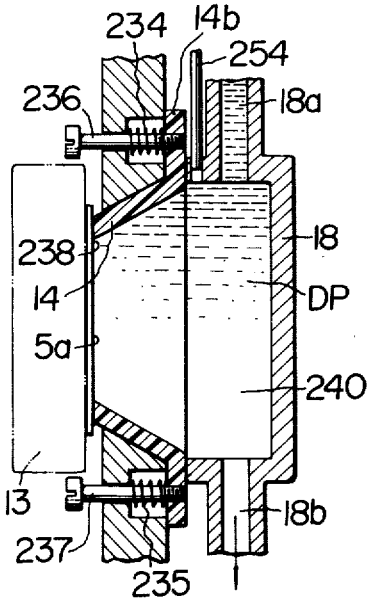
FIG. 43 is a section of the developing chamber formed by the film surface, movable apertured frame and the vessel of developing solution.
Figure 44:
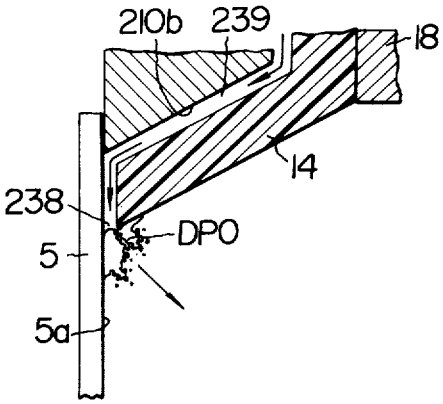
FIG. 44 is an enlarged section showing moving the apertured frame away from the film.

Referring to FIG. 43 and in accordance with the invention, the developing chamber 240 is defined by a movement of the vessel 18 to bring its front end into abutment against the marginal area 14*b* of the movable apertured frame 14 and to move it toward the exposed film 5*a* on the pressure plate 13 against the resilience of the coiled springs 234 and 235 until the edge defining the opening of the apertured frame 14 abuts against the film surface 5*a*. The developing solution DP is supplied into the developing chamber 240 through the inlet 18*a* to fill the chamber, whereby the photosensitive surface 5*a* is developed. Subsequently, the developing solution DP is drained from the developing chamber 240 through the drainage port 18*b*. The drainage takes place through the drainage port 18*b* by way of a drainage pipe 249 (see FIG. 45) which leads to the developing solution tank 41 (see FIGS. 11 and 45) described later to be collected therein. The drainage operation occurs by reducing the pressure within the tank 41 by means of the air pump 43 (see FIG. 45) as will be described later. When the pressure in the tank 41 is reduced, the developing solution DP within the developing chamber 240 is drained through the drainage port 18*b* and the drainage pipe 249 into the tank 41. After nominal drainage of the developing solution DP from the developing chamher 240 occurs, the movable unit 15 begins its returning motion, whereby the vessel 18 moves away from the film surface 5*a*. Thereupon, the apertured frame 14 follows the motion of the vessel 18 to move away from the film surface 5*a* under the resilience of coiled springs 234 and 235. As they move away from the film surface, the outer surface of the apertured frame 14 moves away from the wall of the mounting aperture 210*b* as shown in FIG. 44, so that a clearance 239 which connects to atmospheric pressure the interior of the apertured frame 14 and the vessel 18 is formed between the wall of the aperture 210*b* and the outer surface of the apertured frame 14, and between the film surface 5*a* and the forward end face of the apertured frame 14. Since the pressure within the apertured frame 14 and the vessel 18 is still reduced at this time, the formation of the clearance 239 allows atmospheric air to flow rapidly therethrough into the apertured frame 14 and the vessel 18. The kinetic energy of the air stream blows off the residual developing solution DPO attaching to the corner region 238 defined between the film surface 5*a* and the apertured frame 14 as well as the residual solution attaching to the film surface facing the interior of the apertured frame 14. The blown off residual solution DPO is directed to the drainage port 18*b* of the vessel 18 and is collected in the tank 41. Since now there is no residual developing solution DPO remaining on the film surface 5*a*, the image field is not disturbed and a rectilinear boundary is clearly defined. The absence of residual developing solution DPO avoids carrying developing solution to other parts of the system to mar them.

Developing solution supply unit

This unit supplies a predetermined amount of developing solution DP which is sufficient to fill the developing chamber 240 formed by the vessel 18, the apertured frame 14 and the film surface 5*a*. Specifically, referring to FIG. 45, a reservoir 242 of developing solution is disposed above the developing chamber 240 and is integrally formed with a metering tank 241 at its bottom. The metering tank 241 has a volume equal to the volume defined within the developing chamber 240 for receiving the developing solution. A communication hole 243 is formed in the bottom of the reservoir 242 to supply the developing solution therefrom into the metering tank 241. The communication hole 243 is adapted to be opened or closed by a valve 244 which is located within the metering tank 241 and is connected to one end of a connecting rod 245 which extends through the communication hole 243. The other end of the connecting rod 245 extends through the reservoir 242 to the exterior thereof in an upward direction to be connected with one end 246*a* of a rockable link 246. The rockable link 246 is pivotally mounted at 247 on the reservoir 242 and has its other end 246*b* operatively connected with the plunger of a solenoid SOL5 which is operated by an electrical circuit described later. When the solenoid SOL5 operates to pull the other end 246*b*, the rockable link 246 rocks counterclockwise about the pivot 247 to move the valve 244 upward through the connecting rod 245, thereby closing the communication hole 243 with the valve 244. When the communication hole 243 is closed, the developing solution within the metering tank 241 is supplied into the developing chamber 240 through a supply pipe 248 which connects a supply opening 241*a* formed in the bottom plate of the tank 241 with the supply inlet 18*a*. After a developing period previously established by the timer T2 (see FIGS. 10 and 88A) has passed, the developing solution supplied into the developing chamber 240 is drained through the drainage port 18*b* to the tank 41. The drainage port 18*b* and the tank 41 are connected by the drainage pipe 249 which includes a drainage control valve VI. The control valve VI is adapted to be controlled by a solenoid SOL6 which is operated by an electrical circuit described later.

The tank 41 and the reservoir 242 are connected together by a circulation pipe 250 which includes a circulation control valve V4 adapted to be controlled by a solenoid SOL9, this solenoid being operated by a solution level switch S4 cooperating with an electrical circuit described later. The solution level switch S4 is arranged on the reservoir 242 and has its actuator S4*a* coupled with a float 251 disposed within the reservoir 242. A rod 252 is fixed to the float 251 and extends externally of the reservoir 242 to be connected with the actuator S4*a*. The switch S4 is closed when the float 251 falls below a preselected level after the developing solution in the reservoir 242 has been supplied into the metering tank 241 a plurality of times, and cooperates with an electrical circuit to energize the solenoid SOL9 as the pressure within the tank 41 is increased by drainage of the developing solution from the developing chamber 240 into the tank 41, thereby opening the valve V4 to pump developing solution from the tank 41 into the reservoir 242. When developing solution is supplied into the reservoir 242 in this manner and the float 251 rises to a predetermined level, the switch S4 is opened to deenergize the solenoid SOL9, thereby closing the valve V4.

Thus, in the system according to the invention, the developing solution is intermittently circulated along a path including the reservoir 242, metering tank 241, developing chamber 240, tank 41 and reservoir 242. The metering tank 241 has a pipe 253 to communicate with the atmosphere, thereby allowing the air within the metering tank 241 to exit as developing solution is supplied thereto from the reservoir 242. The vessel 18 of developing solution is also connected with an air exhaust pipe 254 which extends upwardly therefrom, thereby enabling the exhaust of air therefrom when developing solution is supplied from the metering tank 241 into the developing chamber 240.

Figure 45:
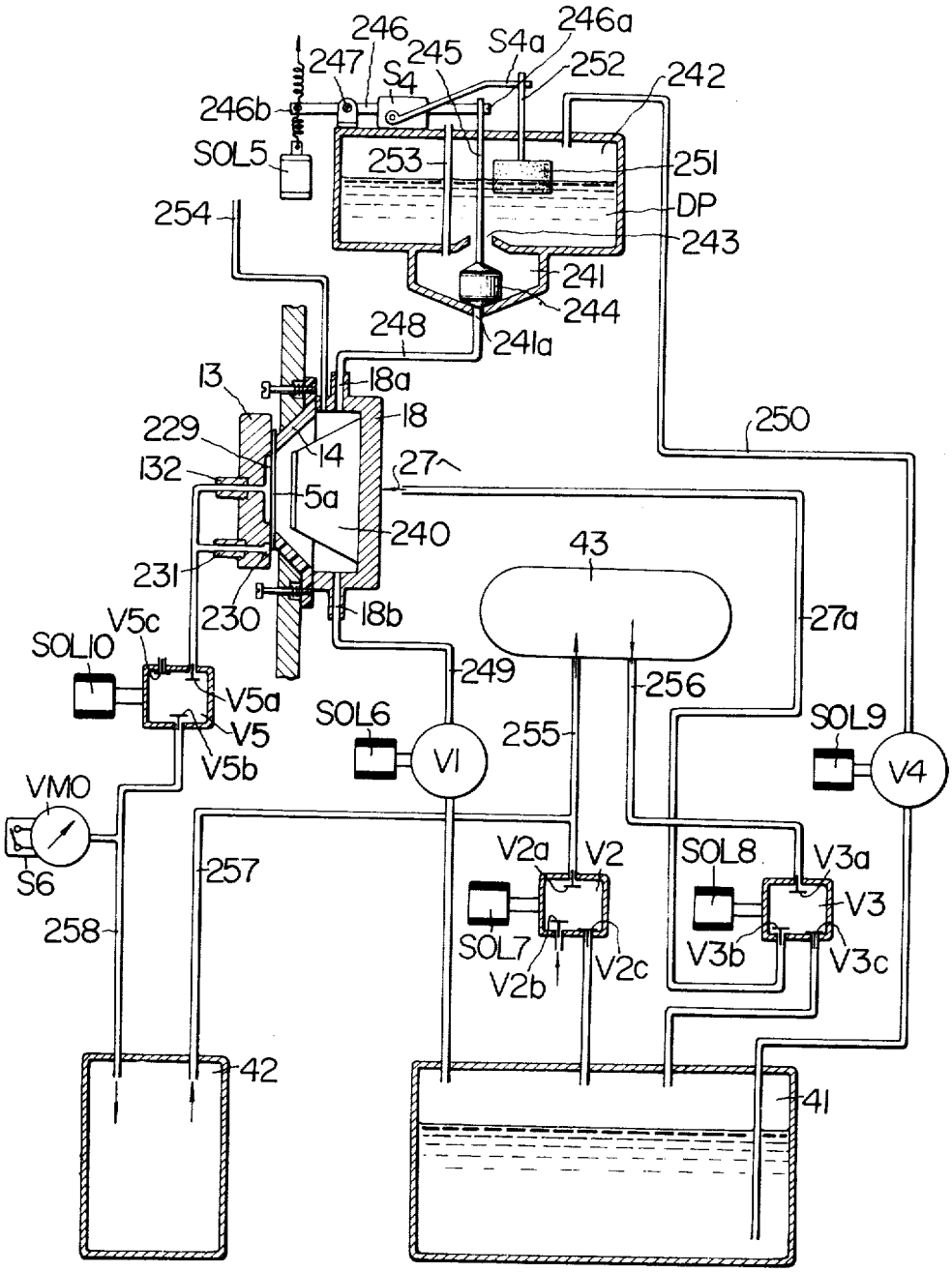
FIG. 45 is a diagram showing the apparatus for supplying the developing solution and the circulation path of the developing solution.

The circulation of the developing solution takes place by reducing and increasing the pressure within the tank 41 by means of the air pump 43. The air pump 43 is physically located in the innermost portion of the system as shown in FIG. 11, and is connected with the tank 41 through a pressure reducing pipe 255 and a pressure increasing pipe 256, as shown in FIG. 45. The pressure reducing pipe 255 includes a three-way valve V2 while the pressure increasing pipe 256 includes a three-way valve V3. The valve V2 has an inlet port V2*a* and an outlet port V2*b*, both of which are normally open, the outlet port V2*b* communicating with the atmosphere. The valve V2 also includes an outlet port V2*c* which is normally closed. Thus, the pressure reducing pipe 255 normally communicates with the atmosphere, and the air pump 43 is disconnected from the tank 41. The valve V2 is controlled by a solenoid SOL7 which is operated by an electrical circuit described later, and when the solenoid SOL7 is energized, the port V2*b* is closed and the port V2*c* is opened, thereby disconnecting the pipe 255 from the atmosphere and connecting the pump 43 with the tank 41 through the pipe 255. When such connection occurs, the pressure within the tank 41 is reduced. When the control valve V1 is opened by the operation of the solenoid SOL6, the developing solution within the developing chamber 240 is drained into the tank 41 through the drainage pipe 249.

The valve V3 has an inlet port V3*a* and an outlet port V3*b*, both of which are normally open, the port V3*b* communicating with the atmosphere. The valve V3 also includes an outlet port V3*c* which is normally closed. Thus, because the pressure increasing pipe 256 communicates with the atmosphere through the port V3*c*, the pump 43 is normally disconnected from the tank 41. The valve V3 is controlled by a solenoid SOL8 which is operated by an electrical circuit described later, and when the solenoid SOL8 is energized, the port V3*b* is closed and the port V3*c* is opened, thereby interrupting the communication of the pipe 256 with the atmosphere and connecting the pump 43 with the tank 41 through the pipe 256. As a result, the pressure within the tank 41 is increased, and when the control valve V4 is opened under the control of the solenoid SOL9, the developing solution within the tank 41 is circulated into the reservoir 242 through the circulation pipe 250.

Intermediate the pump 43 and the inlet port V2*a*, the pressure reducing pipe 255 is connected with a pipe 257 which leads to the suction vacuum tank 42. The vacuum tank 42 is also connected with a suction pipe 258 which is connected with the suction pipe 231 and the hollow shaft 132 (see FIG. 28) mounted on the rear surface of the pressure plate 13 for the purpose of applying suction to the film suction grooves 229 and the residual developing solution suction grooves 230. The suction pipe 258 includes intermediate its length a suction valve V5 and a pressure gauge VMO having a pressure switch S6. The suction valve V5 comprises a three-way valve having an inlet port V5*b* and an outlet port V5*a* which are open while the film portion which is on the pressure plate 13 is subjected to electrophotographic processings, thus enabling the suction created by the pump 43 to pull the film toward, andd to hold it in place upon the pressure plate 13 through the suction grooves 229 and 230. The valve V5 has another outlet port V5*c* which is normally in communication with the atmosphere, but is closed during the electrophotographic processing steps. The suction valve V5 is controlled by a solenoid SOL10 which is operated by an electrical circuit described later. When the film is to be transported, the solenoid SOL10 is enertized to close the port V5*b* and to open the port V5*c*, thereby connecting the suction grooves 229 and 230 with the atmosphere to make the film suction described above inoperative. The pressure gauge VMO serves to provide an indication of the degree of vacuum within the suction vacuum tank 42 which is subject to suction or pressure reduction by the pump 43. When the pressure reduction within the vacuum tank 42 is such that the suction applied to the film is sufficient to hold it fast against the pressure plate 13, the pressure switch S6 is closed to permit electrophotographic processings to proceed upon depression of the photographing switch SP. However, when the pressure reduction is insufficient, the pressure switch S6 is not closed, so that electrophotographic processings cannot be effected even if the photographing switch SP is depressed, and an alarm buzzer is operated to announce the insufficient pressure reduction. When no film is present on the pressure plate 13 or when the pressure reduction does not take place for some reason, the pressure within the vacuum tank 42 is not reduced. As a result, the pressure switch S6 is not closed, and the alarm buzzer is operated upon depression of the photographing switch SP.

When suction is normally applied to the film, any residual developing solution which may enter the pipe 258 through the suction grooves 230 during the developing step will be collected in the vacuum tank 42. The outlet port V3*b* of the valve V3 is connected with the ventilation hole 27 (see FIGS. 12 and 25) through the pipe 27*a* for causing dry air to be directed against the developed film surface for the purpose of fixing. In this manner, the developing solution supply unit in the system of the invention operates to supply and drain the developing solution as well as circulate it by increasing and reducing the pressure within the tank 41 by means of the air pump 43, and the pump also serves to reduce the pressure within the vacuum tank 42 to permit the film to be held against the pressure plate 13. In this manner, a compact and efficient developing solution supply unit is provided.

Original receptacle

Figure 46:
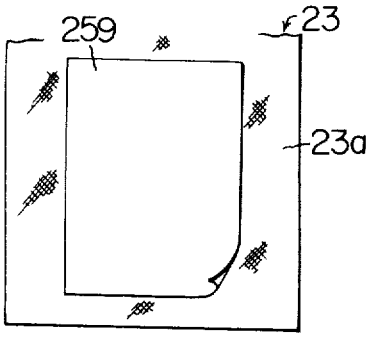
FIG. 46 is a plan view showing the relationship between an original receptacle and an original.
Figure 47:
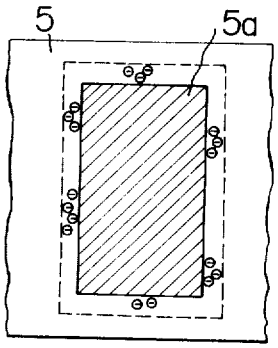
FIG. 47 is a plan view showing the relationship between the photosensitive surface of the film and the charged field.
Figure 48:
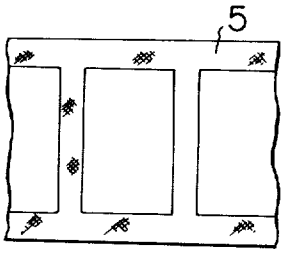
FIG. 48 is a plan view of a film having a marred margin around the photograph forming field.
Figure 49:
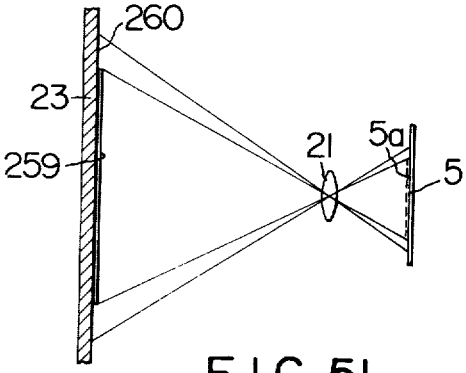
FIG. 49 is a schematic view illustrating the exposure of an original placed on the original receptacle.

The original receptacle 23 used in the system of the invention has a white diffuse surface around an original to be placed thereon. The purpose of such diffuse surface is to provide a well defined, uniform boundary for the image field in the resulting microphotograph, and to prevent electrostatic attachment of developing solution to the marginal area around the image field. Specifically, referring to FIG. 46, it will be appreciated that if the surface 23*a* of the original receptacle 23 on which an original is to be placed presents a color other than white, or if the surface 23*a* is marred around an original 259 to be placed even though it is white, the light which illuminates such portions will be projected as spot-like images on the marginal region around the normal image field of the photosensitive film surface 5*a* as shown in FIG. 47 to cause the charge to remain in such portions. Such remaining charge around the image field results in the marginal area development as shown in FIG. 48 when the film is developed. The result is a marring of the periphery of the image field on the microfilm, and where the marring occurs on or adjacent to the boundary of the image field, the resulting microphotograph may have a poor boundary definition.

In order to eliminate such disadvantage, the receptacle 23 used in the system of the invention has a white diffuse surface 260 around the periphery of the original 259 to be placed thereon. With such an arrangement, when the original 259 is placed on the receptacle 23 and illuminated by the lamps L1 to L8 (see FIG. 12), the light is intensively reflected by the white diffuse surface 260 around the periphery of the original 259 and is projected by the focusing lens 21 onto an area around the photosensitive surface 5*a* of the film 5. This results in the complete removal of the charge on this marginal area around the photosensitive surface 5*a*, whereby charge may remain only within the image field on the film surface.

Figure 50:
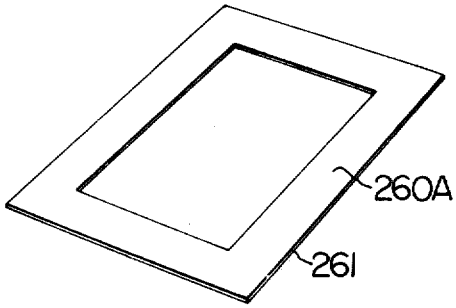
FIG. 50 is a perspective view of an original frame having a white diffuse surface.
Figure 51:
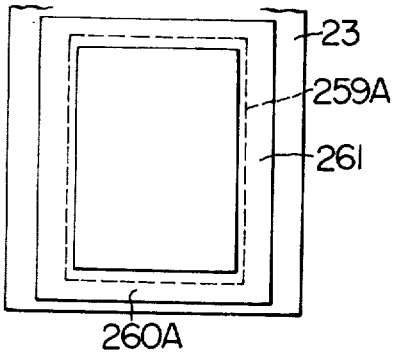
FIG. 51 is a plan view of the frame placed on an original.

As mentioned previously, in the system of the invention, the image field increases in size as the developing, charging and exposure steps take place, so that during the exposure, that portion of the image field which extends outside of the normal opening in the apertured frame 14 is the greatest as compared with those formed during the other steps, and the projection of the light from the white diffuse surface to such portion completely removes the charge that may have been applied in such portion.

Where a large sized original 259 is used, the white diffuse surface 260 may be formed by a white frame 261 having a white diffuse surface 260A, as shown in FIG. 50. Referring to FIG. 51, by placing the white frame 261 on a large sized original 259A shown in phantom lines so that the white diffuse surface 260A faces outward, the light, on illuminating the surface 260A, is reflected therefrom to remove the charge outsidde the normal image field completely.

Figure 52:
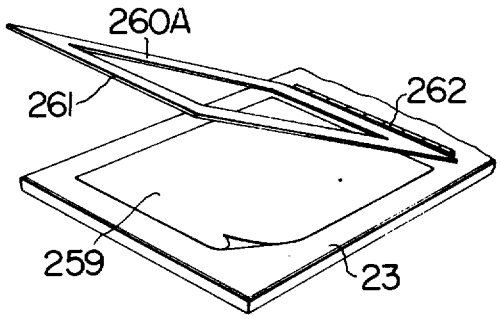
FIG. 52 is a perspective view showing another example of the original receptacle.
Figure 53:
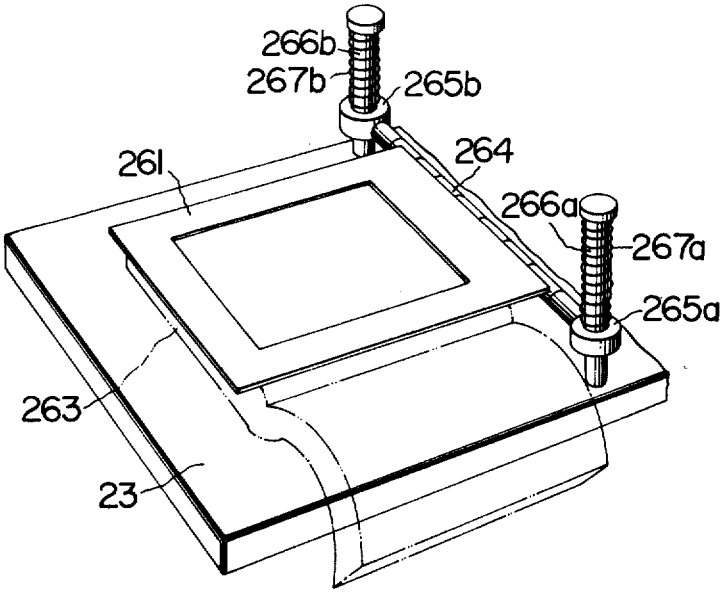
FIG. 53 is a perspective view showing a further example of the original receptacle.

As shown in FIG. 52, the white frame 261 may be mounted on the original receptacle 23 by a hinge 262 along its one side so that the white diffuse surface 260A is presented outside. Such mounting prevents a movement of the white frame 261, thereby assuring that the original 259 is always held in a definite position on the receptacle 23.

Where the original 259 is not a sheet of paper but a page of a book, for example, an arrangement as shown in FIG. 53 may be used to locate the original in place. Specifically, one side of the white frame 261 is provided with a support member 264 which constitutes a hinge and which is secured at its opposite ends to a pair of rings 265*a* and 265*b* fitted on a pair of studs 266*a* and 266*b*, respectively, which are fixedly mounted on the receptacle 23. A pair of coiled compression springs 267*a* and 267*b* are disposed along the studs 266*a* and 266*b*, respectively, to urge the white frame 261 to move downward, thereby holding an original in the form of a page of a book between the white frame 261 and the receptacle 23.

Movable unit and its drive mechanism

As mentioned previously, the movable unit 15 comprises a movable frame on which are mounted the charger 16, exposure window 17 and developing unit 18 which are sucessively brought into alignment with the optical axis O for the purpose of applying electrophotographic processing to the film held stationary on the pressure plate 13 in alignment with the optical axis O. The drive mechanism for the movable unit 15 is adapted to subject the latter to a reciprocatory motion across the optical axis O in a direction parallel to the film surface as well as to a movement along the optical axis. While the arrangement and operation of the movable unit 15 and its drive mechanism have been generally described in connection with FIG. 12, further details thereof will be described below.

Figures 54, 55:
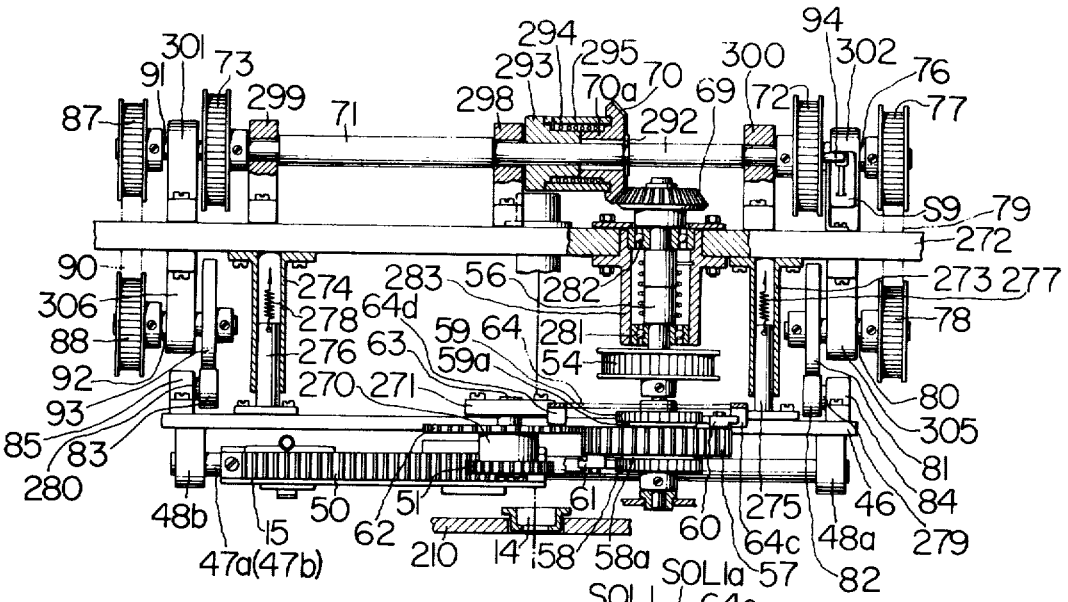
FIG. 54 is a top view of the drive mechanism for the movable unit.
FIG. 55 is a front view of FIG. 54.
Figure 56:
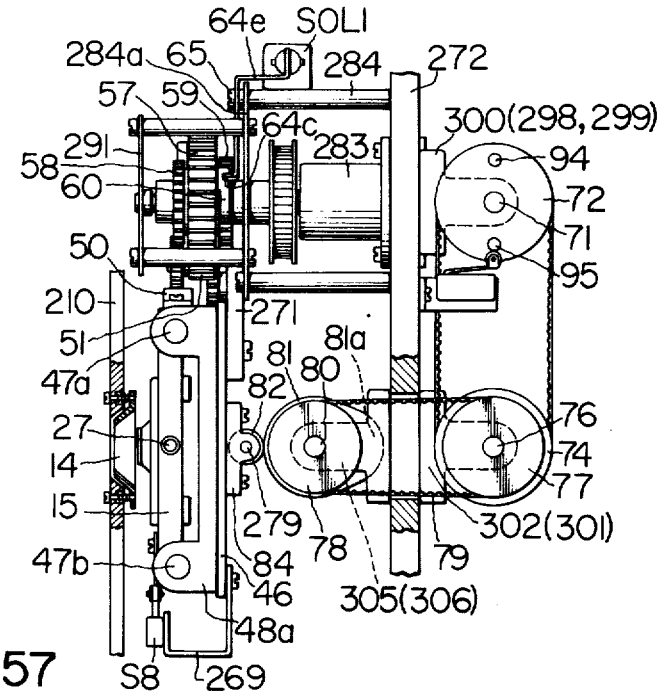
FIG. 56 is a right-hand elevation of FIG. 54, with parts broken away.

Specifically, referring to FIGS. 54, 55 and 56, the movable unit 15 is arranged opposite the stationary wall 210 on which the apertured frame 14 is mounted, and reciprocates along this wall in the direction in which the film runs. The movable unit 15 is slidably mounted on the mounting plate 46 which is arranged on its rear side and on the opposite side from the stationary wall 210. The pair of guide rods 47*a* and 47*b* are mounted on the upper and lower portions on the front surface (facing the stationary wall 210) of the mounting plate 46 by means of the mounting members 48*a* and 48*b* so as to extend horizontally and parallel to the direction in which the film moves. The upper guide rod 47*a* extends through the pair of fitting holes 15*a* and 15*b* formed on the opposite ends at the upper portion of the movable unit 15 while the pair of fork 15*c* and 15*d* provided in the lower part of the movable unit 15 on its opposite ends fit on the lower guide rod 47*b*, thereby rendering the movable unit 15 slidable along the mounting plate 46. On its front surface or the surface opposite the stationary wall 210, the movable unit 15 carries the ventilation hole 27 for supplying dry air for fixing, charger 16, exposure window 17 and vessel 18 of developing solution all of which are arranged in the sequence named as viewed in the direction of movement of the unit 15. The arrangement and operation of these units carried on the movable unit 15 have been described previously, and therefore will not be repeated. When the movable unit 15 is in its starting position (see FIG. 55), the ventilation hole 27 is located on the optical axis O and is opposite the film surface positioned within the apertured frame 14. At its right-hand bottom, the movable unit 15 has the microswitch operating member 49 mounted thereon, and the pair of microswitches S7 and S8 are located in the path of movement of the operating member 49. The microswitch S7 is operated by this member 49 when the movable unit 15 has moved in its forward stroke, to the right as viewed in FIG. 55, to bring the exposure window 17 into alignment with the optical axis O and opposite the film surface within the apertured frame 14. The microswitch S8 is operated by the member 49 when the movable unit 15 has further moved in its forward stroke to bring the vessel 18 into alignment with the optical axis O. These microswitches S7 and S8 are mounted on plates 268 and 269, respectively, both of which are secured to the mounting plate 46. When the switch S7 is operated, an exposure start signal is produced, while when the switch S8 is operated, a signal which drives the mounting plate 46 in the forward direction for developing processing is applied to an electrical circuit described later. When the movable unit 15 is in its starting position (see FIG. 55), the left-hand edge of the unit 15 operates a microswitch S10 disposed on the mounting member 48*b* to cause its contact to assume an operative position. The purpose of switch S10 is to permit the passage of air through the ventilation hole 27 for a period of time determined by the timer T3 for the purpose of fixing. When the movable unit 15 has completed the developing processing step and returned to its starting position, it switches the contacts of the switch S10, thereby operating the timer T3 for the purpose of ventilation and switching the motor M1 to a forward rotation.

As mentioned previously, the reciprocatory motion of the movable unit 15 is carried out by a rack and pinion arrangement. Specifically, the rack 50 is fixed on the top surface of the movable unit 15 and meshes with the pinion 51 which is secured to the hollow shaft 270 fitting on the axle 63. The interconnecting gear 62 which is fitted on the axle 63 is secured to the hollow shaft 270 and meshes with the clutch gear 57. The axle 63 is carried by the support plate 271 which is secured to the mounting plate 46. The mounting plate 46 is adapted to be moved together with the support plate 271 toward the stationary wall 210 by the rollers 82 and 83 which are driven forwardly by the cam discs 81 and 93 when the vessel 18 of developing solution is located on the optical axis O, thus bringing the vessel 18 mounted on the movable unit 15 into abutment against the apertured frame 14. The mounting plate 46 is slidably mounted on a stationary wall 272 which extends parallel to the stationary wall 210 and is slidable in the forward and rearward directions. On the side near the mounting plate 46, the stationary wall 272 has a pair of hollow shafts 273 and 274 fixedly mounted thereon, into which axles 275 and 276 integrally mounted on the mounting plate 46 fit. Normally, the axles 275 and 276 are pulled toward the stationary wall 272 by a pair of tension springs 277 and 278, respectively. In this manner, the mounting plate 46 is urged to move toward the stationary wall 272. However, such movement of the mounting plate 46 is prevented by the abutment against the periphery of the cams 81 and 93 of rollers 82 and 83 which are rotatably mounted by axles 279 and 280 on roller mounting members 84 and 85, respectively, which are in turn secured on the rear surface of the mounting plate 46 which is opposite the stationary plate 272.

The gear 87 which meshes with the interconnecting gear 62 is rotatably mounted on the drive shaft 56. The drive shaft 56 extends through the stationary plate 272 and is rotatably carried by bearings 281 and 282 which are received within a bearing sleeve 283 that is in turn fixed in the stationary plate 272, thus rendering the drive shaft 56 rotatable with respect to the stationary plate 272. On the portion of the drive shaft 56 which extends toward the stationary wall 210, the drive pulley 54 is fixed thereon, and the gear 57 mentioned above is also rotatably mounted thereon at a position further removed from the stationary plate 272 than the pulley 54 and is prevented from axial movement.

As described previously in connection with FIG. 12, the drive pulley 54 is connected by the timing belt 55 with the output pulley 54 of the motor M1 which runs the movable unit, and when the motor M1 is energized, the drive shaft 56 is rotated through the pulleys 53 and 54. As shown in FIG. 54, the gear 57 has a relatively large thickness to prevent the interconnecting gear 62 meshing therewith from disengagement therefrom when the mounting plate 46 is moved toward the stationary wall 210. A clutch mechanism is provided which comprises friction discs **58*a* and 59*a* (see FIG. 54), ratchet wheels 58 and 59 and pawl members 60 and 61 which are located on the opposite sides of the gear 57. Specifically, referring to FIGS. 12 and 54, the ratchet wheel 59 is located between the gear 57 and the pulley 54 ans is fixedly mounted on the drive shaft 56 to transmit the rotative force from the drive shaft 56 to the pinion 51 in order to move the movable unit 15 through its forward stroke by cooperating with the pawl member 60 mounted on the surface of the gear 57 which is opposite the pulley 54, while the other ratchet wheel 58 is disposed on the side of the gear 57 which is nearer the stationary wall 210 and is fixedly mounted on the drive shaft 56. The ratchet wheel 58 cooperates with the pawl member 61 which is mounted on the surface of the gear 57 opposite the stationary wall 210 to transmit the rotative force from the drive shaft 56 to the pinion 51 in order to move the movable unit 15** through its reverse stroke.

Figure 57:
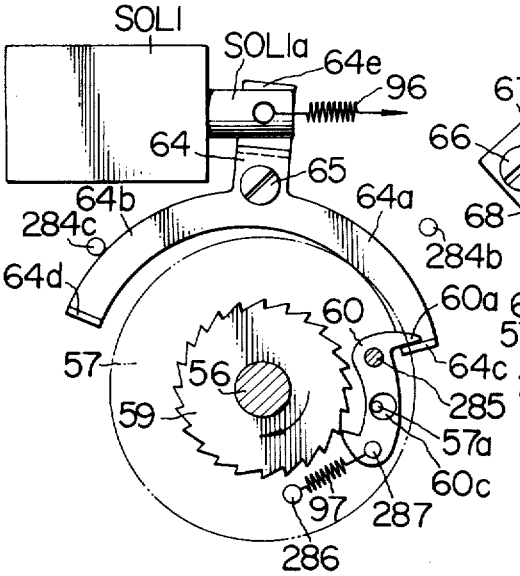
FIG. 57 is a front view of a forward rotation clutch comprising a ratchet wheel and a pawl member.

The clutch is switched by the operating link 64 which is displaced by the solenoid SOL1 and by a blocking plate 67, both shown in FIG. 55. The operating link 64 is disposed above the ratchet wheel 59 and is pivotally mounted on the stud 65 above a plate **284*a* which is mounted by means of four axles 284 (see FIG. 56) fixedly mounted on the stationary plate 272. The operating link 64 has the pair of curved arms 64*a* and 64*b* while lie over the ratchet wheel 59, the extremities 64*c* and 64*d* of the arms 64*a* and 64*b* being bent in a direction toward the gear 57. Directly above the pivot for the operating link 64, a branch link 64*e* extends therefrom in a rearward direction to be pulled by the solenoid SOL1. The ratchet wheel 59 fixedly mounted on the drive shaft 56 is formed with serrated teeth which are inclined in the clockwise direction as shown in FIG. 57, and is engaged by the pawl member 60. The pawl member 60 is rockably mounted on the gear 57 at pivot 285 and is formed with a pawl 60*b* which extends in the clockwise direction. A circular opening 60*c* is formed in the pawl 60*b* intermediate its length and is engaged by a pin 57*a* fixedly mounted on the gear 57 to limit the extent of the rockable motion of the pawl member 60. The tension spring 97 extends between a pin 286 fixedly mounted on the gear 57 and a pin 287 fixedly mounted on the pawl 60b of the pawl member 60 to urge the pawl member 60 to rotate clockwise about the pivot 285 so as to engage the pawl 60*b* with the ratchet wheel 59. However, such rotation is normally prevented by the engagement of the projection 60*a* extending from the pawl member 60 with the extremity 64*c* of the operating link 64. However, when the solenoid SOL1 is energized, the branch link 64*e* is pulled by the solenoid SOL1 to cause the operating link 64 to rock counterclockwise about the axle 65, whereby the extremity 64*c* is disengaged from the projection 60*a*. As noted in connection with FIG. 57, the plunger SOL1a of the solenoid SOL1 is pulled by the return spring 96. The extent through which the operating link 64 rocks is limited by a pair of stops 284*b* and 284*c* fixedly mounted on the plate 284*a* (see FIG. 56**).

Figure 58:
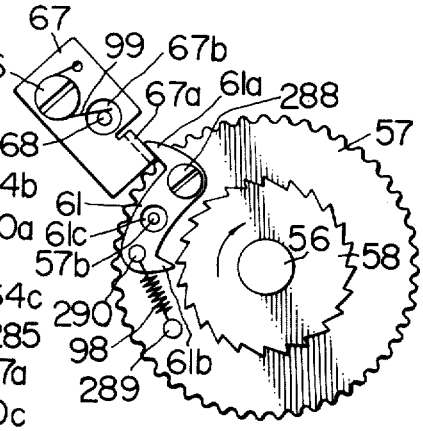
FIG. 58 is a front view of a reverse rotation clutch similarly comprising a ratchet wheel and a pawl member.

As shown in FIG. 58, the ratchet wheel 58 fixedly mounted on the drive shaft 56 is formed with serrated teeth which extend in the counterclockwise directon in a manner symmetrical to the ratchet wheel 59, and is adapted to be engaged by the pawl member 61. The pawl member 61 is pivotally mounted on the gear 57 at pivot 288, and is formed with a pawl **61*b* in its free end portion which extends in the counterclockwise direction. A circular opening 61*c* is formed in this free end portin and is engaged by a pin 57*b* fixedly mounted on the gear 57 to limit the extent of rocking motion of the pawl member 61. The tension spring 98 extends between a pin 289 fixedly mounted on the gear 57 and a pin 290 fixedly mounted on the free end portion of the pawl member 61 to urge the pawl member 61 to rotate counterclockwise about the pivot 288 so as to cause the pawl 61*b* to abut against the ratchet wheel 58. However, when the ratchet wheel 58 rotates in the clockwise direction, the rotation of the ratchet wheel 58 is not transmitted to the pawl member 61. The blocking plate 67 is located adjacent a projection 61a extending from the pawl member 61. The blocking plate 67 is pivotally mounted at the axle 66 on a stationary side plate 291 (See FIG. 56) which is mounted on the stationary plate 272, and is formed with a folded piece 67*a* at its free end. A small opening 67*b* for Vernier motion is formed in the free end portion, and the pin 68 fixedly mounted on the stationary side plate 291 extends into the opening 67*b*. A torsion spring 99 extends around the pin 68 and the blocking plate 67, and urges the blocking plate 67 to rotate counterclockwise about the axle 66. However, such rotation is prevented by the abutment of the edge of the opening 67*b* against the pin 68. The blocking plate 67 is rockable only through an extent which is limited by the abutment of part of the inner periphery of the opening 67*b* against the pin 68. The purpose is to maintain an accurate position for termination of the movement when the movable unit 15 returns. In this manner, the rotative force from the drive shaft 56 is transmitted to the gear 57 through the ratchet wheel 59 and when the gear 57 has rotated clockwise, as viewed in FIGS. 12, 55 and 57, through its one revolution, the movable unit 15 terminates its forward stroke, whereupon the rotative force from the drive shaft 56 is transmitted to the gear 57 through the ratchet wheel 58, and when the gear 57 has rotated counterclockwise through its one revolution, the movable unit 15** terminates its reverse stroke to return to its starting position. The above description covers the drive mechanism which reciprocates the movable unit 15 in the direction parallel to that in which the film runs.

Now the arrangement of the mechanism for moving the mounting plate 46 on which the movable unit 15 is slidably supported in the forward and reverse direction will be described.

Figure 59:
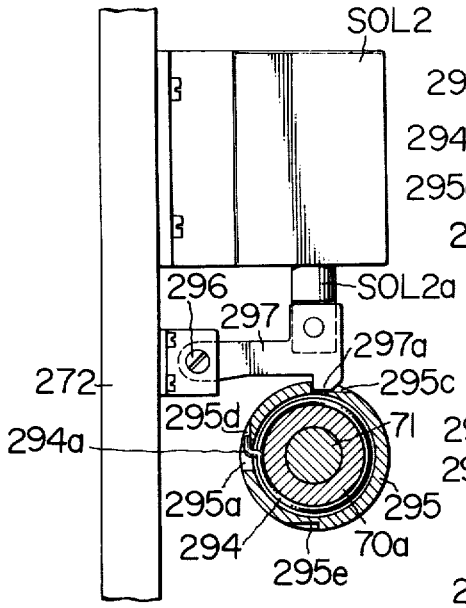
FIG. 59 is a cross section of a spring clutch.
Figure 60:
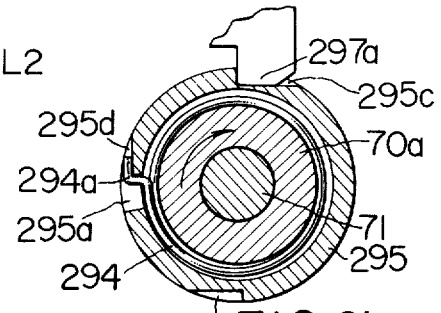
FIGS. 60 and 61 illustrates the operation of the spring clutch.
Figure 61:
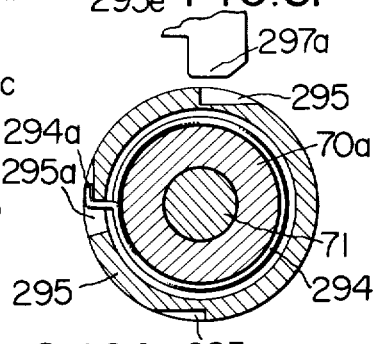

Referring to FIG. 54, the bevel gear 69 is mounted on the rear end (or the upper end as viewed in this Figure) of the drive shaft 56, with a one-way clutch interposed therebetween. The bevel gear 69 meshes with the bevel gear 70 which is fitted on the rotary shaft 71 extending in a horizontal direction and perpendicular to the drive shaft 56, with a locking ring 292 preventing an axial movement of the bevel gear along this shaft. The rotary shaft 71 is rotatably carried by bearing members 298, 299, and 300 which are fixed on the stationary plate 272. The rotative force transmitted from the bevel gear 69 to the bevel gear 70 is transmitted through a spring clutch to the rotary shaft 71. The bevel gear 70 is integrally formed around a hollow shaft 70*a* which is loosely fitted on the rotary shaft 71, and a hollow shaft 298 which is fixedly mounted on the rotary shaft 71 is disposed in juxtaposition with the hollow shaft 70*a*. A coiled spring 294 is wound around the outer periphery of the hollow shafts 293 and 70*a*, with its one end fitted into a tubular body 293 which is loosely fitted over the coil, as shown in FIG. 59. Specifically, the tubular body 295 is formed with a small opening 295*a* into which one end 294*a* of the coiled spring 294 is inserted. The coiled spring 294 tends to tie itself around the hollow shafts 70*a* and 293 (see FIG. 54), but such tendency is resisted by the abutment of the end 294*a* thereof against the wall 295*d* of the opening 295*a*. The tubular body 295 is formed with a pair of diametrically opposite notches 295*c* and 295*e* in its outer periphery, and one of the notches, 295*c*, is engaged by a finger 297*a* of a latch member 297 which is pivotally mounted on the stationary plate 272 at pivot 296. The latch member 297 has its free end attached to the plunger SOL2*a* of the solenoid SOL2 which is mounted on the stationary plate 272, and when the solenoid SOL2 is energized, its plunger SOL2*a* is pulled upward to rock the latch member counterclockwise about the pivot 296, thereby disengaging the finger 297*a* from the notch 295*c* (see FIG. 61). In this manner, the tubular body 295 is prevented from rotating as a result of the engagement between the notch 295*c* and the finger 297*a* (see FIG. 60), but when the finger 297*a* is disengaged from the notch 296*c*, the tubular body 295 is freed, so that the coiled spring 294 can tie itself around the hollow shafts 70*a* and 293 to transmit the rotative force from the bevel gear 70 to the rotary shaft 71 through the hollow shaft 293. In this manner, a spring clutch is formed.

On the opposite ends of the rotary shaft 71 which extend outwardly beyond the bearing members 299 and 300 are secured the pulleys 72 and 73, below which are disposed the other pulleys 74 and 86 (see FIG. 12), which are fixedly mounted on the shaft 76 and 91, which are in turn rotatably carried by bearing members 301 and 302, respectively. The timing belt 75 extends around the pulleys 72 and 74, while the timing belt 89 extends around the pulleys 73 and 86. The shaft 76 carries another pulley 77 fixed thereon, and the shaft 91 carries another pulley 87 fixed thereon. The timing belt 79 extends around the pulleys 77 and 78, while the timing belt 90 extends arond the pulleys 87 and 88. The pulley 78 is fixedly mounted on the axle 80 which is rotatably carried by a bearing member 305 which is in turn fixed on the stationary plate 272 on its side facing the mounting plate 46. Similarly, the pulley 88 is fixedly mounted on the axle 92 which is rotatably carried by a bearing member 306 which is in turn secured on the stationary plate 272 on its side facing the mounting plate 46. The axles 80 and 92 have secured thereto the cam discs 81 and 93 which push the rollers 82 and 83 forwardly. As mentioned previously, both cam discs 81 and 93 are formed with bulging portions 81*a* and 93*a*, respectively, which push the rollers 82 and 83 forwardly. It will be noted in FIG. 56 that in extending around the pulleys 77 and 78, and pulleys 87 and 88, the timing belts 79 and 90 extend through the stationary plate 272 (see FIG. 56).

As indicated in FIG. 56, the pair of pins 94 and 95 are fixedly mounted on one end face of the pulley 72 adjacent its periphery at diametrically opposite positions. The microswitch 59 is disposed in the path of rotation of the pins 94 and 95 to be depressed thereby for operation. The drive mechanism for the movable unit 15 is constructed as described above, and its operation is described below. However, because its operation has been generally dealt with previously, the description to follow will be limited to the operation of essential parts.

Figure 62:
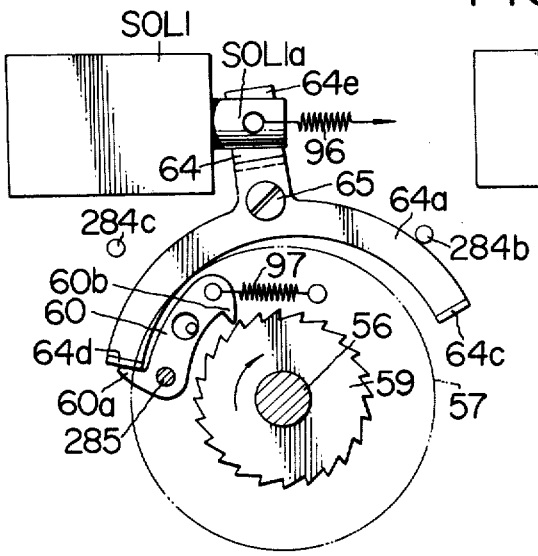
FIGS. 62 and 62A are front views illustrating the manner of the operation of the forward rotation clutch shown in FIG. 57.

When the motor M1 is energized, the drive pulley 54 rotates clockwise (see FIG. 12), whereby the drive shaft 56 also rotates. As the drive shaft 56 rotates, the ratchet wheels 58 and 59 as well as the bevel gear 70 rotate clockwise, but remain without effect because the solenoids SOL1 and SOL2 are not operated. When the photographing switch SP (see FIG. 10) is depressed, the solenoid SOL1 is energized, whereby its plunger SOL1*a* pulls the branch link 64*e* inward against the resilience of the spring 96, whereby the operating link 64 rocks counterclockwise about the pivot 64, as shown in FIG. 62. Thereupon, the extremity 64*c* of the operating link is disengaged from the projection 60*a* of the pawl member 60, whereby the pawl member 60 is permitted to rotate clockwise about the pivot 285 under the resilience of the spring 97 to bring the pawl 60b into engagement with the ratchet wheel 59. When such engagement is made, the gear 57 is driven to rotate clockwise through the pawl member 60, thereby causing its meshing gear 62 (see FIG. 55) to rotate counterclockwise. As the gear 62 rotates counterclockwise, the pinion 51 also rotates counterclockwise to cause the rack 50 to move the movable unit 15 to the right, as viewed in FIG. 55, along the guide rods 47*a* and 47*b*. As the movable unit 15 moves in this manner, the charger 16 traverses the film surface located within the apertured frame 14, thereby charging the photosensitive film surface 5a by corona discharge. When the charger 16 has moved past the apertured frame, the gear 57 has rotated slightly in excess of ½ revolution, and the exposure window 17 is brought into alignment with the charged photosensitive surface. When the gear 57 has rotated to such position, the projection 60*a* abuts against the other extremity 64*d* of the operating link 64, whereby the pawl member 60 is rocked counterclockwise about the pivot 285 against the resilience of the spring 97 to thereby disengage the pawl 60b from the ratchet wheel 59. Thereupon, the transmission of rotative drive to the gear 57 is interrupted, whereby the movable unit 15 comes to a stop. This defines the exposure position. The shutter blade 22 is opened to permit an exposure through the focusing lens 21 and the exposure window 17. The exposure time is previously established by the timer T1, and when the timer T1 times out, the solenoid SOL1 becomes deenergized, whereby the plunger SOL1a is pulled back by the spring 96 to rock the operating link 64 clockwise about the pivot 65, thereby allowing it to return to the initial position.

When the gear 57 has started to rotate, the other pawl member 61 which is mounted thereon also rotates clockwise together with the rotation of the gear 57, but remains without effect since both the gear 57 and the ratchet wheel 58 rotate in the same direction substantially integrally. When the gear 57 has rotated slightly in excess of ½ revolution and stops at the exposure position shown in FIG. 62, the pawl member 61 also stops while engaging with the ratchet wheel 58, but allows the ratchet wheel 58 alone to rotate because the serrated teeth on the ratchet wheel 58 are oriented such that they remain free to move under the pawl member 61.

When the operating link 64 has returned to its initial position, the projection 60*a* is out of engagement with the extremity 64*d*, so that the pawl 60*b* again engages the ratchet wheel 59, whereby the rotative force from the drive shaft 56 is again transmitted to the gear 57 to cause the pinion 51 to rotate counterclockwise through the gear 62 to thereby move the movable unit 15 further to the right, as viewed in FIGS. 12 and 55, through the rack 50. After the gear 57 rotates further through its remaining ½ revolution to return to its starting position, the vessel 18 of developing solution on the movable unit 15 is brought into alignment with the optical axis 0 and is opposite to the exposed photosensitive surface within the apertured frame 14. Upon completion of one revolution of the gear 57, the projection 60*a* abuts against the extremity 64*c*, whereby the pawl member 60 is rocked counterclockwise about the pivot 285 against the resilience of the spring 97 to move the pawl 60*b* away from the ratchet wheel 59 as shown in FIG. 57 and to interrupt the transmission of the rotative force from the drive shaft 56 to the gear 57. Thereupon, the movable unit 15 comes to a stop at a position such that the vessel 18 is located opposite the exposed photosensitive film surface within the apertured frame 14.

Figures 63, 63A, 64:
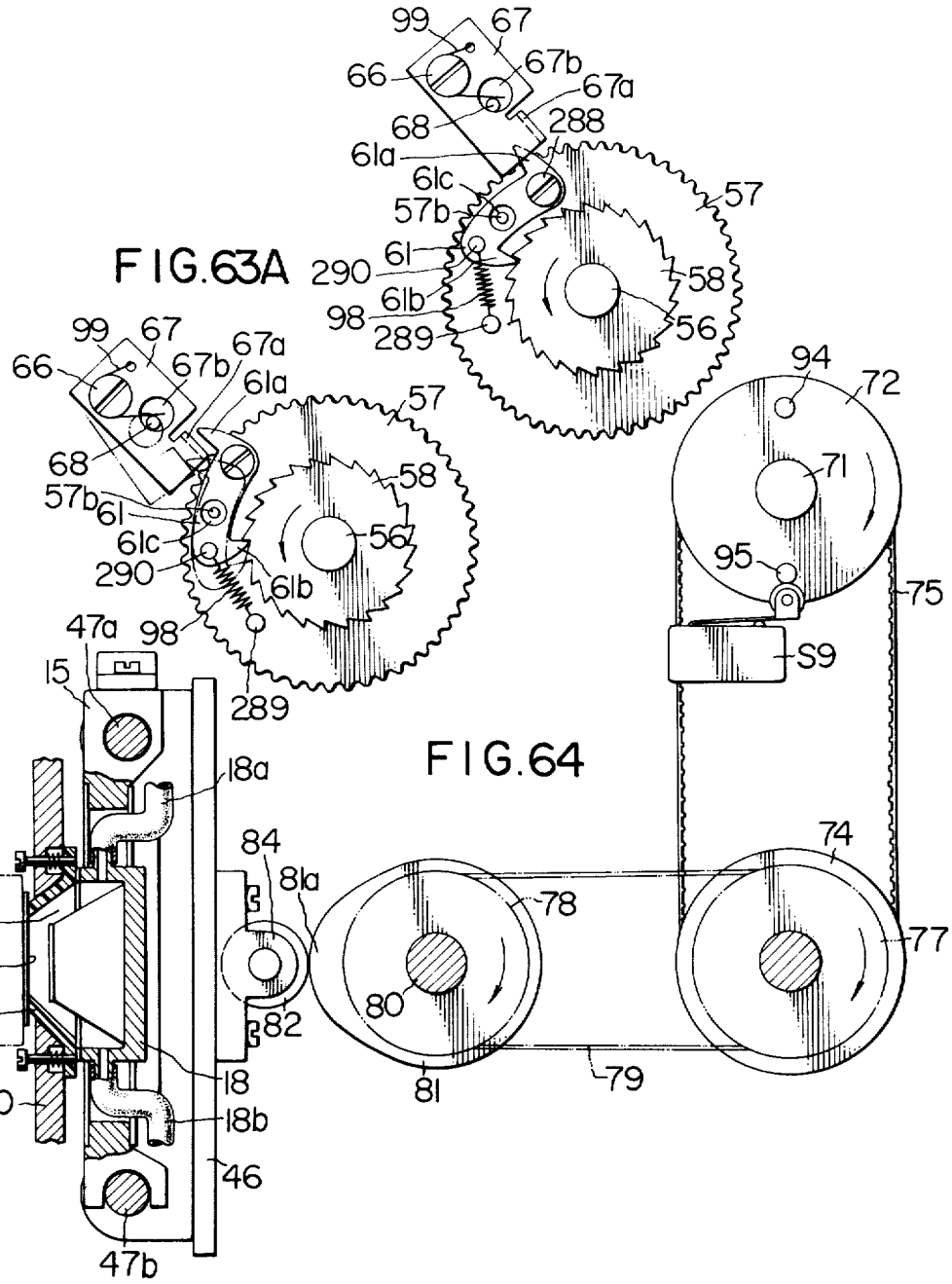
FIGS. 63 and 63A are front views illustrating the manner of operation of the reverse rotation clutch shown in FIG. 58.
FIG. 64 is an elevation of the mechanism for translating the movable unit in a direction toward and away from the pressure plate.

During the time the gear 57 rotates through its second ½ revolution, the other pawl member 61 mounted on the gear 57 rotates together with the gear 57 while maintaining its engaged position. When the gear 57 stops at the termination of the second ½ revolution, the pawl member 61 assumes the position shown in FIG. 63 in which the projection 61*a* is located inside the folded piece 67*a*.

When the vessel 18 is thus located on the optical axis and opposite the film within the apertured frame 14, the operating member 49 on the movable unit 15 depresses the microswitch S8 to open it. When the microswitch S8 is opened, the solenoid SOL2 is energized to pull its plunger SOL2*a*, whereby the latch member 297 shown in FIG. 59 rocks counterclockwise about the pivot 296 to disengage the finger 297*a* from the notch 295*c*. As a result, the tubular body 295 is freed, whereby the coil 294 in the spring clutch is tightened around the hollow shafts to transmit the rotative force from the drive shaft 56 through the bevel gears 69 and 70 and through the hollow shaft 293 to the rotary shaft 71. This transmission of the rotative force is effective to rotate the pulleys 74 and 86 clockwise through the pulleys 72 and 73 (see FIGS. 12 and 56), and the clockwise rotation of the pulleys 74 and 86 is transmitted to the pulleys 77 and 87, and thence through the pulleys 78 and 88 to the axles 80 and 92, thereby causing the cam discs 81 and 93 to rotate clockwise. As the cam discs 81 and 93 rotate, their bulging portions 81*a* and 93*a* act to push the rollers 82 and 83 forwardly,. This results in a movement of the mounting plate 46 toward the stationary wall 210 against the resilience of the springs 277 and 278 (see FIG. 54), thereby bringing the vessel 18 on the movable unit 15 into abutment against the apertured frame 14. The movement of the mounting plate 46 takes place for a maximum distance when the cam discs 81 and 93 have rotated one-half revolution, causing the apertured frame 14 to abut against the film surface on the pressure plate 13, thereby forming the developing chamber 240 with the vessel 18, the apertured frame 14 and the film surface 5*a*. When the cam discs 81 and 93 have rotated through ½ revolution, the pulley 72 also has rotated through ½ revolution, and one of pins, 94, provided thereon depresses the microswitch 59. By the time the cam discs 81 and 93 have rotated through the one-half revolution, a timer within an electrical circuit described later operates to deenergize the solenoid SOL2. The deenergization of the solenoid SOL2 results in the spring clutch returning to its inoperative position when the tubular body 295 has rotated through its ½ revolution to bring the notch 295*d* into alignment with the finger 297*a*, whereby the rotary shaft 71 ceases to rotate and the cam discs 81 and 93 stop at a position which they assume rotation through ½ revolution to maintain the formed developing chamber 240. When the switch 59 is operated by the pin 94, the solenoid SOL5 (see FIG. 45) is energized to initiate the supply of the developing solution DP into the developing chamber 240 through the supply inlet 18*a* and to operate the developing timer T2, thus commencing the developing step. Upon lapse of the developing period, a signal from the developing timer T2 activates the solenoid SOL6, whereby the developing solution within the developing chamber 240 is drained through the drainage port 18*b*, and thereafter the solenoid SOl2 is again energized. This renders the spring clutch operative again, whereby the rotative force from the drive shaft 56 rotates the rotary shaft 71 to cause the cam discs 81 and 93 to rotate through their second ½ revolution. During this rotation, the rollers 82 and 83 follow the cam surface of the cam discs 81 and 93 to move the mounting plate 46 away from the stationary wall 210 under the resilience of the springs 277 and 278 and back to its initial position. As the mounting plate 46 returns to its initial position, the switch 59 is now depressed by the other pin 95 on the pulley 72. Since the solenoid SOL2 is deenergized at this time, the transmission of the drive from the drive shaft 56 to the rotary shaft 71 is interrupted.

Figure 62A:
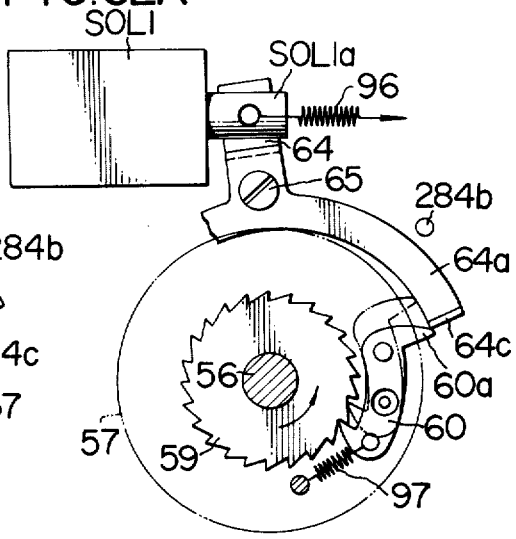

When the switch 59 is operated by the pin 95, the resulting signal switches the connection of the motor M1 for rotation in the reverse direction. As a result, the drive shaft 56 now starts to rotate in the reverse direction, whereby the ratchet wheels 58 and 59 as well as the bevel gear 69 rotate counterclockwise. The counterclockwise rotation of the ratchet wheel 58 causes the pawl member 61 (see FIG. 63) meshing therewith to rotate the gear 57 counterclockwise, whereby the gear 62 meshing therewith causes the pinion 51 to rotate clockwise. The clockwise rotation of the pinion 51 results in a movement of the rack 50 to the left, as viewed in FIGS. 12 and 54, thereby returning the movable unit 15. As the gear 57 rotates counterclockwise, the pawl member 60 engages the ratchet wheel 59 under the resilience of the spring 97, but remains without effect since both the gear 57 and the ratchet wheel 59 rotate in the same direction substantially as a unit. When the gear 57 has rotated through substantially one revolution to return to its starting position, the projection 60*a* then pushes up the extremity 64*c* as shown in FIG. 62A, causing the operating link 64 to rotate counterclockwise about the pivot 65 against the resilience of the spring 96 while moving past the extremity 64*c* as indicated in phantom lines. At the same time, the projection 61*a* on the other pawl member 61 moves the folded piece 67*a* of the blocking plate 67 angularly as indicated in phantom lines in FIG. 63A, thereby rocking the blocking plate 67 clockwise about the pivot 66 against the resilience of the spring 99.

When the movable unit 15 has overrun its starting position, it depresses the switch S10 (see FIG. 12). Thereupon, the motor M1 is switched to rotate in the forward direction. As a result, the clockwise rotation of the ratchet wheel 59 is again transmitted to the gear 57 through the pawl member 60, the projection 60*a* of which has moved past the extremity 64c as described in connection with FIG. 62A. However, this rotation is immediately interrupted since the projection 60*a* engages the extremity 64*c* to rock the pawl member 60 counterclockwise about the pivot 285 against the resilience of the spring 97 to thereby disengage it from the ratchet wheel 59. The position at which the rotation is interrupted corresponds to the starting position of the movable unit shown in FIG. 57. When the gear 57 returns a small distance in the clockwise direction, the pawl member 61 which presses against the blocking plate 67 is returned to the position shown in FIG. 58, whereby the movable unit 15 is returned from the overrun position to the normal starting position. This completes one reciprocatory movement of the movable unit 15. The depression of the switch S10 operates the timer T3 which determines the period of time during which drying air is supplied into the ventilation hole 27 to fix the developed photosensitive film.

The above covers the description of the essential operation of the drive mechanism for the movable unit 15. It will be seen that when either the exposure window or the vessel of developing solution are located on the optical axis 0, the movable unit 15 is momentarily stopped for the purpose of exposure and developing processings, respectively, and that the stops and the movement of the movable unit 15 take place automatically. Consequently, it is only necessary to depress the photographing switch SP in order to prepare one frame of a microphotograph, and no misalignment of the image field occurs because all of the electrophotographic processings take place on the optical axis 0.

Film feed drive mechanisms

Figure 65:
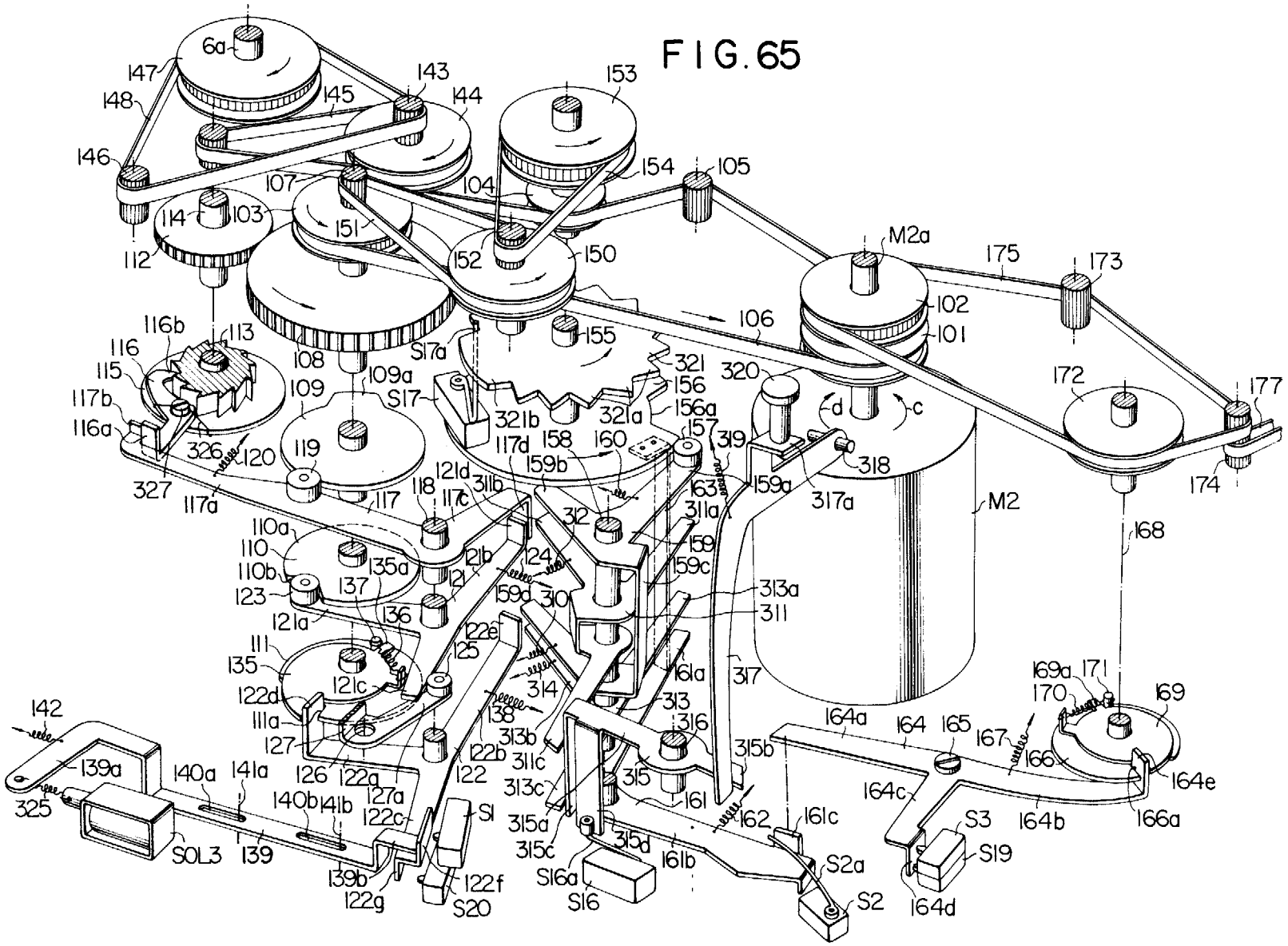
FIG. 65 is an enlarged perspective view of the film feeding mechanism.

The film feed drive mechanisms have been described in connection with FIG. 12 in the course of describing the general arrangement and operation of the system according to the invention. However, its principal parts are taken up in more detail here together with a detailed description of the three kinds of film feeding operations, namely, (1) automatic film loading mechanism, (2) proper film feed mechanism and (3) film idle feeding mechanism. FIG. 65 shows the film feed drive mechanism in an enlarged perspective view. As shown in this Figure, the rockable link 159 pivotally mounted on the axle 158 is formed with a folded piece 159c which is bent at a position adjacent the base region thereof to extend downwardly and parallel to the axle 158. At its remote end, the folded piece 159*c* is bent to extend horizontally to form a rockable arm 159*d* extending in the same direction as the arm 159*b* so as to be engageable with the folded piece 122*e*. The rockable arm 159*d* is fitted over the axle 158. A coiled tension spring 310 extends between the arm 159d and a stationary point to urge it to rock counterclockwise about the axle 158. However, such rocking is prevented by the abutment of the roller 157 on the arm 159*a* against the outer periphery of the notched disc 156. The rockable arm 159*d* is adapted to rock counterclockwise about the axle 158 under the resilience of the spring 310 when the roller 157 has fallen into the notch 156a to thereby engage the folded piece 122*e*, thereby preventing a returning motion of this folded piece and maintaining the three arm link 122 in its operative position.

A three arm link 311 adapted to rock when the film is to be withdrawn is disposed on the axle 158 at a position intermediate the upper and lower arms of the rockable link 159, it being understood that the link 311 is rotatable about the axle 158. The link 311 includes a first arm 311*a* which extends in the same direction as the arm 159*a*, and a second arm 311*b* which extends in the same direction as the other arm 159*b*. In addition, the link 311 includes a further arm 311*c* which extends in a direction opposite from the first arm 311a. The three arm link 311 is urged to rock counterclockwise about the axle 158 by a tension spring 312 which extends between the second arm 311*b* and a stationary point, but normally is prevented from such rocking by the abutment of the first arm 311*a* against the depending piece 163. Another three arm link 313 is rockably mounted on the axle 158 at a position below the rockable arm 159*d*, and includes a first arm 313*a* which extends in the same direction as the first arm 311*a* of the link 311, a second arm 313b which extends in the same direction as the rockable arm 159*d*, and a third arm 313*c* which extends in the same direction as the third arm 311*c* of the link 311. The link 313 is urged to rotate counterclockwise about the axle 158 by a tension spring 314 which extends between the second arm 313b and a stationary point. However, such rotation is prevented by the engagement of the first arm 313a with the depending piece 163.

The links 313 and 311 operate to disable the operation of one frame feeding mechanism when the film is idly fed by a distance corresponding to 27 frames when loading the film, as described later. The third arms 311*c* and 313*c* of the links 311 and 313 extend close to a folded piece 315*c* which is formed by bending in a downward direction from one arm 315*a* of a switch opening and closing link 315 which is pivotally mounted on an axle 316. On one lateral edge, the arm 315*a* is formed with a depending piece 315*d*, and a film loading microswitch S16 is disposed adjacent thereto. The switch S16 has its actuator S16*a* in abutment with the depending piece 315*d*. The opening and closing link 315 has another arm 315*b* which extends in a direction opposite from the arm 315*a* and which abuts against the free end of a pusher rod 317 which is pivotally mounted at its base region at a horizontal pivot 318. Normally, the pusher rod 317 is urged by a coiled tension spring 319 to rotate clockwise about the pivot 318. Along its upper edge toward the base region, the pusher rod 317 is formed with a folded piece 317*a* on which a pushbutton 320 is mounted. When loading the film, the depression of the pushbutton 320 subsequent to opening the lid 39*a* of the casing 39 to mount the roll film 5 therein results in an automatic withdrawal of the leader 5CO (see FIG. 16) from the film roll to permit the film to be tensioned in place.

Fixedly mounted on the rotary shaft 155 is a counting signal emitter disc 321 which is formed along its periphery with a succession of 12 angle-shaped protuberances 321*a* and an arc portion 321*b* which extends for an angle corresponding to two angle-shaped protuberances. A microswitch S17 has its actuator S17*a* located in abutment with the outer periphery of the emitter disc 321, and the arrangement is such that when the rotary shaft 155 has rotated through 1/14 of a revolution, the emitter disc 321 rotates through an angle corresponding to one angle-shaped protuberance to rock the actuator S17a, thereby closing the switch S17 and emitting a counting signal to a counter.

A microswitch S20 is disposed below the switch S1 which switches the direction of rotation of the film feeding motor M2, and a microswitch S19 is located below the microswitch S3. Both of these microswitches S19 and S20 serve to control the solenoid SOL10 which in turn controls the three-way valve V5. The switch S20 is adapted to be depressed by the folded piece 122*g* formed at the end of the third arm 122*c* of the three arm link 122, while the switch S19 is adapted to be depressed, together with the switch S3, by the upright piece 164*d* on the end of the third arm 164*c* of the three arm link 164. The remaining arrangement of FIG. 65 is the same as has been described in connection with FIG. 12, and is designated by like reference numerals, so that it is not described further herein. The film feed drive mechanism operates as follows:

1. Drive of the automatic film loading mechanism

Figure 66:
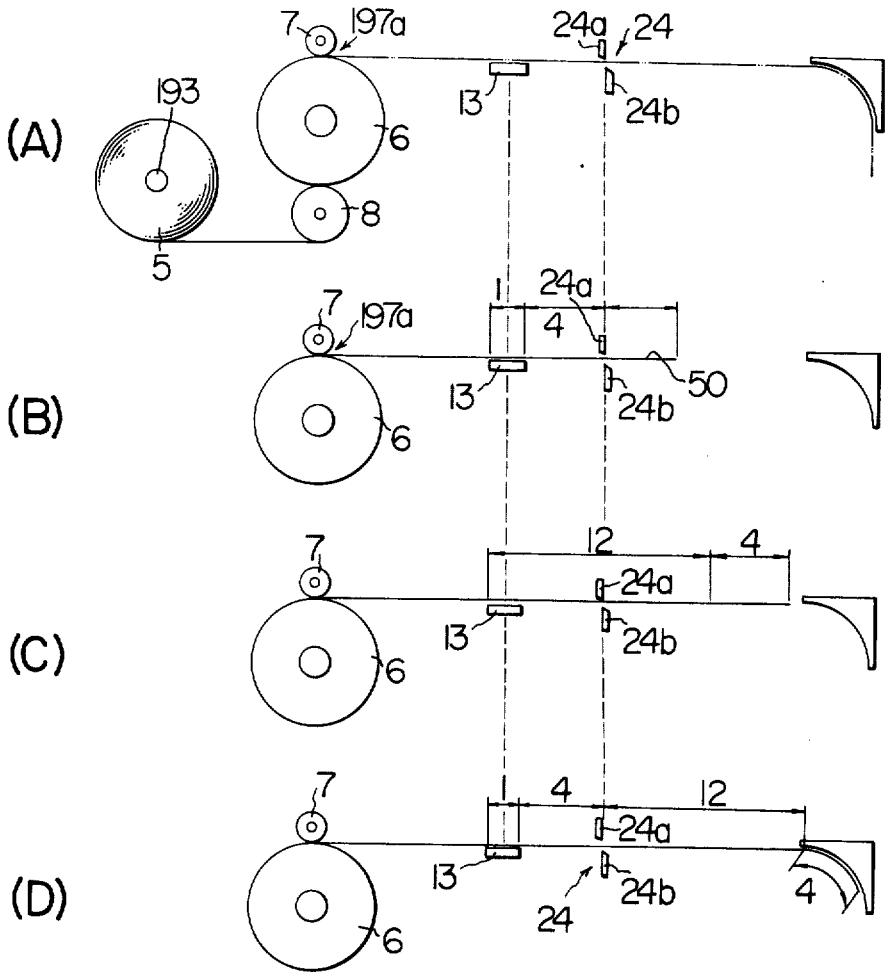
FIGS. 66(A) to (D) are diagrams illustrating the film feed operation.

This mechanism functions, when a roll of microfilm is initially loaded into the system, to withdraw the leader therefrom and to extend it around the transport drum 6, to pass it between the apertured frame 14 and the pressure plate 13 and thread it between the blades 24*a* and 24*b* of the cutter assembly 24 so that it can be fed into the conveying path formed by the timing belt 44, all in an automatic manner. During this process, a length of film corresponding to approximately 27 frames is fed. Specifically, referring to FIG. 66(A), the leader is withdrawn from the film roll 5 mounted on the axle 193 and is manually wrapped counterclockwise around one-half the periphery of the guide roller 8 and its leading end inserted into the space between the rollers 8 and 6, and then the pushbutton 320 (see FIG. 65) is depressed. Thereupon, the film is automatically wrapped clockwise around one-half the periphery of the transport drum 6, fed onto the pressure plate 13 through the film delivery port 197a defined between the guid roller 7 and the drum 6, passed over the pressure plate 13 to be threaded between the blades 24*a* and 25*b* of the cutter assembly 24 and is conveyed onto the timing belt 44. The length of the film which extends beyond the cutter assembly 24 into the conveying path is severed by the cutter assembly 24 as shown in FIG. 66(B), and is discharged externally of the system by the belt 44. Now, the film is extended and tensioned in its normal position.

First, the drive mechanism for idle feeding the film when the film is initially positioned in this manner is described immediately below. Referring to FIG. 65, when the pushbutton 320 is depressed, the pusher rod 317 rocks counterclockwise about the pivot 318 against the resilience of the spring 319, whereby the arm 315*b* of the switch opening and closing link 315 is rocked counterclockwise about the axle 316 to move its depending piece 315d against the actuator S16*a*, thus switching the switch S16. When this switch is operated, the solenoid SOL3 is energized to pull its plunger, so that the slide bar 139 is moved to the right against the resilience of the spring 142. This movement of the slide bar 139 results in its rear end 139*b* moving against the upright piece 122f, whereby the three arm link 122 rocks counterclockwise about the pivot 118 against the resilience of the spring 138. Thereupon, the upright piece 122*d* moves out of the notch 111*a*, thus allowing the cam disc 135 to rotate counterclockwise about the drive shaft 107 under the resilience of the spring 136, thereby closing the plane of the notch 111*a* and preventing the upright piece 122*d* from falling thereinto after it has once moved out of it.

The rocking motion of the upright piece 122*f* operates the switch S1, which as mentioned previously changes the direction of rotation of the film transport motor M2. The circuit connection with the motor M2 and the manner of switching of the switch S1 as well as the microswitches S2 and S3 are shown in FIGS. 67(A), (B), (C) and (D). Specifically, FIG. 67(A) shows the start position when the film roll 5 has been loaded. The switch S1 is changed to a reverse position S1b while the switch S3 remains open to prevent the energization of the motor M2. When the switch S1 is now pushed by the upright piece 122*f*, it is changed to a forward position S1a, whereby the motor M2 is energized, starting to rotate in the forward direction.

Figure 26:
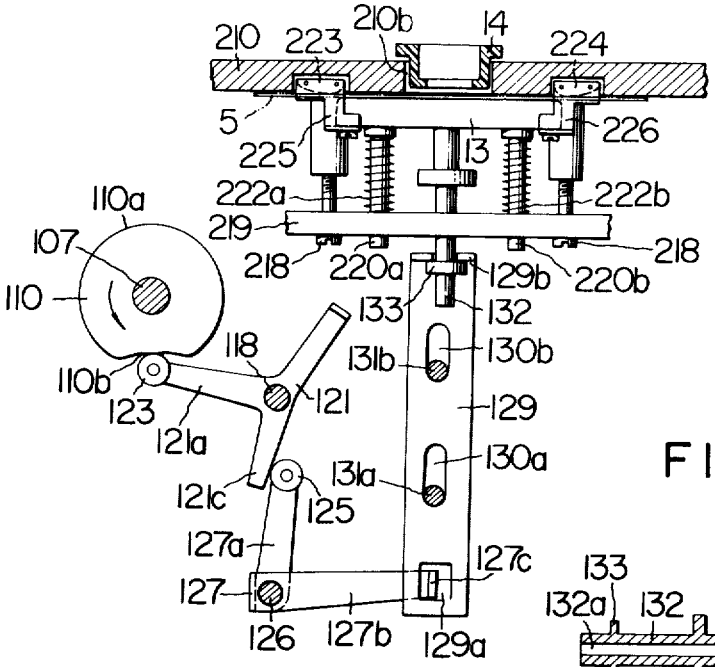
FIG. 26 is a plan view of the pressure plate drive mechanism.

When the motor M2 starts to rotate in the forward direction, its rotation is transmitted through the forward rotation pulley 101 to rotate the pulley 103, drive shaft 107, large diameter gear 108, cam disc 109, notched cam disc 110 and notched disc 111 in the counterclockwise direction. Thereafter, when the notched cam disc 110 has rotated through an angle which is in excess of one-eighth revolution, the roller 132 is moved out of the notch 110*b*, whereby the three arm link 121 is rocked counterclockwise about the axle 118 against the resilience of the spring 124 to move the roller 125 angularly with its third arm 121*c*. As a result, the rockable member 127 is rocked clockwise about the pivot 126 to cause a retraction of the sliding bar 129 (see FIGS. 12 and 26) and hence of the pressure plate 13. On the other hand, during the initial ¼ revolution of the drive shaft 107, the roller 119 merely abuts against the periphery of the disc 109, so that the pawl member 116 is not released from its constrained position.

Figure 69:
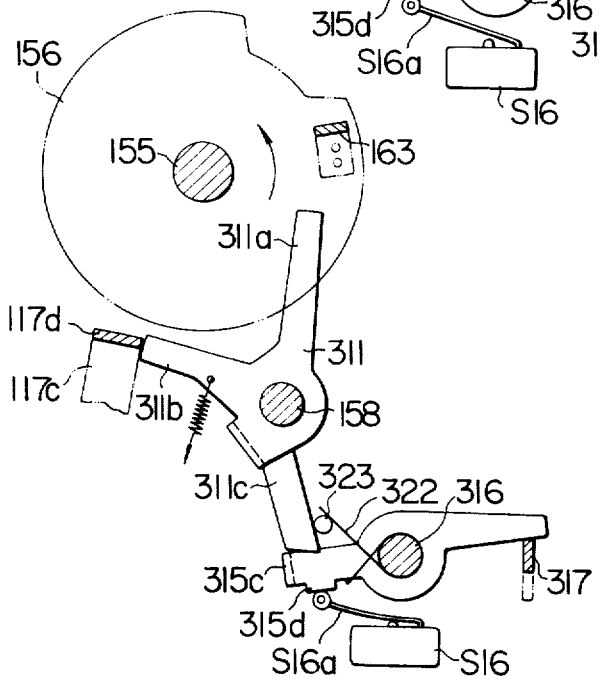

As a consequence, the small diameter gear 112 which meshes with the large diameter gear 108 merely undergoes a clockwise rotation about the axle 114 for ¼ revolution without feeding the film. When the drive shaft 107 has rotated through another one-eighth revolution, the projection 109*a* abuts against the roller 119 to move it, whereby the control lever 117 rocks counterclockwise about the axle 118 against the resilience of the spring 120 to disengage its upright piece 117*b* from the folded piece 116*a*, thus releasing the pawl member 116 from its constraint. This results in the engagement of the pawl member 116 with the ratchet wheel 113. Now the rotation of the small diameter gear 112 is transmitted through the disc 115 to the axle 114, causing it to rotate clockwise and driving the axle 6a of the drum 6 clockwise through the reduction unit which comprises the belt 145, pulley 144, belt 148 and pulley 147. The transport of the film commences as the axle 6a rotates, and the leader 5CO of the film begins to be fed in this manner. As the drive shaft 107 rotates, the rotary shaft 155 is rotated counterclockwise through the reduction unit comprising the belt 151, pulley 150 and belt 154, so that the notched disc 156 also rotates counterclockwise. As it rotates, the depending piece 163 moves to free the first arms 311a and 313a and the arm 161a which have been engaging therewith, and since the folded piece 315c has rocked, the three arm links 311 and 313 are rocked counterclockwise about the axle 158 under the resilience of the springs 312 and 314, respectively. When the link 311 rocks, its second arm 311b engages depending piece 117d and the folded piece 121d which are in their rocked position, thereby preventing the returning motion of the control lever 117 and the three arm link 121. More particularly, when the pushbutton 320 is depressed, the pressure rod 317 causes the opening and closing link 315 to rock counterclockwise about the axle 316 against the resilience of a spring 322, thereby operating the switch S16 with its depending piece 315d. The link 315 is normally urged by the torsion spring 322 to rock clockwise about the axle 316, but such rocking motion is prevented by a stop 323. The rocking of the link 315 about the axle 316 results in the disengagement of its folded piece 315c from the third arm 311c (see FIG. 69). However, because of the engagement between the first cam 311a with the depending piece 163, the three arm link 311 can not rock. If then the drive shaft 107 and the rotary shaft 155 commence to rotate, the depending piece 117d rocks counterclockwise and the notched disc 156 rotates counterclockwise whereby the first arm 311a is disengaged from the depending piece 163 to permit the three arm link 311 to rock about the axle 158 under the resilience of the spring 312 until its third arm 311c abuts against the stop 323, as shown in FIG. 69. In this position of the three arm link 311, its second arm 311b has moved into the path of rocking motion of the depending piece 117d, whereby the returning motion of the control lever 117 is prevented by the engagement between the second arm 311b and the depending piece 117d. Also the upright piece 121d of the three arm link 121 engages the second arm 311b, so that the returning motion of the link 121 is also prevented.

When freed by the movement of the depending piece 163, the three arm link 313 also rocks counterclockwise about the pivot 158 under the resilience of the spring 314 until its third arm 313c abuts against the stop 323. In this position of the link 313, its second arm 313b has moved into the path of rocking motion of the folded piece 122e which has rocked, thereby preventing the returning motion of the three arm link 122. As a result, the three arm link 122 is maintained in its position in which its third arm 122c depresses the switches S1 and S20, and the control lever 117 is maintained in its position removed from the pawl member 116. Therefore, the rotation of the large diameter gear 108 is entirely transmitted to the drive axles 6a of the drum 6, thus transporting the film for a distance corresponding to two frames per 1 revolution of the large diameter gear 108.

Figures 70, 71, 72:
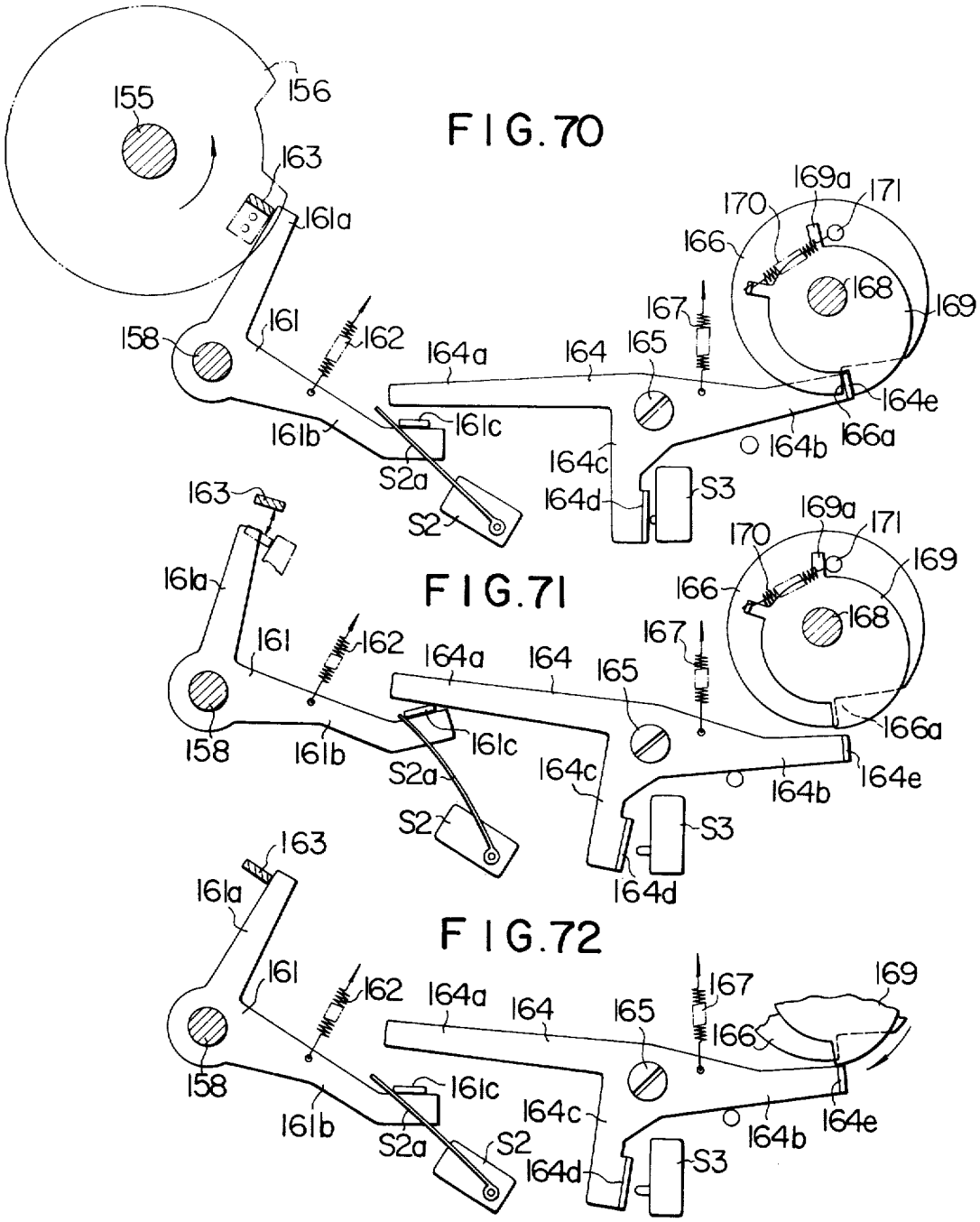
FIGS. 70 to 72 are plan views showing the operation of another three arm link and its associated rockable link.

When the arm 161a is disengaged from the depending piece 163, the rockable link 161 rocks around the axle 158. Its operation is depicted in FIGS. 70 to 72. Specifically, when the depending piece 163 moves to be disengaged from the arm 161a, the rockable link 161 rocks counterclockwise about the axle 158 under the resilience of the spring 162, whereby the folded piece 161c thereon pushes up the arm 164a of the three arm link 164 to cause it to rock clockwise about the pivot 165 under the resilience of the spring 167. As a consequence, the upright piece 164e moves out of the notch 166a, so that the cam disc 169 is permitted to rotate clockwise about the shaft 168 under the resilience of the spring 170 until the stop 169a thereon abuts against the pin 171. Such rotation of the cam disc 169 closes the plane of the notch 166a, whereby the upright piece 160e is prevented from returning into the notch. As the rockable link 161 rocks, the actuator S2a which abuts against the folded piece 161c follows the movement thereof to open the contacts of the switch S2 (see FIG. 71). As the link 164 rocks, the folded piece 164d on the third arm 164c moves away from the switches S3 and S19, whereby the switch S3 is closed and the switch S19 is changed. In this manner, the opening and closing condition of the switches S2 and S3 are interchanged, but since the change-over switch S1 is in its forward position S1a, the motor M2 continues to rotate in the forward direction irrespective of the switching of the switches S2 and S3.

Under this condition, the film leader continues to be fed, passing through the delivery port 197a onto the pressure plate 13 and then through the cutter assembly 24 onto the conveying path, as shown in FIG. 66(B). During such time, the counting signal emitter disc 321 rotates to repeat the opening and closing of the switch S17 with its angle-shaped protuberances 321a, thereby sequentially turning on and off the frame number indicator lamps L11 to L22. Toward the end of the completion of one revolution of the rotary shaft 155, the roller 157 falls into the recess 156a, whereby the rockable link 159 rocks counterclockwise about the axle 158 under the resilience of the spring 160. This results in its other arm 159b moving to a position over the second arm 311b which is already in its rocked position, thereby engaging with the depending piece 117d and the upright piece 121d. Also the rockable arm 159d moves under the resilience of the spring 310 to a position over the second arm 313b which is also in its rocked position, thereby engaging with the upright piece 122e. However, the rocking motion of these members remain without effect since the depending piece 117d and the upright pieces 121d and 122e are already constrained by the second arms 311b and 313b. The roller 157 falls into the notch 156a at the time the 23 frame has been fed. After the film is so fed for a distance corresponding to another four frames, the rotary shaft 155 reaches a position in which it completes a revolution. However, immediately before that, the depending piece 163 again engages the first arms 311a and 313a and the arm 161a, thereby moving them angularly. As a result, the three arm links 311 and 313 as well as the rockable link 161 rock clockwise about the axle 158 against the resilience of the springs 312 and 314 and 162, respectively, thereby returning to their original position. When the three arm links 311 and 313 return and the switch opening and closing link 315 is returned to its initial position, the engagement between the second arm 311b on one hand and the depending piece 117d and the upright piece 121d on the other hand is broken. However, because the other arm 159b still engage these pieces 117d and 121d, the latter is not released from constraint. The release of the engagement between the upright piece 122*e* and the second arm 313*b* does not release the upright piece 122*e* from constraint, because the latter is engaged by the rockable arm 159*d*. When the rockable link 161 rocks clockwise, the upright piece 161*c* also rotates clockwise to move the actuator S2*a*, thereby closing the switch S2 which has been open. The closure of this switch changes the motor circuit as shown in FIG. 67(C). Under this condition, when the twenty-seventh frame has been fed, the roller 157 is moved out of the notch 156*a*, whereby the rockable link 159 returns by a clockwise rocking motion about the axle 158 against the resilience of the springs 160 and 310, thus terminating the engagement between its other arm 159*b* and the depending piece 117*d* and the upright piece 121*d*. When the depending piece 117*d* is freed, the control lever 117 can rotate clockwise about the axle 118 since the cam disc 109 has its portion of smaller diameter located opposite to the foller 119. The upright piece 117*b* moves into the path of rotation of the pawl member 116, and when the upright piece 116*a* engages the upright piece 117*b* as the small diameter gear 112 rotates, the engagement between the pawl member 116 and the ratchet wheel 113 is broken. Thereupon, the transmission of the rotative force from the drive shaft 107 to the drum axle 6*a* is interrupted, and the film feeding operation is interrupted. At this time, the drive shaft 107 assumes a position in which it has rotated through three-fourths of a revolution. When the engagement between the upright piece 121*d* and the arm 159*b* is released, the three arm link 121 is in a condition capable of rocking clockwise about the axle 18 under the resilience of the spring 124, but the roller 123 still abuts against a portion of the cam disc 110 having an increased diameter, so that the link 121 is maintained in its position. Subsequent to the interruption of the film feeding operation, the roller 123 falls into the notch 110*b* in the notched cam disc 110, whereby the three arm link 121 rocks to its original position. The third arm 121*c* of the link 121 rocks clockwise, and the roller 125 follows this motion to cause a counterclockwise rocking motion of the rockable link 127 about the pivot 126, whereby the pressure plate 13 is advanced to its normal position.

When the engagement between the upright piece 122*e* and the rockable arm 159*d* is released, the three arm link 122 is capable of rocking clockwise about the axle 118 under the resilience of the spring 138, but such clockwise rocking is prevented because of its abutment against the periphery of the notched disc 111. When the advancement of the pressure plate mentioned above has been determined, the folded piece 122*d* initially abuts against the leading edge of the cam disc 135, clearing the notch 111*a* and falling thereinto. A relatively large stroke through which the link 122 rocks clockwise moves the upright piece 122*f* away from the switches S1 and S20, whereby the switch S1 is changed to the reverse position S1b as shown in FIG. 67(D).

When the switch S1 is changed, the motor M2 commences to rotate in the reverse direction. The motor drives the reverse rotation pulley 102, which in turn rotates the shaft 168 counterclockwise through the belt 175. As the motor M2 commences to rotate in the reverse direction, the cutter assembly 24 is immediately operated by interlocking with the reverse drive, thereby severing the film leader portion 50 which extends beyond the cutter assembly 24 on the conveying path, as shown in FIG. 66(B). The severed leader portion 50 is conveyed on the timing belt 44 (see FIG. 12) to the exterior of the system. The timing belt 44 is driven for the time interval during which the pulley 172 rotates through its one revolution. Specifically, when the shaft 168 rotates through one revolution together with the pulley 172, the notched disc 166 also undergoes one revolution, whereby the edge of the cam disc 169 abuts against the upright piece 164*e*, and when the notch 166*a* is cleared, the upright piece 164*e* falls thereinto to thereby rock the three arm link 164 counterclockwise about the axle 165 under the resilience of the spring 167, whereby the folded piece 164*d* moves away from the switches S3 and S19 to open them. The opening of these switches interrupts the energization of the motor M2 as shown in FIG. 67(E), so that the motor M2 is stopped, and the film leader is now completely positioned in place and tensioned between the delivery port 197*a* and the cutter assembly 24, as shown in FIG. 66(B).

2. Drive for the proper film feed mechanism

The drive for the proper film feed mechanism has already been described in connection with the general arrangement of the system according to the invention with reference to FIG. 12, and therefore only essential parts thereof will be described here. It will be recalled that the film is fed by this mechanism by a distance of one frame for each completion of the electrophotographic processing cycle applied thereto and that after the film has been fed in this manner for a length corresponding to 12 frames, an idle film feeding occurs for a length corresponding to 4 frames. As mentioned previously, the reason for providing an idle feeding of 4 frames is because the distance between the pressure plate 13 and the cutter assembly 24 in the system shown corresponds to a length of 4 frames of the film, as shown in FIG. 66(B). When the 12th frame is positioned on the pressure plate 13, the boundary between the seventh and eighth frames is located between the blades 24*a* and 24*b* of the cutter assembly 24, as shown in FIG. 66(C). If the film is severed subsequent to one frame transport after the 12th frame has been processed, the film will be severed at a position corresponding to the boundary between the eighth and nineth frames. To avoid this, the system of the invention is constructed such that an idle feeding of further four frames occurs subsequent to the intermittent film transport over 12 frames so that the trailing edge of the 12th frame be severed by the cutter assembly. By providing an idle feeding for a length corresponding to 4 frames as shown in FIG. 66(D), it is assured that the 12 frames to which the electrophotographic processings have been completed are located in the conveying path beyond the cutter assembly 24 so that when the cutter assembly 24 operates, a film sheet 5A including 12 frames in succession is obtained without severing the film at an intermediate position. Thus, the film sheet 5A comprises 16 frames, 12 frames of which are subjected to electrophotographic processing.

Figure 73:
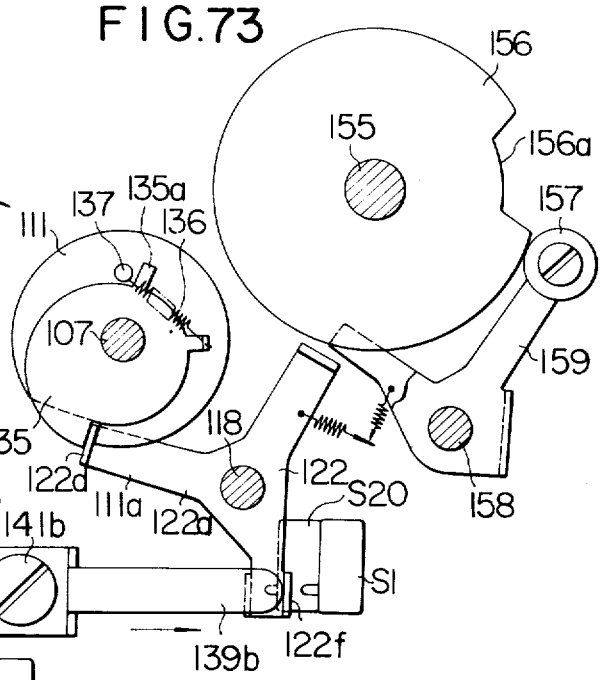
FIG. 73 is a plan view showing the transmission mechanism for transmitting the film feeding drive.
Figure 74:
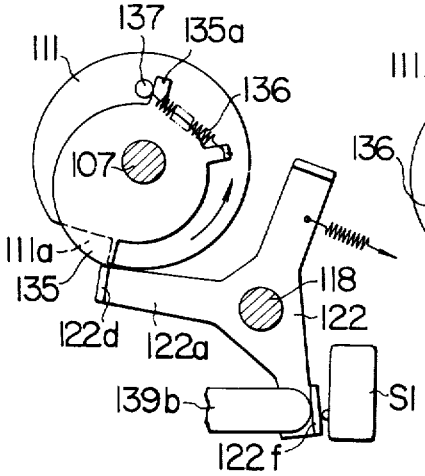

The intermittent film feed for a length corresponding to one frame is automatically initiated by a signal produced when the movable unit 15 has completed its one cycle of electrophotographic processing steps and the drying timer T3 has timed out. Specifically, when this signal is produced, the solenoid SOL3 is energized. As shown in FIGS. 65 and 73, the solenoid SOL3, when energized, acts to pull the slide bar 139 to the right through the spring 325. When the slide bar 139 slides to the right, its other end 139*b* presses against the upright piece 122*f*, thereby rocking the three arm link 122 counterclockwise about the axle 118 to cause the upright piece 122*d* to move out of the notch 111*a* and thus allowing the plane of the notch 111*a* to be closed by the cam disc 135, as shown in FIG. 74. When the notch 111*a* is closed, the switch S1 remains in its forward position S1*a* even though the energization of the solenoid SOL3 may be interrupted subsequently. This causes the motor M2 to rotate in the forward direction (see FIG. 67(F)).

Figure 82:
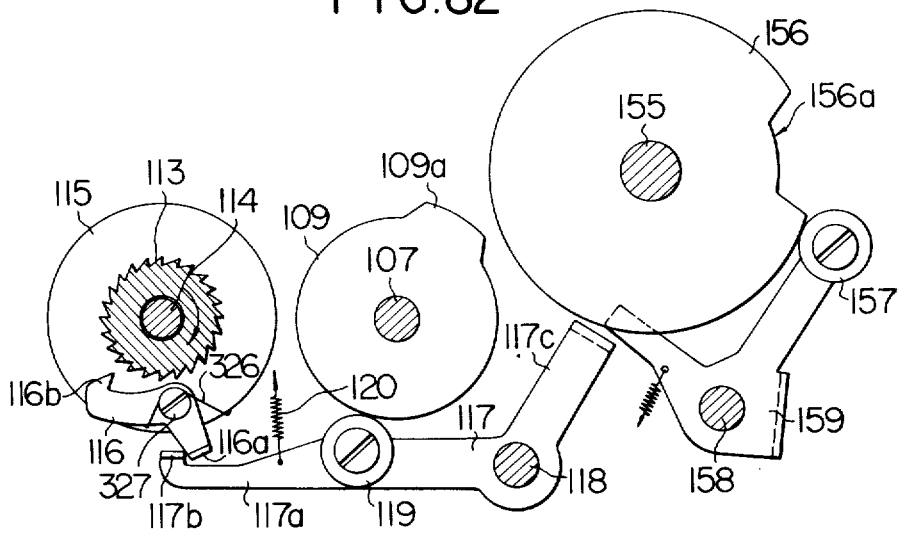
FIGS. 82 to 84 illustrate the operation of a clutch operating mechanism contained in the drive transmission mechanism.
Figure 83:
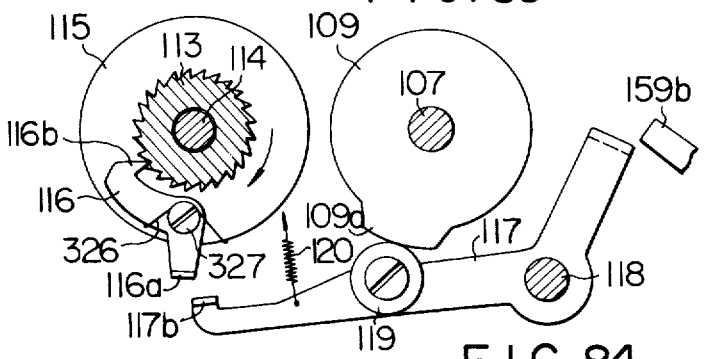

When the motor M2 commences to rotate in the forward direction, the drive shaft 107 rotates counterclockwise, and the cam disc 109 and the large diameter gear 108 as well as the notched cam disc 110 also rotate counterclockwise. However, during the time when the drive shaft 107 rotates through ¼ revolution, the rotative force therefrom is not effective to drive the axle 6*a* of the drum. Specifically, the manner of transmission of the rotative force from the drive shaft 107 to the axle 114 is illustrated in FIGS. 82 and 83. As shown in FIG. 82, until the drive shaft 107 has rotated through one-fourth revolution and the projection 109*a* abuts against the roller 119, the control lever 117 is maintained by the resilience of the spring 120 in its position to which it has rocked clockwise about the axle 118, so that the upright piece 117*b* on its one arm 117*a* maintains its engagement with the upright piece 116*a* of the pawl member 116, maintaining it rocked counterclockwise about its pivot 327 against the resilience of the spring 326 and thus holding the pawl 116*b* away from the ratchet wheel 113. However, when the drive shaft 107 has rotated through one-fourth revolution and the projection 109*a* moves the roller 119 as shown in FIG. 83, the control lever 117 is rocked counterclockwise about the axle 118 against the resilience of the spring 120, whereby the upright piece 117*d* is disengaged from the upright piece 116*a* to allow the pawl member 116 to rock clockwise about the pivot 327 under the resilience of the spring 326 to thereby enable the pawl 116*b* to mesh with the ratchet wheel 113 which is fixedly mounted on the small diameter gear 112. Thereupon, the disc 115 fixedly mounted on the axle 114 rotates together with the ratchet wheel 113, and then the axle 6*a* of the drum begins to rotate, thus feeding the film for a length corresponding to one frame. This operation takes place by a ½ revolution of the large diameter gear 108 which causes 1 revolution of the small diameter gear 112, the rotation of which is reduced to a 1/16 of a revolution of the drum 6. When the projection 109*a* moves past the roller 119, the latter returns to abut against the portion of the cam disc 109 having a reduced diameter as a result of the returning motion of the control lever 117, so that the upright piece 117*b* moves into the path of rotation of the upright piece 116*a*, and when the axle 114*a* has rotated through its 1 revolution, the upright piece 116*a* becomes engaged with the upright piece 117 *b* to thereby rock the pawl member 116 counterclockwise about the pivot 327, thus disengaging the pawl 116*b* from the ratchet wheel 133 and interrupting the transmission to the drum axle 6*a*. In this manner, 1 revolution of the large diameter gear 108 corresponds to 2 revolutions of the small diameter gear 112, and the rotation of the latter which corresponds to one revolution thereof during its intermediate stage is transmitted to the drum axle 6*a* to permit a film feeding by one frame.

Figure 75:
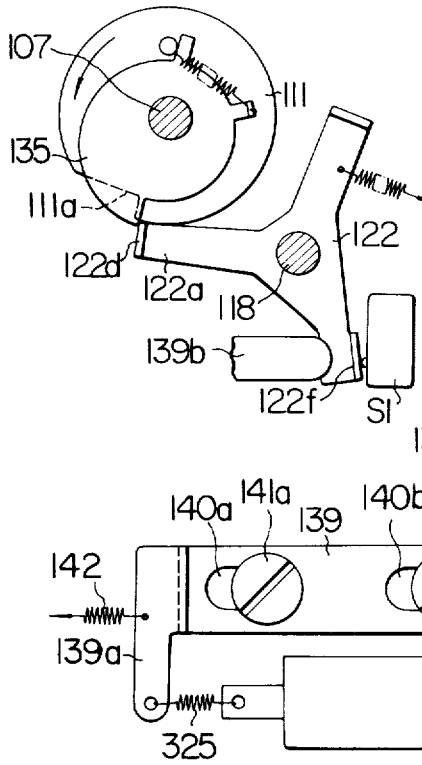
FIGS. 74 to 78 are similar views to FIG. 73, illustrating the operation of the transmission mechanism.

As indicated in FIG. 75, the upright piece 122*d* of the three arm link 122 abuts against the portion of the cam disc 135 having the largest diameter during one revolution of the drive shaft 107, whereupon the cam disc 135 comes to a standstill and only the disc 111 continues to rotate to clear the notch 111*a*, into which the upright piece moves, thereby returning the link 122 clockwise about its axle 118. By this time, the solenoid SOL3 is already deenergized, and therefore the slide bar 139 is returned to its original position under the resilience of the spring 142. As a result, when the three arm link 122 returns, the switch S1 is changed to its reverse position S1*b*, and the motor M2 stops. When the drive shaft 107 rotates through 1 revolution, the shaft 155 rotates through 1/14 revolution, so that the resulting movement of the depending piece 163 permits the first arms 311*a* and 313*a* as well as the arm 161*a* to be disengaged therefrom. Thus the three arm links 311 and 313 are freed, but are now constrained from rocking as a result of the abutment of their third arms 311*c* and 313*c* against the folded piece 315*c* of the switch opening and closing link 315 (see FIG. 65). However, the rockable link 161 rocks counterclockwise about the axle 158 under the resilience of the spring 162, so that the switch S2 is opened. By interlocking with the rockable arm 161, the three arm link 164 also rocks clockwise about the pivot 165, thereby closing the switch S3. As a result, the circuit connection made by the switches S2 and S3 is interchanged as shown in FIG. 67(F). When the drive shaft 107 has rotated through its 1 revolution to change the switch S1 to its reverse position S1*b* under this condition, the motor M2 is not driven in the reverse direction and stops because the switch S2 is open at this time as shown in FIG. 67(G).

Figure 84:
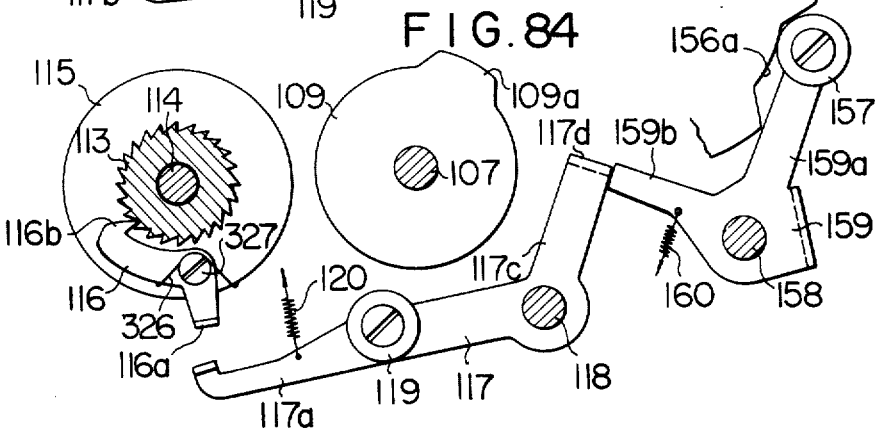

In this manner, the motor M2 repeats its rotating and stopped states to provide an intermittent feed of the film to which the electrophotographic processing cycles have been applied by a length corresponding to from 1 to 12 frames. When the film feed for the twelfth frame is initiated, the roller 157 falls into the notch 156*a* as shown in FIG. 84, so that the rockable link 159 rocks counterclockwise about the axle 158 under the resilience of the spring 160. As it rocks, its arm 159*b* engages the folded piece 117*d* on the arm 117*c* of the control lever 117 which now assumes a position rocked counterclockwise about the axle 118, thereby preventing the returning motion of the control lever 117. Such blocking action prevents the engagement between the pawl member 116 and the ratchet wheel 113 from being released when the drive shaft 107 has rotated through one revolution and the feed of the 12th frame has been completed, thus allowing the continued transmission of the rotative force from the drive shaft 107 to the shaft 114. This transmission of the rotative force continues all during the time when the roller 157 is in the notch 156*a* and until the roller 157 is moved out of the notch 156*a* as a result of the rotation of the disc 156. During such interval, the drive shaft 107 continuously rotates through two revolutions, and therefore the disc 156 rotates through 2/14 of a revolution. Since the rotative force from the large diameter gear 108 (see FIG. 65) is entirely transmitted to the shaft 114 through the small diameter gear 112 unless the engagement between the pawl member 116 and the ratchet wheel 113 is released, the shaft 114 rotates through two revolutions during one revolution of the large diameter gear 108, or the shaft 114 rotates through four revolutions during two continuous revolutions of the large diameter gear 108, so that the drum axle 6a is rotated through four-sixteenths of a revolution, thus achieving an idle film feeding of four frames in succession. It is noted that no electrophotographic processing cycles are applied to such four frames.

Figure 76:
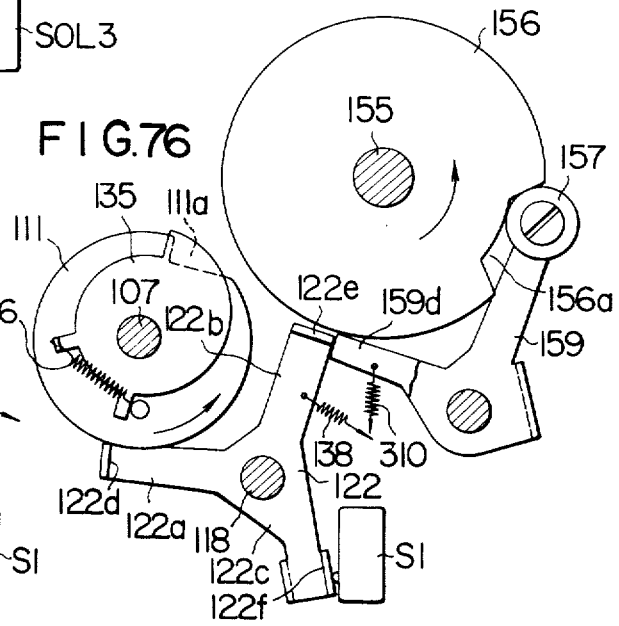
Figure 77:
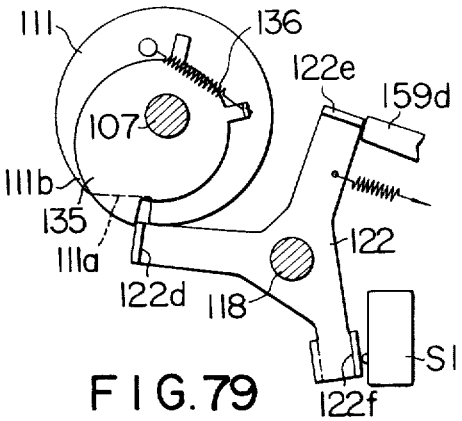
Figure 78:
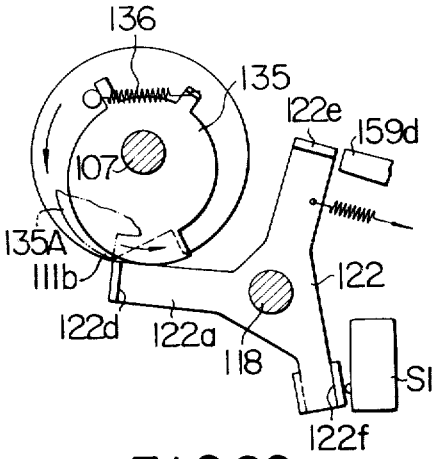

On the other hand, when the roller 157 falls into the notch 156a, the rockable arm 159d rocks counterclockwise to engage the upright piece 122e of the second arm 122b of the three arm link 122 which now assumes its rocked position, as indicated in FIG. 76, so that the returning motion of the link 122 is prevented and the switch S1 is maintained in its forward position S1a to which it has been switched by the upright piece 122f of the third arm 122c. As a consequence, during the time while the film is fed for the 12th to fifteenth frame, the motor circuit is connected as shown in FIG. 67(H) and stays energized. Also during such interval, the cam disc 135 and the disc 111 continue their idle rotation. In the system of the invention, a special arrangement is made to permit the idle rotation of the cam disc 135 and the disc 111 without interference by the upright piece 122d of the three arm link 122 which abuts against the periphery of the disc 111. Specifically, when the upright piece 122d moves out of the notch 111a, the cam disc 135 which is positioned over the disc 111 precedes the disc 111 in rotation and has a cam edge which is adapted to close the plane of the notch 111a, with the maximum diameter on the cam edge being slightly greater than the outer periphery of the disc 111 in order to permit the upright piece 122d to abut against the disc 135 when it has rotated through its one revolution. However, this results in a disadvantage as mentioned below when the three arm link 122 is constrained in its rocked position. That is, although the disc 111 and the cam disc 135 must undergo an idle rotation when the link 122 is constrained, as the cam disc 135 completes its 1 revolution, its maximum diameter portion will abut against the upright piece 122d as shown in FIG. 77 to thereby prevent further rotation of the cam disc 135, which is therefore prevented from continuing its idle rotation. To avoid such disadvantage, FIG. 78 shows that the trailing end 111b, as viewed in the direction of rotation, of the notch 111a in the disc 111 has a diameter which is slightly greater than the maximum diameter of the cam disc 135 and is also rounded. With this arrangement, as the portion of the cam disc 135 having the maximum diameter abuts against the upright piece 122d and is momentarily stopped as shown in chain lines 135A, only the disc 111 will continue to rotate, and though the notch 111a is cleared, after the notch 111a has moved past the upright piece, the trailing end 111b will move the upright piece 122d radially outward, whereby the cam disc 135 will resume its counterclockwise rotation immediately under the resilience of the spring 136, thus again closing the plane of the notch 111a. In this manner, the above mentioned disadvantage is eliminated and the idle rotation of the cam disc 135 and the disc 111 is assured. The momentary clearing of the notch 111a does not result in the upright piece 122d falling into the notch, because the returning motion of the three arm link 122 is prevented by the rockable arm 159d.

Figure 79:
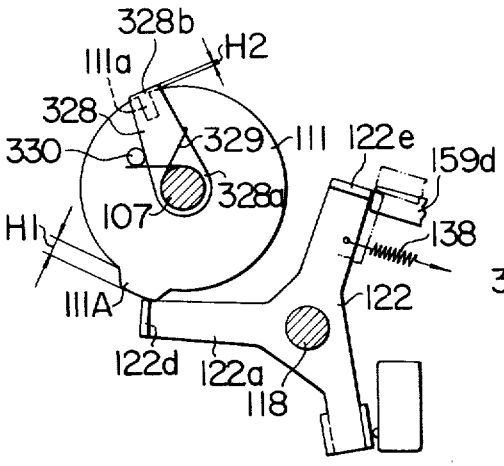
FIG. 79 is a plan view showing another example of the drive transmission mechanism.
Figure 80:
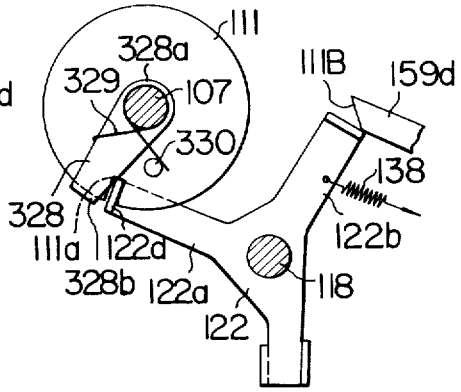
FIGS. 80 and 81 are plan views showing a further example of the drive transmission mechanism.
Figure 81:
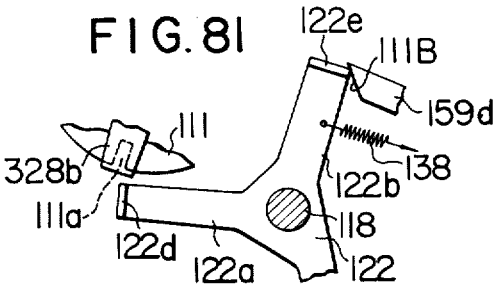

FIGS. 79 to 81 show other embodiments of the mechanism described above. In the embodiment shown in FIG. 79, the cam disc 135 is replaced by a rockable arm 328 which is pivotally mounted at 328a on the shaft 107 and which has its free end 328b extending slightly beyond the disc 111 radially. In addition, the disc 111 is formed with a projection 111A. Normally the rockable arm 328 closes the plane of the notch 111a, which is designed to allow the upright piece 122d to fall thereinto, by an arrangement including a torsion spring 329 and a stop pin 330 fixedly mounted on the disc 111. The projection 111A extends outwardly a distance H1 which is greater than the distance H2 by which the rockable arm 328 extends beyond the disc 111. With this arrangement, the idle rotation of the disc 111 and the rockable arm 328 can be achieved in that when the projection 111A moves the upright piece 122d radially outward to rock the three arm link 122 counterclockwise about the axle 118, the rockable arm 159d rocks to engage the upright piece 122e to thereby maintain the three arm link 122 in its rocked position in which its upright piece 122d is located outside the path of rotation of the rockable arm 328. In the alternative arrangement shown in FIGS. 80 and 81, the projection 111A shown in the embodiment of FIG. 79 is replaced by a bevelled edge 111B formed at the extremity of the rockable arm 159d, and when the latter has rocked counterclockwise, the upright piece 122e is moved by the bevelled edge 111B, whereby the three arm link 122 rocks about the axle 118 through a relatively large stroke to move the upright piece 122d out of the path of rotation of the rockable arm 328. This again allows the idle rotation of the disc 111 and the rockable arm 328.

Figure 67:
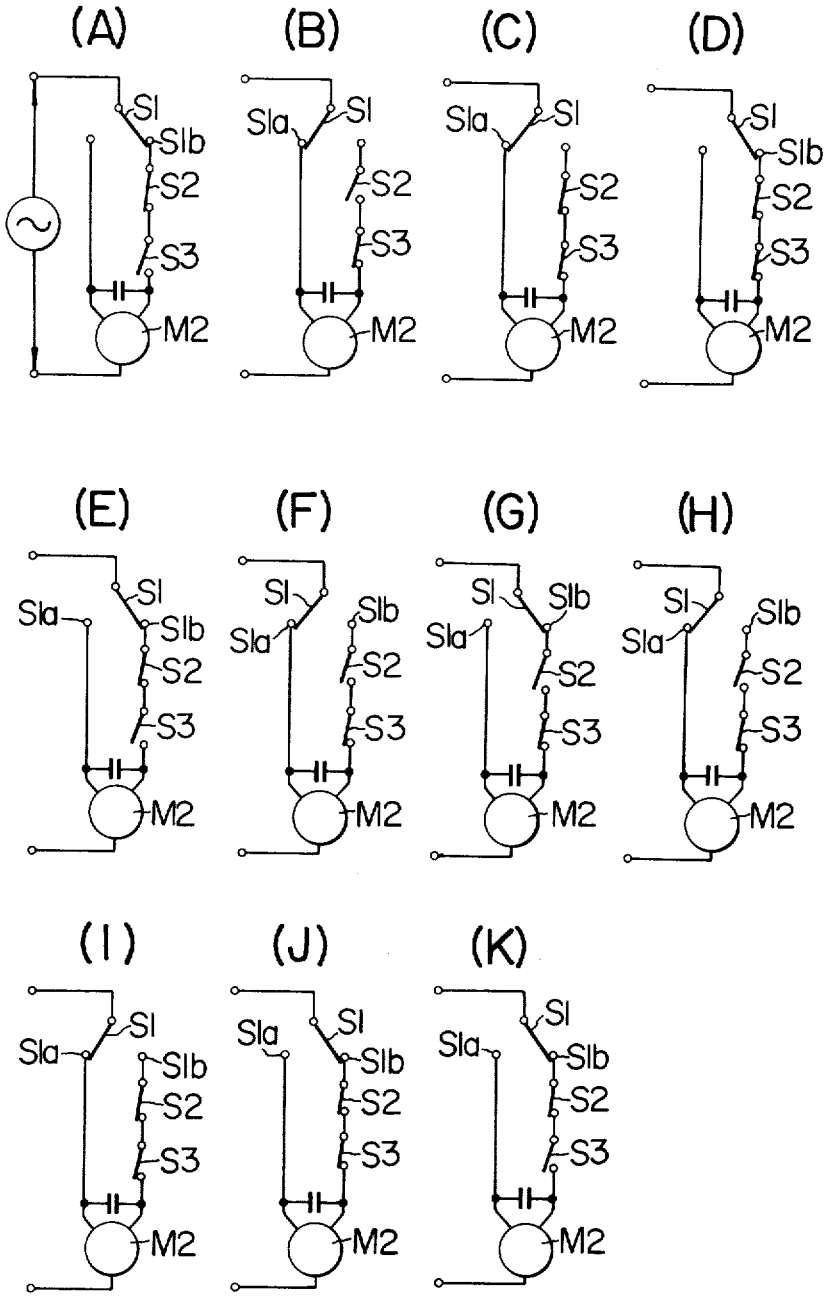
FIGS. 67(A) to (K) are diagrams showing the various positions of a switch in the film transport motor circuit.
Figure 68:
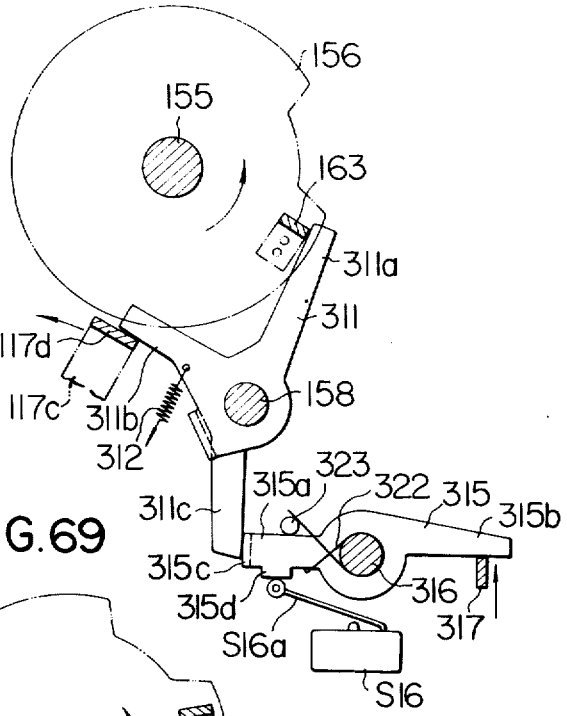
FIGS. 68 and 69 are plan views showing the operation of a switch operating link and its associated three arm link.

The above description has dealt with the idle film feeding by four frames. When the notched disc 156 has rotated through one revolution to cause the depending piece 163 to abut against and move the arm 161a, as shown in FIG. 65, the rockable link 161 is rocked clockwise about the axle 158, whereby the upright piece 161c closes the switch S2. Thereupon, the motor circuit is changed as shown in FIG. 27(L) and the switches S2 and S3 assume their closed position. At this time, the roller 157 is moved out of the notch 156a as shown in FIG. 65, so that the rockable link 159 returns clockwise about the axle 158, releasing the folded piece 117a and the upright piece 121d which has been applied by its other arm 159b and allowing the upright piece 117b to be moved into the path of rotation of the upright piece 116a. When the disc 115 has rotated such that the upright piece 116a engages the upright piece 117b, the pawl member 116 is rocked counterclockwise about the pivot 327, whereby the pawl member 116 is disengaged from the ratchet wheel 113 to interrupt the drive to the axle 6a and hence the film feed. The upright piece 122e is released from the constraint applied by the rockable arm 159d, so that the upright piece 122d can abut against the periphery of the disc 111, and subsequently abuts against the portion of the cam disc 135 having the maximum diameter to fall into the notch 111a, thus rocking the three arm link 122 clockwise about the axle 118. As it rocks, the movement of the upright piece 122f changes the switch S1 to its reverse position s1b. Thereupon, the motor circuit is switched as shown in FIG. 67(J), and because the switches S2 and S3 are closed, the motor M2 is driven for rotation in the reverse direction. This causes a rotation of the reverse rotation pulley 102 to operate the cutter assembly 24, thereby severing a 16 frame film sheet 5A from the remainder of the film. Since the conveying path is through the belt 175, the severed film sheet is discharged externally of the system. When the pulley 172 rotates through 1 revolution clockwise through the drive applied by the belt 175, the shaft 168 also rotates through one revolution to permit the upright piece **164*e* to fall into the notch 166*a* in the disc 166, so that the three arm link 164 rocks counterclockwise about the pivot 165, thereby opening the switch S3 and interrupting the drive of the motor M2 in the reverse direction. At this time, the motor circuit is connected as shown in FIG. 67(K), which is the same as the initial circuit connection (see FIG. 67**(A)).

3. Drive of the idle film feeding mechanism

The drive of this mechanism takes place by closing the spacing switch SC (see FIGS. 10 and 88A) which activates an electrical circuit described later to energize the solenoid SOL3 for a period required to complete the film feeding operation for the normal 12 consecutive frames. During such interval, the photographing switch SP is not depressed, so that the movable unit 15 remains stationary, and a signal is transmitted from a switch S17 only to a countermechanism. Thus, for frame 1 to frame 12, film feeding takes place by the normal intermittent feeding operation, while four subsequent frames are fed continuously. When the countermechanism has indicated the 12th frame, the solenoid SOL3 is deenergized. However, the film feed for four frames take place similarly to the normal procedure, because of the roller 157 falling into the notch **156*a*. When the film has been fed for a length corresponding to a total of 16 frames, the motor M2 is reversed to activate the cutter assembly 24 to thereby sever a 16 frame film sheet 5A** and to discharge the severed film sheet externally of the system along the conveying path. In this manner, all of the film feeding operations are effected by means of the single reversible motor M2 in the system of the invention.

Cutter assembly

Figure 85:
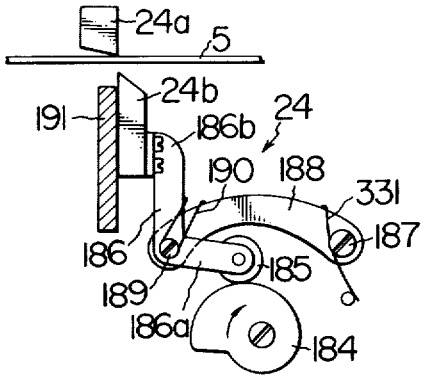
FIG. 85 is a plan view of a cutter assembly.
Figure 86:
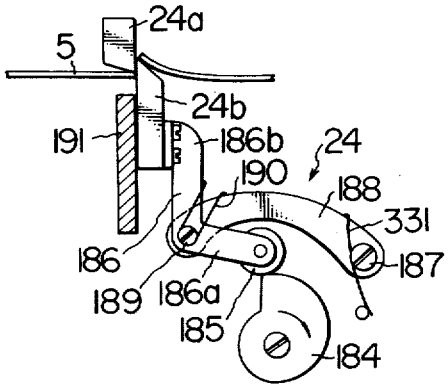
FIG. 86 illustrates the operation of the cutter assembly.

While the assembly 24 has been previously described in connection with FIG. 12, its operation will be more fully described below with reference to FIGS. 85 and 86 which are plan views of the assembly 24. As mentioned previously, the assembly 24 comprises the stationary blade **24*a* and the movable blade 24*b*, the stationary blade 24*a* being mounted on the side nearer the movable unit 15 and the movable blade 24*b* being mounted on the film feeding mechanism. The film 5 which is conveyed from the pressure plate 13 is adapted to pass between the blades 24*a* and 24*b*. The movable blade 24*b* is driven by the cam disc 184 which is mounted on the reverse rotation pulley 102 (see FIG. 12) which rotates when the motor M2 is driven in the reverse direction. As mentioned previously, the cam disc 184 is fixedly mounted on the reverse rotation pulley 102 through the hollow shaft 183, and has a cam edge abutting the roller 185 which is rotatably mounted on the end of the arm 186*a* of the bell crank-shaped rockable link 186. The rockable link 186 is pivotally mounted on the free end of the rockable link 188 by means of the pivot 189. The rockable link 188 is pivotally mounted on the pivot 187, and is urged to rock counterclockwise about the pivot 187 by a torsion spring 331 which is disposed along the pivot 187. As a result, the roller 185 is held abutting against the cam surface of the cam disc 184. The movable blade 24*b* is mounted on the end of the other arm 186*b* of the bell crank-shaped rockable link 186. The arm 186*b* and the rockable link 188 are urged to move away from each other by the torsion spring 190 which is disposed along the pivot 189 and which has its ends abutting against these members, whereby the movable blade 24*b* is held in abutment against the movable blade guide member 191. It is assumed that the resilience of the spring 190 is less than the resilience of the spring 331**.

The cutter assembly 24 operates during the initial phase of the rotation of the reverse rotation pulley 102. Specifically, as the pulley 102 rotates clockwise, the cam disc 184 also rotates clockwise to push the roller 185 upwardly, whereby the movable link 188 rocks clockwise about the pivot 187, and such rocking motion thereof is effective to move the movable blade **24*b* toward the stationary blade 24*a* as a result of the abutting engagement between the movable blade 24*b* and the guide member 191. As indicated in FIG. 86, such movement of the movable blade 24*b* results in its sliding contact with the stationary blade 24*a*, thereby severing the film which has passed therebetween. Immediately after the severing action has been effected, the roller 185 falls into the step formed in the cam surface of the disc 184, so that the rockable link 188 returns counterclockwise about the pivot 187 under the resilience of the spring 331**.

Electrical circuits

Figure 87:
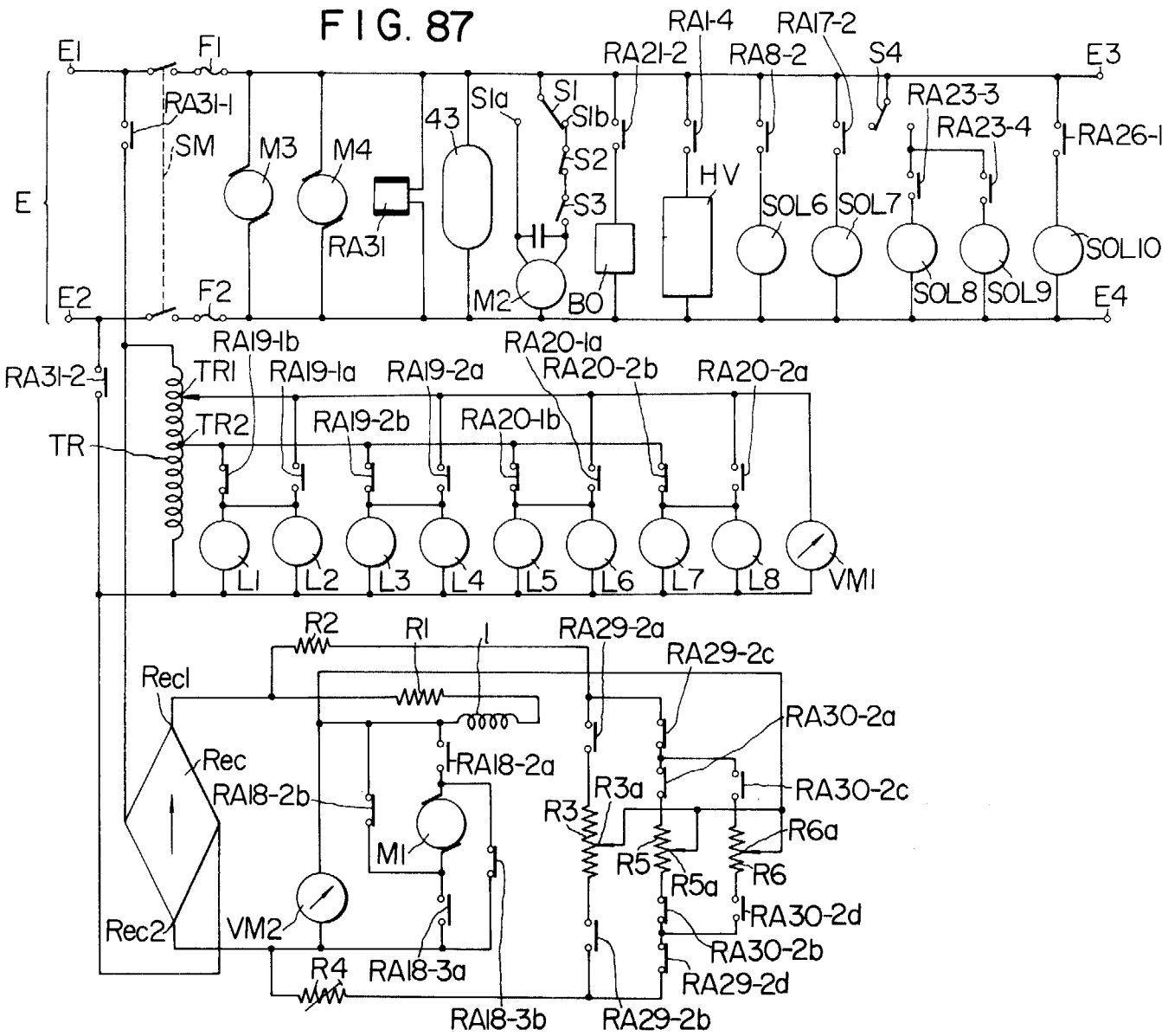
FIGS. 87, 88A and 88B are circuit diagrams illustrating an exemplary electrical circuit used in the system of the invention, FIG. 87 showing the principal circuit and FIGS. 88A and 88B illustrating its control system.

An example of the electrical circuits used in the system 31 will be described below with reference to FIGS. 87, 88A and 88B. FIG. 87 shows the principal electrical circuit of the system 31 according to the invention connected across the terminals E1 and E2 of an a.c. source in series with the main switch SM and fuses F1 and F2 are lamp cooling fan motors M3 and M4 (see FIG. 12) in parallel; relay coil RA31; air pump 43; the motor circuit including the forward and reverse rotation changeover switch S1, switches S2 and S3 and the film transport motor M2; buzzer BO connected in series with a normally open relay contact RA21-2; a high voltage generator HV for the charger connected in series with a normally open relay contact RA1-4; the solenoid SOL6 for operating the drainage control valve connected in series with a normally open relay contact RA8-2; solenoid SOL7 for operating the pressure reducing valve connected in series with a normally open relay contact RA17-2; developing solution metering switch S4 in series with a pair of series circuits including a series combination of a normally open relay contact RA23-3 and the solenoid SOL8 for operating the pressure increasing valve and a series combination of a normally open relay contact RA23-4 and the solenoid SOL9 for operating the liquid supply controlling valve respectively; and solenoid SOL10 for operating the suction valve connected in series with a normally open relay contact RA26-1. A transformer TR which controls the voltage supplied to the illumination lamps in connected through normally open relay contacts RA31-1 and RA31-2 across the terminals E1 and E2. The transformer TR comprises an auto-transformer having a slidable tap TR1 and a fixed tap TR2 which provides a lower voltage. Connected across the slidable tap TR1 and the a.c. source terminal E2 are the illumination lamps L1 and L2 in series with a normally open relay contact RA19-1*a*; illumination lamps L3 and L4 in series with a normally open relay contact RA19-2*a*; illumination lamps L5 and L6 in series with a normally open relay contact RA20-1*a*, and illumination lamps L7 and L8 in series with a normally open relay contact RA20-2*a*, respectively. Connected across the fixed tap TR2 and the source terminal E2 are the lamps L1 and L2 in series with a normally closed relay contact RA19-1*b*; lamps L3 and L4 in series with a normally closed relay contact RA19-2*b*; lamps L5 and L6 in series with a normally closed relay contact RA20-1*b*; and lamps L7 and L8 in series with a normally closed relay contact RA20-2*b*, respectively. The fixed tap TR2 provides a low voltage of about 30 volts for preheating the lamps L1 to L8. The slidable tap TR1 is adapted to provide a voltage in a range from 30 to 100 volts, which voltage is applied to the lamps L1 to L8 for exposure. The exposure voltage is indicated by a lamp voltage indicator VM1.

A rectifier circuit Rec is connected across the source E through the contacts RA31-1 and RA31-2. The motor M1 which drives the movable unit 15 is connected across the output terminals Rec1 and Rec2 of the rectifier circuit Rec. Specifically, the output terminal Rec1 is connected through a resistor R1, a field coil *l*, a normally open relay contact RA18-2*a*, the armature of the motor M1 and a normally open relay contact RA18-3*a* with the other output terminal Rec1. A normally closed relay contact RA18-2*b* is connected in shunt with the series circuit comprising the motor M1 and the contact RA18-2*a*. A normally closed relay contact RA18-3*b* is connected in shunt with the series circuit comprising the motor M1 and the contact RA18-3*a*. A speed control circuit for the motor M1 is connected across the output terminals Rec1 and Rec2. This circuit comprises a series circuit including a resistor R2, a normally open relay contact RA29-2*a*, a variable resistor R3, a normally open relay contact RA29-2*b* and a resistor R4 connected in series across the output terminals Rec1 and Rec2, and the series combination comprising the contact RA29-2*a*, the variable resistor R3 and the contact RA29-2*b* is shunted by a series circuits including normally closed contacts RA29-2*c* and RA30-2*a*, a variable resistor R5, and normally closed contacts RA30-2*b* and RA29-2*d*. The series combination comprising the contact RA30-2*a*, the variable resistor R5 and the contact RA30-2*d* is in turn shunted by a series circuit including a normally open contact RA30-2*c*, a variable resistor R6 and a normally open contact RA30-2*d*. Of the variable resistors R3, R5 and R6 connected in shunt with the motor M1, the variable resistor R6 serves controlling the charger voltage by controlling the speed with which the movable unit 15 runs from its starting position to its exposure position. By adjusting this variable resistor, the speed with which the charger 16 (see FIG. 12) traverses across the photosensitive film surface placed on the pressure plate 13 is controlled, thereby permitting the potential to which the photosensitive surface is charged to be controlled. The greater the speed, the lower the potential to which the photosensitive surface is charged, and vice versa. In this manner, the potential to which the photosensitive film surface is charged is controlled by changing the running speed of the charger rather than by control of the discharge voltage.

The variable resistor R5 controls the running speed of the movable unit 15 during its movement from the exposure position to the developing position, i.e., the movement of the vessel 18 of developing solution into abutment with the apertured frame 14 subsequent to the completion of exposure. The variable resistor R3 controls the speed with which the mounting plate 46 for the movable unit returns to its original position subsequent to the completion of the developing. A voltmeter VM2 is connected across the series circuit including the contact RA18-2*a*, motor M1 and the contact RA18-3*a*, and is also connected with the slidable taps R3*a*, R5*a* and R6*a* of the variable resistors R3, R5 and R6, respectively, thereby allowing the drive voltage of the motor M1 to be indicated by the meter VM2.

Figure 88A:
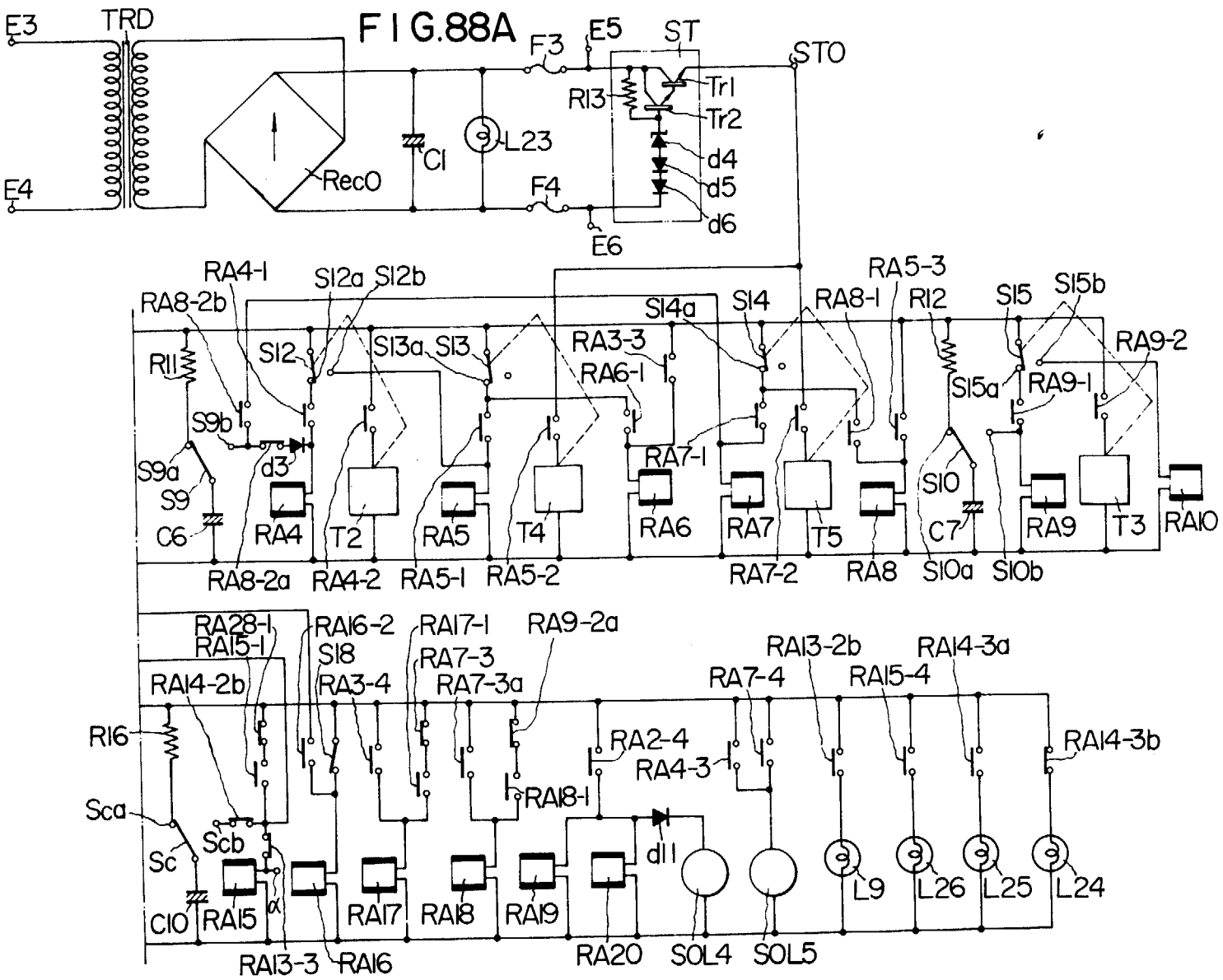
Figure 88B:
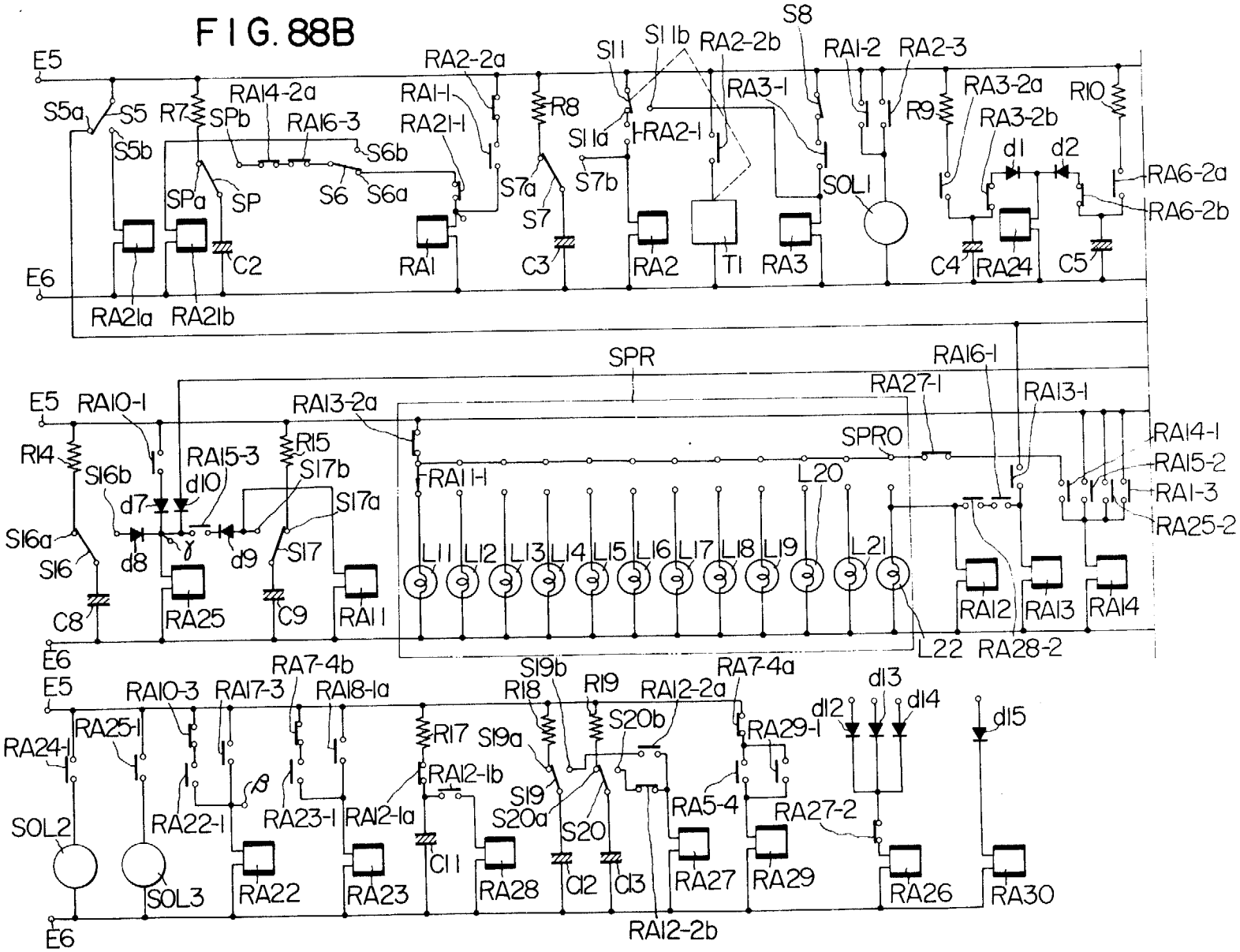

FIGS. 88A and 88B show the electrical circuits of the control system associated with the principal electrical circuit shown in FIG. 87. The electrical circuits in the control system operate on d.c. voltage. Specifically, the terminals E1 and E2 of the a.c. source E shown in FIG. 87 are connected through the main switch SM and fuses F1 and F2 with a pair of supply terminals E3 and E4, which are connected with the primary winding of a step-down transformer TRD shown in FIG. 88A. The secondary side of the transformer TRD is connected with a rectifier circuit Rec0, the output of which is smoothed by a smoothing capacitor C1 to provide a d.c. voltage of about 24 volts across a pair of d.c. terminals E5 and E6 though fuses F3 and F4.

As indicated in FIG. 88B, connected across the d.c. terminals E5 and E6 are a series circuit including a buzzer BO, a releasing change-over switch S5 and a reset relay coil RA21*a*; a series circuit including a resistor R7, photographing switch SP and a capacitor C2; a series circuit including a normally closed relay contact RA2-2*a*, a normally open relay contact RA1-1 and a relay coil RA1; a series circuit including a resistor R8, change-over switch S7 and a cpacitor C3; a series circuit including switch S11 for the timer T1, a normally open relay contact RA2-1 and a relay coil RA2; a series circuit including a normally open relay contact RA2-2*b* and the timer T1; a series circuit including a normally closed switch S8, a normally open relay contact RA3-1 and a relay coil RA3; a series circuit including a normally open relay contact RA1-2 and solenoid SOL1; a series circuit including a reistor R9, a normally open relay contact RA3-2*a* and a capacitor C4; a series circuit including a resistor R10, a normally open relay contact RA6-2*a* and a capacitor C5; and continuing to FIG. 88A, a series circuit including a resistor R11, change-over switch S9 and a capacitor C6; a series circuit including the change-over switch S12 for the timer T2, a normally open relay contact RA4-1 and a relay coil RA4; a series circuit including a normally open relay contact RA4-2 and timer T2; a series circuit including the change-over switch S13 for timing adjusting timer T4, a normally open relay contact RA5-1 and a relay coil RA5; a series circuit including a normally open relay contact RA3-3 and a relay coil RA6; a series circuit including changeover switch S14 for timing adjusting timer T5, a normally open relay contact RA7-1 and a relay coil RA7; a series circuit including a normally open relay contact RA5-3 and a relay coil RA8; a series circuit including a resistor R12, change-over switch S10 and a capacitor C7; a series circuit including the change-over switch S15 for the timer T3, a normally open relay contact RA9-1 and a relay coil RA9; and a series circuit including a normally open relay contact RA9-2 and timer T3.

The photographing switch SP is normally thrown to its position SP*a* to charge the capacitor C2, but is changed to its contact SP*b* when the photographic button is depressed to cause the capacitor to discharge through a series circuit including normally closed relay contacts RA14-2*a*, RA16-3, a pressure switch S6, a normally closed relay contact RA21-1 and the relay coil RA1. The pressure switch S6 is operated from its contact S6*a* to contact S6*b* when the pressure upon the pressure plate 13 does not reach a given value, allowing the capacitor C2 to discharge through a set relay coil RA21*b* to operate it upon switching the photographing switch SP. When the set relay coil RA21*b* is energized, the normally open relay contact RA21-2 (see FIG. 87) is closed to permit a current flow to the buzzer BO, thereby announcing that the film is not yet held attracted atainst the pressure plate 13. The relay RA21*b* is constructed to provide a mechanical self-holding action, which must be reset when the film is sucked against the pressure plate 13 since the pressure switch S6 is thrown to its contact S6*a* at this time. To reset such self-holding action, the switch S5 is thrown to its position S5*b* which is connected with the reset relay coil RA21*a*, thereby energizing the latter. The energization of the reset relay coil RA21*a* causes its contact RA21-2 to be opened and its contact RA21-1 to be closed, whereby the circuit is returned to its initial condition. The switch S7 is normally thrown to a position in which it is connected with the resistor R8 to charge the capacitor C3, but when the switch S7 is changed from its contact S7*a* to contact S7*b*, the capacitor C3 is discharged through the relay coil RA2.

The switch S11 is changed from its contacts S11*a* to S11*b* to permit the energization of the relay coil RA3 when the timer T1 times out. The normally open relay contact RA1-2 is shunted by a normally open relay contact RA2-3. The capacitor C4 is also connected through a normally closed relay contact RA3-2*b* and a diode d1 with a relay coil RA24, while the capacitor C5 is also connected through a normally closed relay contact RA6-2*b* and a diode d2 with the relay coil RA24.

The change-over switch S9 shown in FIG. 88A normally assumes a position in which it is connected with the resistor R11 to charge the capacitor C6, but when this switch is changed from its contact S9*a* to S9*b*, the capacitor C6 is discharged through a path including a normally closed relay contact RA8-2*a*, diode *d*3 and the relay coil RA4. The contact S9*b* is also connected through a normally open relay contact RA8-2*b* with the relay coil RA7, and when the contact RA8-2*a* is broken and the contact RA8-2*b* is closed, the capacitor C6 is discharged through the relay coil RA7.

The change-over switch S12 associated with the timer T2 is normally thrown to its contact S12*a*, but permits the relay coil RA5 to be energized when it is changed to the contact S12*b*. The switch S13 associated with the timer T4 is normally thrown to its contact S13*a*, but is opened when the timer T4 is operated. The contact S13*a* is also connected with a relay coil RA6 through a normally open relay contact RA6-1. The change-over switch S14 associated with the timer T5 is normally thrown to its contact S14*a*, which contact is also connected with the relay RA8 through a normally open relay contact RA8-1.

The change-over switch S10 is normally thrown to its contact S10*a* which is connected with the resistor R12, but when it is changed to the contact S10*b*, permits the charged capacitor C7 to discharge through the relay coil RA9. The timer switch S15 has a contact S15*a* in which it is connected in circuit with the relay coil RA9, and also another contact S15*b* which is connected with a relay coil RA10. In order to assure an accurate operation of the timers T4 and T5, they are energized by a voltage stabilizer ST which is connected across the terminals E5 and E6. The voltage stabilizer ST comprises transistors Tr1, Tr2, constant voltage diode *d*4, diodes *d*5 and *d*6 and resistor R13. Connected across the output terminal STO of the stabilizer and the terminal E6 aare the timer T4 in series with a normally open relay contact RA5-2, and also the timer T5 in series with a normally open relay contact RA7-2, respectively.

As indicated in FIG. 88B, across the d.c. terminals E5 and E6 are further connected a series circuit including a resistor R14, film loading change-over switch S16 and a capacitor C8; a series circuit including a normally open relay contact RA10-1, diode *d*7 and a relay coil RA25; a series circuit including a resistor R15, switch S17 for generating film frame counting signal, and a capacitor C9; a normally closed relay contact RA13-2*a* in series with a stepping relay circuit SPR; a series circuit including a normally open relay contact RA1-3 and a relay coil RA14; and further continuing to FIG. 88A, a series circuit including a resistor R16, spacing switch SC and a capacitor C10; a series circuit including a normally closed relay contact RA28-1, a normally open relay contact RA15-1, a normally closed relay contact RA13-3 and a relay coil RA15; a series circuit including switch S18 for detecting the presence of film remaining within the system and a relay coil RA16; a series circuit including a normally open relay contact RA3-4 and a relay coil RA17; a series circuit including a normally open relay contact RA7-3*a* and a relay coil RA18; a series circuit including a normally open relay contact RA2-4 and a relay coil RA19; a series circuit including a normally open relay contact RA4-3 and solenoid SOL5; a series circuit including a normally open relay contact RA13-2*b* and lamp L9 indicating the presence of film remaining in the system; a series circuit including a normally open relay contact RA15-4 and space feed indicator lamp L26; a series circuit including a normally open relay contact RA14-3*a* and indicator lamp L25 which indicates that no photographing can take place; and a series circuit including a normally closed relay contact RA14-3*b* and indicator lamp L24 which indicates that the system is ready to start photographing.

The film loading change-over switch S16 is normally thrown to its contact S16*a* in which it is connected with the resistor R14, but is changed to its contact S16*b* upon depression of the pushbutton 320 (see FIG. 65) when loading the film roll to thereby cause the charged capacitor C8 to discharge through the relay coil RA25. The switch S17 is normally thrown to its contact S17*a* in which it is connected with the resistor R15, but permits the charged capacitor C9 to discharge through a relay coil RA11 when it is changed to its contact S17*b*. Each time the switch S17 is changed in this manner, the relay coil RA11 is energized to have it s contact RA11-1 switched successively to thereby permit the frame number indicator lamps L11 to L22 to be turned on in turn through the normally closed relay contact RA13-2*a*. The contact S17*b* is connected with the relay coil RA25 through a diode d9 and a normally open relay contact RA15-3. The output end SPRO of the stepping relay SPR is connected with the relay coil RA14 through a normally closed relay contact RA27-1 and a normally open relay contact RA14-1. The normally open relay contact RA1-3 is shunted by normally open relay contacts RA25-2 and RA15-2, respectively. A relay coil RA12 is connected between the lamp L22 and the source terminal E6. A relay coil RA13 is connected between the contact S5*a* of the switch S5 and the source terminal E6 in series with a normally open relay contact RA13-1. The relay coils RA13 and RA12 are interconnected by way of normally open relay contacts RA28-2 and RA16-1.

Referring to FIG. 88A, the spacing switch SC is normally thrown to its contact SC*a* in which it is connected with the resistor R16, but permits the charge on the capacitor C10 to discharge through the relay coil RA15 in series with normally closed relay contacts RA14-2*b* and RA13-3 when it is changed to its contact SCb. The junction between the contact RA13-3 and the contact RA14-2*b* is connected through a diode d10 (see FIG. 88B) with the relay coil RA25. The junction between the switch S18 and the relay coil RA15 is connected through a normally open relay contact RA16-2 with the contact S5*a* of the switch S5. The contact RA3-4 is shunted by a series combination of a normally closed relay contact RA7-3 and a normally open relay contact RA17-1, and similarly the contact RA7-3*a* is shunted by a series combination of a normally closed relay contact RA9-2*a* and a normally open relay contact RA18-1. The relay coil RA19 is shunted by a relay coil RA20, across which a solenoid SOL4 for operating the shutter is connected through a diode d11. The contact RA4-3 is shunted by a normally open relay contact RA7-4.

As indicated in FIG. 88B, across the supply terminals E5 and E6 are additionally connected a series including a normally open relay contact RA24-1 and solenoid SOL2; a series circuit including a normally open relay contact RA25-1 and solenoid SOL3; a series circuit including a normally open relay contact RA17-3 and a relay coil RA22; a series circuit including a normally open relay contact RA18-1*a* and a relay coil RA23; a series circuit including a resistor R17, a normally closed relay contact RA12-1*a* and a capacitor C11; a series circuit including a resistor R18, change-over switch S19 and a capacitor C12; a series circuit including a resistor R19, change-over switch S20 and a capacitor C13; and a series circuit including a normally closed relay contact RA7-4*a*, a normally open relay contact RA5-4 and a relay coil RA29.

The normally open relay contact RA17-3 is shunted by a series combination of a normally closed relay contact RA10-3 and a normally open relay contact RA22-1, and similarly the contact RA18-1*a* is shunted by a series combination of a normally closed relay contact RA7-4*b* and a normally open relay contact RA23-1. In addition, the capacitor C11 is shunted by a path including a normally open relay contact RA12-1*b* and a relay coil RA28.

The switch S19 is normaly thrown to its contact S19*a* in which it is connected with the resistor R18, but permits the capacitor C12 to discharge through a path including a normally open relay contact RA12-2*a* and a relay coil RA27 when it is changed to its contact S19*b*. The switch S20 is normally thrown to its contact S20*a*, but permits the cpacitor C13 to discharge through a path including a normally closed relay contact RA12-2*b* and the relay coil RA27 when it is changed to its contact S20b. The normally open relay contact RA5-4 is shunted by a normally open relay contact RA29-1.

As further shown in FIGS. 88A, there is a terminal $\alpha$ connected with the junction between the normally closed relay contact RA13-3 and the relay coil RA15, and this terminal is connected through a diode d12 and a normally open relay contact RA27-2 with a relay coil RA26, as shown in FIG. 88B. This relay coil RA26 is also connected through the contact RA27-2 and a diode d13 with a terminal $\beta$ on the relay coil RA22, and also connected through the contact RA27-2 and a diode d14 with a terminal $\gamma$ on the relay coil RA25. There is a terminal $\delta$ connected with one end of the relay coil RA1, and this terminal is connected through a diode d15 with a relay coil RA30, the other end of which is connected with the source terminal E6.

Figure 89:
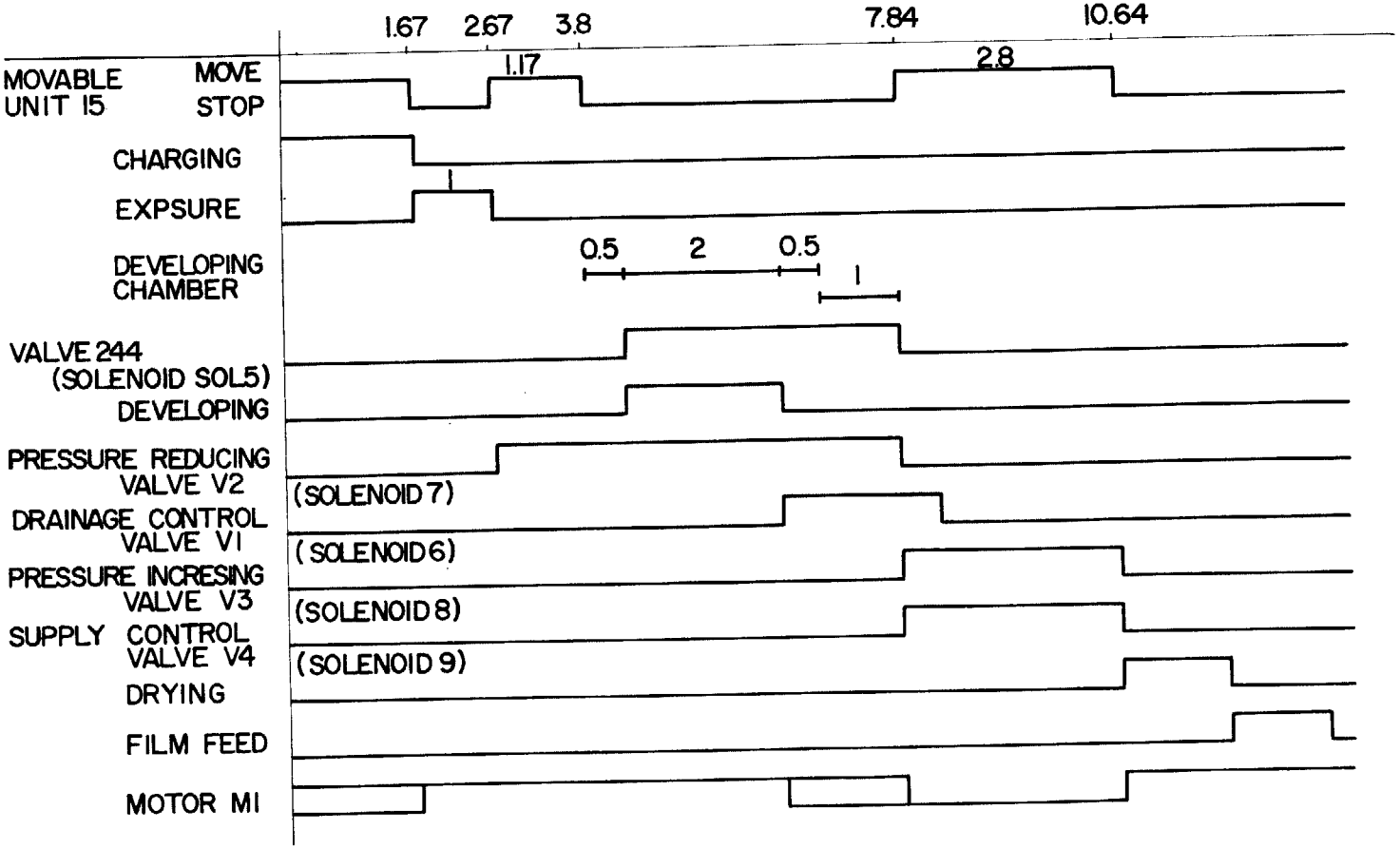
FIG. 89 is a timing chart illustrating the operation of various mechanisms in the system of the invention.

The operation of the various electrical circuits contained in the system 31 is described below with reference to the timing chart shown in FIG. 89. When the main switch SM shown in FIG. 87 is closed, the relay coil RA31 becomes energized, whereby its contacts RA31-2 and RA31-1 are closed to connect the lamps L1 to L8 to low voltage and to initiate the drive of the motor M1 in the forward direction. The fan motors M3 and M4 are also operated, theregy colling the lamps L1 to L8. An original may be placed on the receptacle 23 (see FIG. 12) under this condition and the photographing button may be depressed. Upon depression of the button, the photographing switch SP is changed to its contact SPb, whereby the capacitor C2 is discharged through the relay coil RA1 to energize it. As a consequence, its contact RA1-1 is closed to self-hold the relay. The energization of the relay coil RA1 is effective to energize the relay coil RA30, so that its contacts RA30-2*a* and RA30-2*b* are opened while its contacts RA30-2*c* and RA30-2*d* are closed. Consequently, the motor M1 rotates at a speed established by the variable resistor R6, this speed defining the rate of charging the film. Simultaneously, the contacts RA1-2, RA1-3 and RA1-4 are closed. The closure of the contact RA1-2 energizes the solenoid SOL1, so that the movable unit 15 commences to move through its forward stoke. The speed with which the movable unit 15 moves during its forward stroke corresponds to the charging speed mentioned above. The closure of the contact RA1-4 is effective to activiate the charging high voltage generator HV, so that a corona discharge voltage is applied to the discharge electrode. On the other hand, the closure of the contact RA1-3 energizes the relay coil RA14, whereby its contact RA14-1 is closed while its contacts RA14-2*a* and RA14-3*b* are opened. The closure of the contact RA14-1 is effective to self-hold the relay RA14, and as a result of opening the contact RA14-2*a*, the relay coil RA1 can no longer be energized when the photographing switch SP (which is now returned to its open state) is closed again. The opening of the contact RA14-2*b* prevents the energization of the relay coil RA15 in the event the spacing switch SC is inadvertently closed. The closure of the contact RA14-3*a* is effective to turn on the lamp L25 to thereby indicate that the system is in the process of photographing, and the opening of the contact RA14-3*b* turns off the lamp L24 to indicate that the system was ready to initiate the photographing step.

Under this condition, the movable unit 15 traverses through its forward stroke, and as the charger 16 traverses the photosensitive film surface, a corona discharge is directed to the latter, which is therefore charged to an optimum value. When the movable unit 15 has reached the exposure position in which the exposure window 17 is brought into alignment with the optical axis O, the switch S7 is changed, whereby the capacitor C3 is discharged through the relay coil RA2 to energize it. This results in the closure of its contact RA2-1, which serves self-holding the relay. In addition, the contact RA2-2*a* is opened, whereby the relay coil RA1 is deenergized, opening its contacts RA1-1, RA1-2, RA1-3 and RA1-4. The energization of the solenoid SOL1 is maintained by the closure of the contact RA2-3, and also the energization of the relay coil RA14 is maintained by the closure of the contact RA14-1. Therefore, it will be seen that only the relay coil RA1 and the high voltage generator HV are rendered inoperative at this time. Because the drive to the movable unit 15 is interrupted by the clutch mentioned previously at a position in which the switch S7 is closed, the movable unit 15 comes to a stop at a position where the exposure window 17 is aligned with the optical axis O. The deenergization of the relay coil RA1 results in the deenergization of the relay coil RA30, whereby its contacts RA30-2*a* and RA30-2*b* are closed while its contacts RA30-2*c* and RA30-2*d* are opened. Thereupon, the rotational speed of the motor M1 is switched from the charging speed to a speed which is established by the variable resistor R5. The closure of the contact RA2-4 is effective to energize the relay coils RA19 and RA20 and the solenoid SOL4. The energization of the relay coils RA19 and RA20 results in the opening of the contacts RA19-1*b*, RA19-2*b*, and RA20-1*b* and RA20-2*b* and the closure of the contacts RA1901*a*, RA19-2*a* RA20-1*a* and RA20-2*a*, so that the illumination lamps L1 to L8 are switched from low lever illumination to high level illumination or exposure illumination. At the same time, the energization of the solenoid SOL4 is effective to open the shutter blade 22, thereby initiating an exposure.

The exposure period is determined by the time T1 which operates in response to the closure of the contact RA2-2*b*. Upon the lapse of the exposure period, i.e., upon completion of the exposure, when the timer T1 times out to change the switch S11 to its contact S11*b*, the relay coil RA3 becomes energized. This results in the closure of its contact RA3-1 to thereby self-hold the relay RA3, and also results in the deenergization of the relay coil RA2, whereby its contacts RA2-1, RA2-2*b*, RA2-3 and RA2-4 are opened while its contact RA2-2*a* is closed. The opening of the contact RA2-3 results in the deenergization of the solenoid SOL1, so that the movable unit 15 initiates its movement as a result of the clutch mentioned previously becoming operative. Since the contact RA2-4 is open at this time, the relay coils RA19 and RA20 and the solenoid SOL4 are deenergized, whereby the lamps L1 to L8 are switched to low level illumination and the shutter blade 22 is closed. When the relay coil RA3 is energized, its contact RA3-2*a* is closed while its contact RA3-2*b* is opened, whereby the capacitor C4 commences charging. At the same time, the contact RA3-3 is closed to energize the relay coil RA6, so that its contact RA6-2*a* is closed while its contact RA6-2*b* is opened, whereby the capacitor C5 is also charged. The relay RA6 is self-held by the contact RA6-1. The closure of the contact RA3-4 energizes the relay coil RA17, whereby its contact RA17-1 is closed to self-hold this relay. Simultaneously, the contact RA17-2 is closed to activate the solenoid SOL7 shown in FIG. 87, whereby the pressure reducing valve V2 is switched. Also the contact RA17-3 is closed to energize the relay coil RA22, which is self-held by its contact RA22-1. The energization of the relay coil RA22 results in the energization of the relay coil RA26, whereby its contact RA26-1 is closed to energize the solenoid SOL10, thereby switching the suction valve V5 and causing the film to be sucked against the pressure plate 13.

When the movable unit 15 has moved to the developing position under this condition, the switch S8 is opened. Since the clutch is mechanically disengaged as mentioned previously when the movable unit 15 has moved to this position, its movement parallel to the film surfce, i.e., its forward stroke, is terminated. Now the relay coil RA3 is deenergized to open its contacts RA3-1, RA3-3, RA3-4 and RA3-2*a* and to close its contact RA3-2*b*. This results in a momentary energization of the relay coil RA24 by the discharge of the capacitor C4, so that the contact RA24-1 is closed to energize the solenoid SOL2, whereby the spring clutch mentioned previously is operated to transmit the drive from the motor M1 to the rotary shaft 71 (see FIG. 12), causing the movable unit 15 to move toward the film surface in order to define the developing chamber 240. When the developing chamber is formed, the pin 94 switches the switch S9, whereby the relay coil RA4 is energized through the contact RA8-2*a* and the diode *d*3. As a result, its contacts RA4-1, RA4-2 and RA4-3 are closed, thus self-holding the relay RA4 with its contact RA4-1. The closed contact RA4-2 initiates the operation of the developing timer T2, while the closed contact RA4-3 energizes the solenoid SOL5. The energization of the solenoid SOL5 results in a flow of a constant quantity of developing solution DP into the developing chamber 240 from the metering tank 241 (see FIG. 45), thus initiating the developing process. Upon lapse of the developing period established by the time T2, the switch S12 is changed to its contact S12*b*, whereby the relay coil RA5 is energized. At the same time, the relay coil RA4 is deenergized, whereby its contacts RA4-1, RA4-2 and RA4-3 are opened. The energization of the relay coil RA5 results in the closure of its contacts RA5-1 to RA5-4. The closed contact RA5-1 self-holds the relay RA5, while the closed contact RA5-2 operates the time T4 which provides a preset timing, e.g., 0.5 seconds. The closed contact RA5-3 energizes the relay coil RA8, which is self-held by its closed contact RA8-1. Also the contact RA8-2 is closed to energize the solenoid SOL6, and the contact RA8-2*b* is closed while the contact RA8-2*a* is opened. The energization of the solenoid SOL6 results in the operation of the drainage control valve V1, whereby the developing solution DP within the developing chamber 240 is drained to the tank 41 (see FIG. 45) because the pressure within the latter is reduced. The closure of the contact RA5-4 is effective to energize the relay coil RA29, so that its contacts RA29-1, RA29-2*a* and RA29-2*b* (see FIG. 87) are closed while its contacts RA29-2*c* and RA29-2*d* are opened. The closed contact RA29-1 self-holds the relay RA29, and the closure of the contacts RA29-2*a* and RA29-2*b* causes the motor M1 to rotate at a speed established by the variable resistor R3. This rotation takes place at a relatively slow speed. In the meantime, the timer T4 times out after the 0.5 seconds interval has elapsed to open the switch S13. This results in the deenergization of the relay coil RA5 with resulting opening of its contacts RA5-1, RA5-2, RA5-3 and RA5-4. The opening of the switch S13 also deenergizes the relay coil RA6, whereby its contacts RA6-1 and RA6-2*a* are opened while its contact RA6-2*b* is closed. The closure of the contact RA6-2*b* causes the capacitor C5 to be discharged through the relay coil RA24 again, so that the latter is energized to result in the energization of the solenoid SOL2, whereby the rotary shaft 71 (see FIG. 12) rotates to move the movable unit 15 away from the film. When the movable unit 15 has returned to a given position, the switch S9 is returned to its contact S9*b* again, so that the capacitor C6 is now discharged through the relay coil RA7 to energize it. This results in the closure of the self-holding contact RA7-1, and also the closure of the contact RA7-2 to operate the timer T5 which provides a timing interval of, e.g., 0.5 seconds.

The energization of the relay coil RA7 opens its contact RA7-3, so that the relay coil RA17 is deenergized to open its contact RA17-2 (see FIG. 87), whereby the solenoid SOL7 is deenergized to change the pressure reducing valve V2 and interrupting the pressure reducing action. Also the contact RA17-3 is opened to deenergize the relay coil RA22, and this also results in the deenergization of the relay coil RA26. This opens the contact RA26-1 (see FIG. 87), so that the solenoid SOL10 becomes inoperative, switching the suction valve V5 to its initial position and disabling the suction applied to the film on the pressure plate 13.

The energization of the relay coil RA7 closes its contact RA7-3*a*, whereby the relay coil RA18 is energized. This results in the closure of the contact RA18-1 to self-hold the relay RA18, and also results in the closure of the contact RA18-1*a* to energize the relay coil RA23, which is self-held by its contact RA23-1 and which closes its contacts RA23-3 and RA23-4. This results in the energization of the solenoids SOL8 and SOL9, whereby the pressure increasing valve V3 and the liquid supply controlling valve V4 are operated to pump the developing solution within the tank 41 into the reservior 241. At this time, the switch S4 is closed. When the float 251 (see FIG. 45) has risen to a given level the switch S4 is opened, whereby the solenoids SOL8 and SOL9 become deenergized to terminate the pumping of the developing solution.

The energization of the relay coil RA18 results in opening the contacts RA18-2*b* and RA18-3*b* (see FIG. 87) and closing the contacts RA18-2*a* and RA18-3*a* (see FIG. 87), whereby the motor M1 begins to rotate in the reverse direction. At the same time, the contacts RA7-4*a* and RA7-4*b* are opened. As a result, the relay coil RA29 is deenergized, so that its contacts RA29-2*a* and RA29-2*b* are opened while its contacts RA29-2*c* and RA29-2*d* are closed, thereby causing the motor M1 to rotate in the reverse direction at a speed established by the variable resistor R5. This operation is allowed for a period of time which is the 0.5 seconds interval established by the time T5. When the timer T5 times out, the switch S14 is opened to deenergize the relay coils RA7 and RA8, whereby the timer T5 is deenergized. The contact RA7-3 is closed while the contact RA7-3*a* is opened. The contact RA8-2*a* is closed while the contact RA8-2*b* is opened.

Now the movable unit 15 commences to move through its reverse stroke. When it reaches its starting position, the switch S10 is thrown to its contact S10b, whereby the capacitor C7 discharges through the relay coil RA9 to energize it. Thereupon, the contact RA9-1 is closed to self-hold this relay, and the contact RA9-2 is closed to operate the drying timer T3. Dry air is supplied through the hole 27 to be blown against the developed film surface for a period of time determined by the timer T3 for the purpose of fixing the image. This completes one microphotograph frame. When the timer T3 times out, the switch S15 is thrown to its contact S15*b*, whereby the relay coil RA9 is deenertized and the relay coil RA10 is energized. The resulting closure of the contact RA10-1 permits the relay coil RA25 to be energized, so that its contact RA25-1 is closed to energize the solenoid SOL3 and to thereby commence a new one-frame film feeding operation.

Before this occurs, the opened contact RA9-2*a* deenertizes the relay coil RA18, so that its contacts RA18-1 and RA18-1*a* are opened to thereby deenergize the relay coil RA23, thus opening its contacts RA23-1, RA23-3 and RA23-4. Since the contacts RA18-2*a* and RA18-3*a* are opened while the contacts RA18-2*b* and RA18-3*b* are closed, the motor M1 starts to rotate in the forward direction again. However, because the clutch renders the drive mechanism for the movable unit 15 inoperative, the unit 15 remains stationary.

When the solenoid SOL3 is energized, the forward and reverse rotation change-over switch S1 is changed to its forward position, causing the film transport motor M2 to rotate in the forward direction, whereby a normal film feeding operation by one frame occurs as mentioned previously in connection with the film feed mechanism.

When the first to eleventh frames have thus been fed, the switch S20 is changed to its other position, whereby the capacitor C13 discharges through the relay coil RA27. This opens the contact RA27-1 to deenergize the relay coil RA14. Also the energization of the relay coil RA27 opens its contact RA27-2, so that the relay coil RA26 is deenergized to open its contact RA26-1, thereby deenergizing the solenoid SOL10.

Each time the film is fed by one frame, the switch S17 is operated to cause the capacitor C9 to discharge through the relay coil RA11, causing the contact RA11-1 of the stepping raly SPR to advance by one step to turn on the successive lamps, thus indicating to which frame the electrophotographic processings are then being applied. When the twelfth frame is processed, the relay coil RA12 is energized to open its contacts RA12-1*a* and RA12-2*b* and to close its contracts RA12-1*b* and RA12-2*a*, whereby the capacitor C11 discharges through the relay coil RA28 to energize it. At the same time, the capacitor C12 is permitted to discharge through the relay coil RA27 to energize it when the switch S19 is switched. The energization of the relay coil RA 27 opens its contacts RA27-1 and RA27-2 to deenergize the relay coil RA 26. This results in the opening of the contact RA26-1, deenergizing the solenoid SOL10 and disabling the film sucking operation through the pressure plate 13. Therefore, the idle film feeding of 4 frames can take place in a normal manner.

When transporting the leader portion of the film, the switch S16 is changed to its contact S16*b* to enertize the relay coil RA25. Thereupon, the contact RA25-1 is closed to energize the solenoid SOL3, and the film transport occurs by switching the switch S1 to its forward position. This operation has been described previously.

When the spacing switch SC is changed to its other position SCb, the capacitor C10 is discharged through the relay coil RA15 to enertize it. This results in the closure of its contacts RA15-1, RA15-2 and RA15-3. The closed contact RA15-1 self-holds the relay, and the closed contact RA15-2 energizes the relay coil RA14, whereupon its contact RA14-1 is closed to self-hold the relay while its contact RA14-2*a* is opened to make the switching of the photographing switch SP ineffective. The contact RA14-2*b* is opened, so that an operation of the spacing switch SC for the second time in ineffective. The closed contact RA15-3 maintains the energization of the relay coil RA25 through the diode *d*10. When the film has been fed by 16 frames, the relay coil RA28 is energized to open its contact RA28-1, thereby deenergizing the relay coil RA15. This results in the deenergization of the relay coil RA25, so that the solenoid SOL3 returns to its inoperative condition in the similar manner as mentioned previously in connection with the completion of the film feeding initiated by the operation of the spacing switch SC.

When the supply of the film remaining in the system is exhausted or reduced to a certain level in the course of feeding 16 frames, this is detected by the switch S18 which is closed to energize the relay coil RA16. Thereupon, the contact RA16-2 is closed to self-hold this relay. When 12 frames have been fed under this condition, the discharge of the capacitor C11 through the relay RA28 energizes the latter, to close its contact RA28-2, which serves together with the closed contact RA16-1 to energize the relay coil RA13. Thereupon, the relay RA13 is selfheld by its closed contact RA13-1, and since the contact RA16-3 is opened, the depression of the photographing switch SP remains without effect. Since the contact RA13-3 is also opened, the spacing switch SC is also disabled. Such condition can be announced by a film end indication which is enabled by the closure of the contact RA13-2*b*. The release of the relay coils RA16 and RA13 is effected by means of the switch S5. This completes one cycle of the operation of the illustrated electrical circuits.

We claim:

1. A system for forming microfilm electrophotographic images of originals, comprising:
- a pressure plate located at an imaging position;
- means for delivering a length of film corresponding to one microfilm frame to the imaging position against the pressure plate;
- an original receptacle and means for illuminating an original placed thereon;
- an optical system for focusing the light image of an original placed on the original receptacle onto the microfilm frame on the pressure plate;
- a movable unit including a charger, an exposure window and developing means including a vessel of developing solution;
- means for registering the charger of the movable unit with the microfilm frame on the pressure plate and for charging the microfilm therewith;
- means for subsequently registering the exposure window of the movable unit with the charged microfilm frame on the pressure plate;
- exposure means and means for causing the incidence of the original image on the microfilm frame through the exposure window of the movable unit while said exposure window is registered with the frame on the pressure plate to thereby expose the microfilm frame and form thereon a latent image of the original;
- means for subsequently registering the developing means with the exposed microfilm frame, means for forming a liquid-tight developing chamber while the developing means is registered with the microfilm frame, one wall of said chamber being formed by the microfilm frame surface carrying the latent image, and means for introducing developing solution from said vessel into said chamber and for contacting the exposed frame with said developing solution in the chamber to thereby develop the latent image;
- means for subsequently moving the movable unit away from the developed frame; and
- means for fixing the developed image on the microfilm frame;
- wherein the pressure plate and the microfilm frame which is in the imaging position extend along parallel vertical planes and remain in fixed positions in their respective vertical planes throughout the period in which said microfilm frame is charged, exposed, developed and fixed.

2. A system as in claim 1 including means for resiliently mounting the pressure plate for movement toward and away from the imaging position and means for moving the pressure plate away from the imaging position after the fixing of one developed microfilm frame and prior to delivering a successive microfilm frame to the imaging position, to thereby prevent damage to the microfilm during the advancing thereof.

3. A system as in claim 1 wherein the film is stored in roll form and has a leading edge, and the film delivering means comprises first means for advancing the leading edge of the film away from the roll and past the imaging position by a defined number of blank frames while the movable unit remains stationary, to thereby provide a blank leader of a selected length.

4. A system as in claim 3 wherein the film delivering means comprises second advancing means operative after the film is advanced by the predetermined number of blank frames to advance the film by a single frame upon the completion of fixing the developed image of a microfilm frame, and means for stopping the operation of the second advancing means after it has advanced a second predetermined number of frames and for restarting the operation of the second advancing means after the first advancing means has advanced a subsequent length of film by the predetermined number of blank frames.

5. A system as in claim 4 including means responsive to an operator provided signal for causing the second advancing means to advance the film while the movable unit remains stationary for a selected number of frames.

6. A system as in claim 5 including means for severing the advanced film at a line separating said predetermined number of blank frames and said predetermined number of fixed image frames.

7. A system as in claim 1 wherein said original receptacle comprises a white diffused surface in the marginal areas surrounding the region for accepting the original to thereby project white light to discharge the margin of the microfilm frame surrounding the central area of the desired image of the original while the microfilm frame on the pressure plate is being exposed to said light image of the original.

8. A system as in claim 1 wherein the optical system comprises a first and second reflecting mirror and a taking lens, the first reflecting mirror disposed above the original receptacle for reflecting the light image thereof toward the second reflecting mirror, the second reflecting mirror reflecting the light image from the first reflecting mirror toward the microfilm frame on the pressure plate, and the taking lens interposed between the second mirror and the microfilm frame to focus the original image onto the microfilm frame on the pressure plate.

9. A system as in claim 1 wherein the charger includes a corona discharge unit fixedly mounted on the movable unit and a voltage source for applying charging potential thereto, and wherein the means for registering the charger with the microfilm frame on the pressure plate includes means for sweeping the microfilm frame at a constant rate to thereby charge it.

10. A system as in claim 1 wherein the exposure window comprises a frame interposed in the path of the light beam incident on the microfilm frame from the optical system to define the image field on the microfilm frame exposed thereby.

11. A system as in claim 10 wherein the image field defined by the exposure window is larger than and includes the image field charged by the charger.

12. A system as in claim 11 wherein the image field developed by the developing means is larger than and includes the image field exposed through the exposure window.

13. A system as in claim 1 including a developing solution supply unit comprising a tank and an injection and suction air pump connecting the tank with the vessel of developing solution included in the movable unit, a metering tank interposed between the developing chamber and the vessel of developing solution and means for setting the metering tank with an amount of solution from the vessel sufficient to fill the developing chamber and for subsequently transferring said amount of solution to the developing chamber, and means for subsequently draining the developing chamber of all developing solution.

14. A system as in claim 1 including a fixed mounting plate disposed parallel to the pressure plate, means for slidably mounting the movable unit for reciprocating motion along the mounting plate in a plane parallel to the pressure plate, each reciprocating motion including a charging, an exposure, a developing and a fixing position of the movable unit, and each reciprocating motion starting from the previously reached fixing position.

15. A system as in claim 14 including means operative when the movable unit first reaches its developing position to move the movable unit toward the pressure plate, for maintaining the movable unit against the pressure plate during developing and for subsequently moving the movable unit away from the pressure plate prior to the continuation of the reciprocating motion of the movable unit in a plane parallel to the pressure plate.

16. A system for forming microfilm electrophotographic images of originals, comprising:

a pressure plate located at an imaging position;

means for delivering a length of film corresponding to one microfilm frame to the imaging position against the pressure plate;

an original receptacle and means for illuminating an original placed thereon;

an optical system for focusing the light image of an original placed on the original receptacle onto the microfilm frame on the pressure plate;

a movable unit including a charger, an exposure window and developing means including a vessel of developing solution;

means for registering the charger of the movable unit with the microfilm frame on the pressure plate and for charging the microfilm therewith;

means for subsequently registering the exposure window of the movable unit with the charged microfilm frame on the pressure plate;

exposure means and means for causing the incidence of the original image on the microfilm frame through the exposure window of the movable unit while said exposure window is registered with the frame on the pressure plate to thereby expose the microfilm frame and form thereon a latent image of the original;

means for subsequently registering the developing means with the exposed microfilm frame and for contacting the exposed frame with developing solution from said vessel to thereby develop the latent image;

means for subsequently moving the movable unit away from the developed frame; and means for fixing the developed image on the microfilm frame;

wherein the surface of the pressure plate facing the imaging position includes a film suction groove formed within the region thereof facing the microfilm frame that is in its imaging position, and wherein the system includes means for applying vacuum to said suction groove to thereby hold the microfilm frame against the pressure plate.

17. A system as in claim 16 wherein the surface of the pressure plate having the film suction groove is formed with cleaning grooves disposed around the surface region facing the microfilm frame and wherein the system includes means for applying vacuum to said cleaing grooves subsequently to the developing of the latent image on the microfilm frame to thereby remove residual developing solution from the marginal area of the developed image of the original.

18. A system for forming microfilm electrophotographic images of originals, comprising:

a pressure plate located at an imaging position;

means for delivering a length of film corresponding to one microfilm frame to the imaging position against the pressure plate;

an original receptacle and means for illuminating an original placed thereon;

an optical system for focusing the light image of an original placed on the original receptacle onto the microfilm frame on the pressure plate;

a movable unit including a charger, an exposure window and developing means including a vessel of developing solution;

means for registering the charger of the movable unit with the microfilm frame on the pressure plate and for charging the microfilm therewith;

means for subsequently registering the exposure window of the movable unit with the charged microfilm frame on the pressure plate;

exposure means and means for causing the incidence of the original image on the microfilm frame through the exposure window of the movable unit while said exposure window is registered with the frame on the pressure plate to thereby expose the microfilm frame and form thereon a latent image of the original;

means for subsequently registering the developing means with the exposed microfilm frame and for contacting the exposed frame with developing solution from said vessel to thereby develop the latent image;

means for subsequently moving the movable unit away from the developed frame; and means for fixing the developed image on the microfilm frame;

wherein the film delivering means comprises means for rotatably supporting a roll of electrophotographic microfilm, a transport drum supported for rotation about an axis parallel to that of the film roll, means for unwinding microfilm from the roll and for passing the unwound microfilm around a portion of the circumference of the transport drum whose curvature is opposite that of the film in the roll to thereby remove the tendency of the unwound film to curl and means for guiding the leading edge of the microfilm unwound from the roll between the pressure plate and the movable unit in a direction away from the film roll.

* * * * *